US008662908B2

(12) United States Patent
Harada

(10) Patent No.: US 8,662,908 B2
(45) Date of Patent: Mar. 4, 2014

(54) CARD CONNECTOR

(75) Inventor: Keita Harada, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 1022 days.

(21) Appl. No.: 12/725,701

(22) Filed: Mar. 17, 2010

(65) Prior Publication Data

US 2010/0248551 A1 Sep. 30, 2010

(30) Foreign Application Priority Data

Mar. 24, 2009 (JP) ..... 2009-072693

(51) Int. Cl.
*H01R 29/00* (2006.01)

(52) U.S. Cl.
USPC ..... 439/188; 439/630

(58) Field of Classification Search
USPC ..... 439/636, 630, 260, 65, 152, 153, 326, 439/159, 160, 946
See application file for complete search history.

(56) References Cited

U.S. PATENT DOCUMENTS

| | | | | |
|---|---|---|---|---|
| 6,120,310 | A * | 9/2000 | Chang | 439/188 |
| 6,435,887 | B2 * | 8/2002 | Koitsalu | 439/188 |
| 6,749,450 | B1 * | 6/2004 | Chen | 439/188 |
| 6,896,532 | B2 * | 5/2005 | Chang | 439/188 |
| 7,101,206 | B2 * | 9/2006 | Chang | 439/188 |
| 7,112,077 | B2 * | 9/2006 | Kikuchi | 439/188 |
| 2009/0111288 | A1 * | 4/2009 | Harada | 439/59 |

FOREIGN PATENT DOCUMENTS

JP 2009-110742 A 5/2009

* cited by examiner

*Primary Examiner* — Renee Luebke
*Assistant Examiner* — Larisa Tsukerman
(74) *Attorney, Agent, or Firm* — IPUSA, PLLC

(57) ABSTRACT

A card connector includes a housing including an insertion part into which a card is to be inserted; and a switch mechanism including a movable terminal and multiple fixed terminals. The movable terminal is configured to deform elastically in response to being pressed by the card upon the insertion of the card into the insertion part. The fixed terminals are provided in a direction in which the movable terminal is displaced by the elastic deformation. The movable terminal is configured to be in contact with or out of contact with at least one of the fixed terminals based on the amount of displacement of the movable terminal according to the presence or absence of the card in the insertion part and the shape of the card.

10 Claims, 52 Drawing Sheets

CARD CONNECTOR

CROSS-REFERENCE TO RELATED APPLICATION

The present application is based upon and claims the benefit of priority of Japanese Patent Application No. 2009-072693, filed on Mar. 24, 2009, the entire contents of which are incorporated herein by reference.

BACKGROUND OF THE INVENTION

1. Field of the Invention

The present invention generally relates to card connectors. The present invention more particularly relates to a card connector having a switch mechanism configured to detect insertion of a card.

2. Description of the Related Art

Electronic apparatuses such as digital cameras, portable phones, printers, and portable terminal devices (for example, personal computers) use a memory card into which an IC memory is packaged as a storage medium. This type of memory card, which can be reduced in size and thickness and be increased in capacity, has been attached to more and more electronic apparatuses.

Further, in electronic apparatuses, there is a demand for a card connector that allows selective attachment of various types of memory cards different in shape.

Here, a description is given, with reference to FIG. 1 and FIG. 2, of a card connector of related art.

FIG. 1 is a perspective view of a card connector configured to allow selective insertion of various types of memory cards different in shape. FIG. 2 is an exploded perspective view of the card connector of FIG. 1. FIG. 3 is a cross-sectional view of the card connector of FIG. 1 taken along line A-A.

In the drawings, X1-X2 (the X-axis) indicates the directions of width, Y1-Y2 (the Y-axis) indicates the directions of length, and Z1-Z2 (the Z-axis) indicates the directions of thickness (height) of the card connector or a memory card. Further, Y1 indicates the direction in which the memory card is inserted into the card connector, and Y2 indicates the direction in which the memory card is ejected from the card connector.

A description is given of a general configuration of the card connector.

Referring to FIG. 1 through FIG. 3, a memory card connector 60 includes a lower housing module 70, an upper housing 100 stacked on the upper surface of the lower housing module 70, and a metal-plate cover member 120 that covers the upper housing 100. A misinsertion preventing member 130, a first detection switch 140, and a second detection switch 160 are provided inside the memory card connector 60. The memory card connector 60 has an insertion opening 61 at its Y2 end. The insertion opening 61 includes a lower insertion slot (opening) 62 corresponding to the lower housing module 70 and an upper insertion slot (opening) 63 corresponding to the upper housing 100.

The memory card connector 60 is mounted on the printed circuit board of an electronic apparatus to be incorporated into the electronic apparatus so that the insertion opening 61 is exposed on the exterior surface of the electronic apparatus.

A first memory card 20 (for example, an SD memory card), a second memory card 30 (for example, a memory stick), and a third memory card 40 (for example, a multimedia card) are selectively attachable to the lower insertion slot 62 of the memory card connector 60. Further, a fourth memory card 50 (for example, a memory stick Duo) is attachable to the upper insertion slot 63 of the memory card connector 60.

Here, the third memory card 40 and the fourth memory card 50 have the same terminal arrangement. The fourth memory card 50 is three-fifths as long as the second memory card 30. The first memory card 20 and the third memory card 40 have substantially the same outside dimensions, substantially the same length as the fourth memory card 50, a little larger width than the second memory card 30, and the same terminal arrangement, but are different in that the first memory card 20 has a writing indication member 23.

Next, a description is given of a structure of the lower housing module 70.

Referring to FIG. 2 and FIG. 3, the lower housing module 70 is an insert-molded component (a component formed by insert molding) having multiple contact members 80 and multiple double-contact members 90 insert-molded into a lower housing body 71 of synthetic resin. Further, a pair of movable terminal members 141 and 161 is press-fit into and fixed to the lower housing body 71.

The lower housing body 71, which has a substantially quadrilateral frame shape, includes an X1-side frame rod 72, an X2-side frame rod 73, and three horizontal parts 74, 75, and 76. The frame rods 72 and 73 have respective guide grooves 72*a* and 73*a* on their interior side.

The contact members 80 are inserted into the horizontal part 74 positioned near the lower insertion slot 62, and are arranged side by side in correspondence to the terminals of each of the first memory card 20 and the third memory card 40.

The double-contact members 90 are insert-molded into the Y1-end horizontal part 76. Referring to FIG. 3, each double-contact member 90 has a (shorter) contact arm part 91, a (longer) contact arm part 92 longer than the contact part 91, and a lead terminal part 94. The contact arm part 91, the contact arm part 92, and the lead terminal part 94 are connected at a base 93 of the contact arm part 91. The lead terminal part 94 extends in the Y1 direction from the base 93 of the contact arm part 91. The contact arm part 91 is insert-molded into the horizontal part 76.

The contact arm parts 91 of the double-contact members 90 are arranged side by side in correspondence to the arrangement of the terminals of the second memory card 30. The contact arm parts 92 are positioned on the Z1 side relative to the frame rods 72 and 73 in a vertical direction so as to extend in the Y2 direction, and are arranged side by side in correspondence to the arrangement of the terminals of the fourth memory card 50.

Next, a description is given of a shape of the upper housing 100.

Referring in particular to FIG. 2, the upper housing 100, which is a molded component of synthetic resin, has a frame shape including an X1-side frame rod 101, an X2-side frame rod 102, and two horizontal parts 103 and 104. The frame rods 101 and 102 have respective guide grooves 101*a* and 102*a* on their interior side. Multiple through holes 105 are formed in the horizontal part 104. The contact arm parts 92 of the double-contact members 90 penetrate through the corresponding through holes 105.

Next, a description is given of attachment of memory cards to the memory card connector 60.

Referring to FIG. 2 and FIG. 3, the lower housing module 70 has an internal space for attaching the first memory card 20, the second memory card 30, and the third memory card 40. The upper housing 100 has an internal space for attaching the fourth memory card 50.

When the fourth memory card 50 is not attached, one of the first memory card 20, the second memory card 30, and the fourth memory card 40 is selectively attached to the memory card connector 60 through the lower insertion slot 62.

On the other hand, when none of the first memory card 20, the second memory card 30, and the third memory card 40 is attached, the fourth memory card 50 is attached to the memory card connector 60 through the upper insertion slot 63. The fourth memory card 50 is attached with its terminals in contact with the corresponding contact arm parts 92.

When the first memory card 20, the second memory card 30, or the fourth memory card 40 is attached, the misinsertion preventing member 130 is pressed in the Y1 direction by the attached memory card 20, 30, or 40. As a result, the misinsertion preventing member 130 is rotated approximately 90° in the counterclockwise direction in FIG. 3 so as to prevent the fourth memory card 50 from being attached to the memory card connector 60 in the upper housing 100.

On the other hand, when the fourth memory card 50 is attached, the misinsertion preventing member 130 is held by the attached fourth memory card 50. As a result, the misinsertion preventing member 130 is rotated approximately 90° in the clockwise direction in FIG. 3 so as to prevent the first memory card 20, the second memory card 30, or the third memory card 40 from being attached to the memory card connector 60 in the lower housing body 71.

Next, a description is given of a structure of the first detection switch 140 and a structure of the second detection switch 160.

The first detection switch 140 detects attachment of the first memory card 20 and the third memory card 40. The first detection switch 140 includes the movable terminal member 141 and a fixed terminal part 125 (FIG. 1) formed by cutting and raising part of a side plate part 123 (FIG. 1) of the cover member 120.

The movable terminal member 141 is fixed to the frame rod 73 with the base part of the movable terminal member 141 press-fit into and fixed to a corresponding slit of the frame rod 73. As illustrated in FIG. 2, the movable terminal member 141 has an arm part 145 and a horseshoe contact part 146. Bending of the arm part 145 allows the contact part 146 to be displaced in the X1 and X2 directions. That is, the contact part 146 is displaced in the same direction as the end of the arm part 145 is bent.

When the first memory card 20 or the third memory card 40 is attached, part of the X2-side surface of the first memory card 20 or the third memory card 40, which part is near the end of the X2-side surface in the insertion direction, presses away the arm part 145 in the X2 direction, so that the arm part 145 is bent in the X2 direction. As a result of this elastic deformation of the arm part 145, the contact part 146 is displaced in the X2 direction to approach the fixed terminal part 125, and the end part of the contact part 146 comes into contact with the fixed terminal part 125. As a result, the first detection switch 140 is turned ON to output a card detection signal.

The second detection switch 160 detects the position of the writing indication member 23 to determine whether the writing indication member 23 of the first memory card 20 is at a write enable position P2 or a write inhibit position P1 (FIG. 1). The second detection switch 160 includes the movable terminal member 161 and a fixed terminal part 129 (FIG. 1) formed by cutting and raising part of the side plate part 123 of the cover member 120.

The movable terminal member 161 has substantially the same configuration as the above-described movable terminal member 141. Referring to FIG. 2, the movable terminal member 161 includes an arm part 165 and a horseshoe contact part 166 at the end of the arm part 165.

When the writing indication member 23 of the first memory card 20 is at the write inhibit position P1, the second detection switch 160 does not come into contact with the writing indication member 23, thereby remaining OFF. On the other hand, when the writing indication member 23 of the first memory card 20 is at the write enable position P2, the arm part 165 of the second detection switch 160 comes into contact with the writing indication member 23 to be pressed away in the X2 direction, so that the contact part 166 comes into contact with the fixed terminal part 129 provided on the cover member 120. As a result, the second detection switch 160 is turned ON to output a write enable detection signal.

The memory card connector 60 is configured to be mounted on the printed circuit board of an electronic apparatus with the leg parts of the cover member 120 being screwed to the printed circuit board and soldered to ground patterns. The lead terminal part of the movable terminal member 141 and the lead terminal part of the movable terminal member 161 are soldered to the corresponding pads of a detector circuit on the printed circuit board. Accordingly, when the first detection switch 140 and the second detection switch 160 are turned ON or OFF, the corresponding detection signals are input to the detector circuit, so that the electronic apparatus in which the memory card connector 60 is mounted performs control in accordance with the combinations of the detection signals.

SUMMARY OF THE INVENTION

According to one aspect of the present invention, a card connector includes a housing including an insertion part into which a card is to be inserted; and a switch mechanism including a movable terminal and a plurality of fixed terminals, the movable terminal being configured to deform elastically in response to being pressed by the card upon an insertion of the card into the insertion part, the fixed terminals being provided in a direction in which the movable terminal is displaced by the elastic deformation, wherein the movable terminal is configured to be in contact with or out of contact with at least one of the fixed terminals based on an amount of the displacement of the movable terminal according to a presence or absence of the card in the insertion part and a shape of the card.

The object and advantages of the embodiments will be realized and attained by means of the elements and combinations particularly pointed out in the claims.

It is to be understood that both the foregoing general description and the following detailed description are exemplary and explanatory and not restrictive of the invention as claimed.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Figure 1:
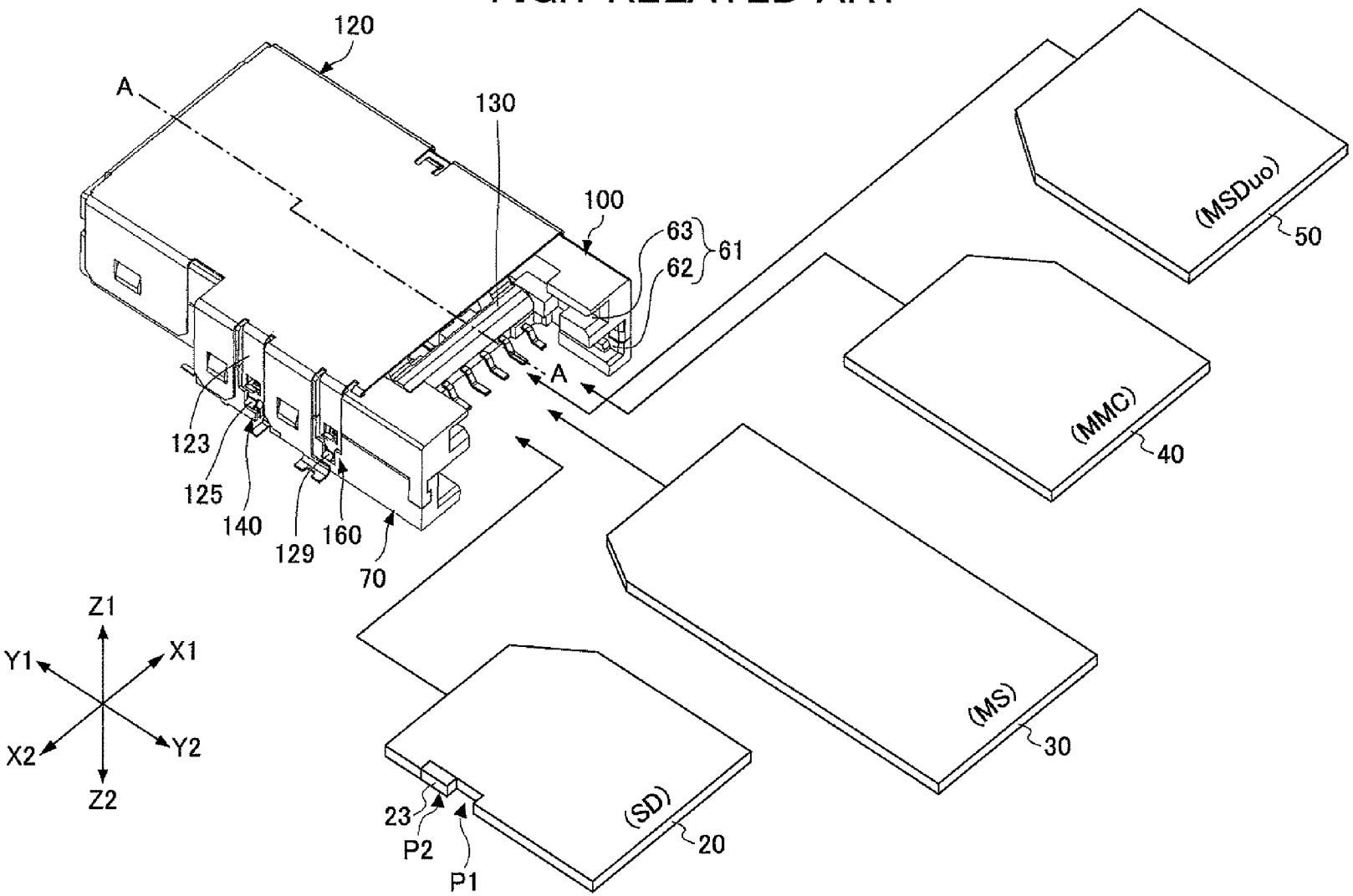
FIG.1 RELATED ART
FIG. 1 is a perspective view of a card connector configured to allow selective insertion of various types of memory cards different in shape.

In the above-described memory card connector 60 (FIG. 1), however, the first detection switch 140 for detecting insertion of a memory card and the second detection switch 160 for detecting the enablement or inhibition of writing to the memory card are provided. This complicates the configuration of the side surface of the memory card connector 60 (the side plate part 123 of the cover member 120), so that the movable terminal members 141 and 161 (FIG. 2) of the first and second detection switches 140 and 160, respectively, are provided close to each other in a narrow space. As a result, in the case of reducing the size of the memory card connector 60, it is difficult to dispose the movable terminal members 141 and 161 without mutual interference, and the assembling operation needs delicacy. This makes it difficult to improve production efficiency.

According to one aspect of the present invention, there is provided a card connector that includes a housing including an insertion part into which a card is to be inserted; and a switch mechanism including a movable terminal and multiple fixed terminals. The movable terminal is configured to deform elastically in response to being urged by the card upon the insertion of the card into the insertion part. The fixed terminals are provided in a direction in which the movable terminal is displaced by the elastic deformation. The movable terminal is configured to be in contact with or out of contact with at least one of the fixed terminals based on the amount of displacement of the movable terminal according to the presence or absence of the card in the insertion part and the shape of the card.

Thus, according to one aspect of the present invention, a single movable terminal comes into contact with (ON) or loses contact with (OFF) one or more of multiple fixed terminals by changing the amount of its displacement in accordance with the state of an inserted card. As a result, the number of movable terminals is reduced to facilitate assembly of a connector, thus making it possible to improve production efficiency.

A description is given below, with reference to the accompanying drawings, of embodiments of the present invention.

[a] First Embodiment

Figure 2:
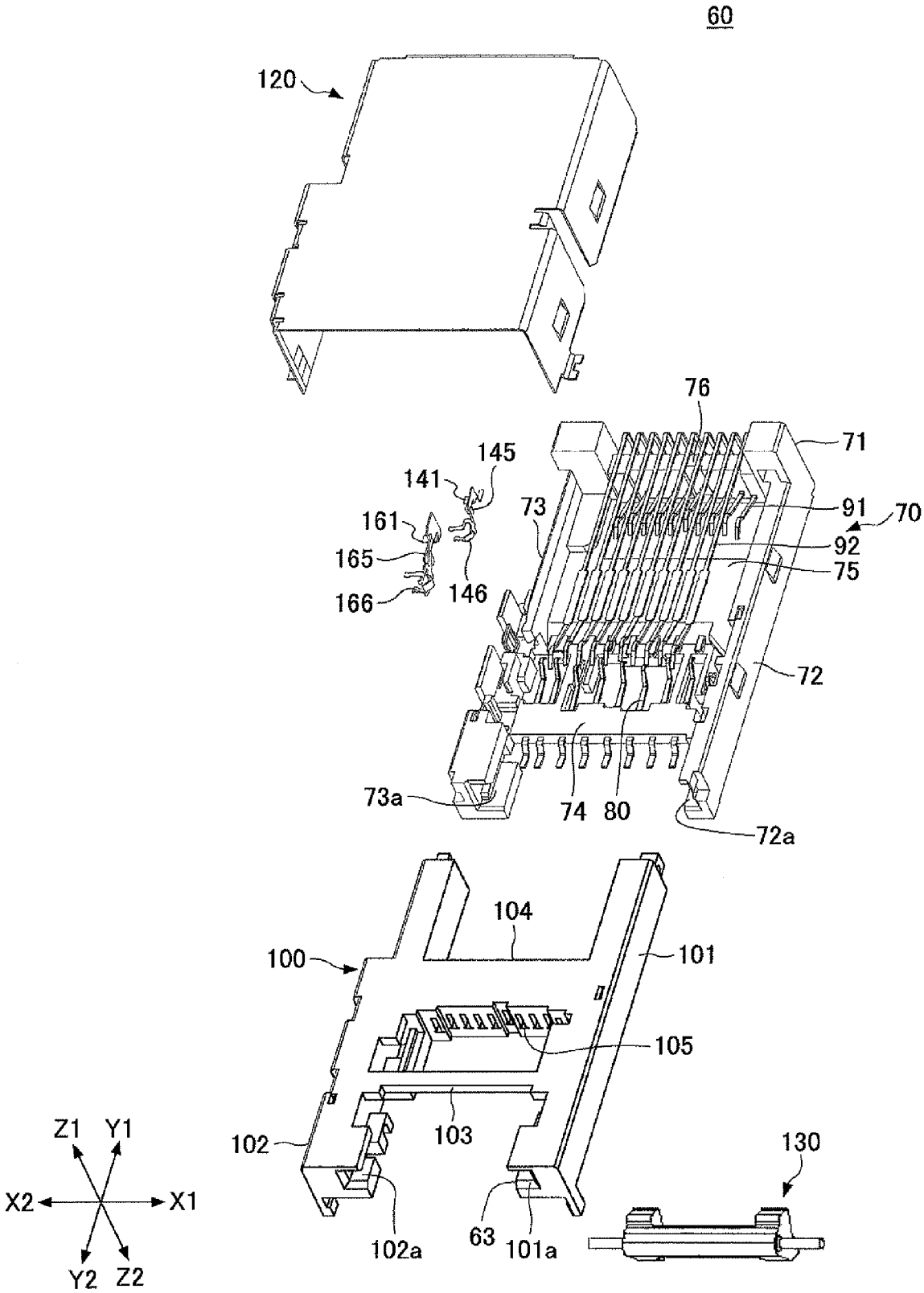
FIG.2 RELATED ART
FIG. 2 is an exploded perspective view of the card connector of FIG. 1.
Figure 3:
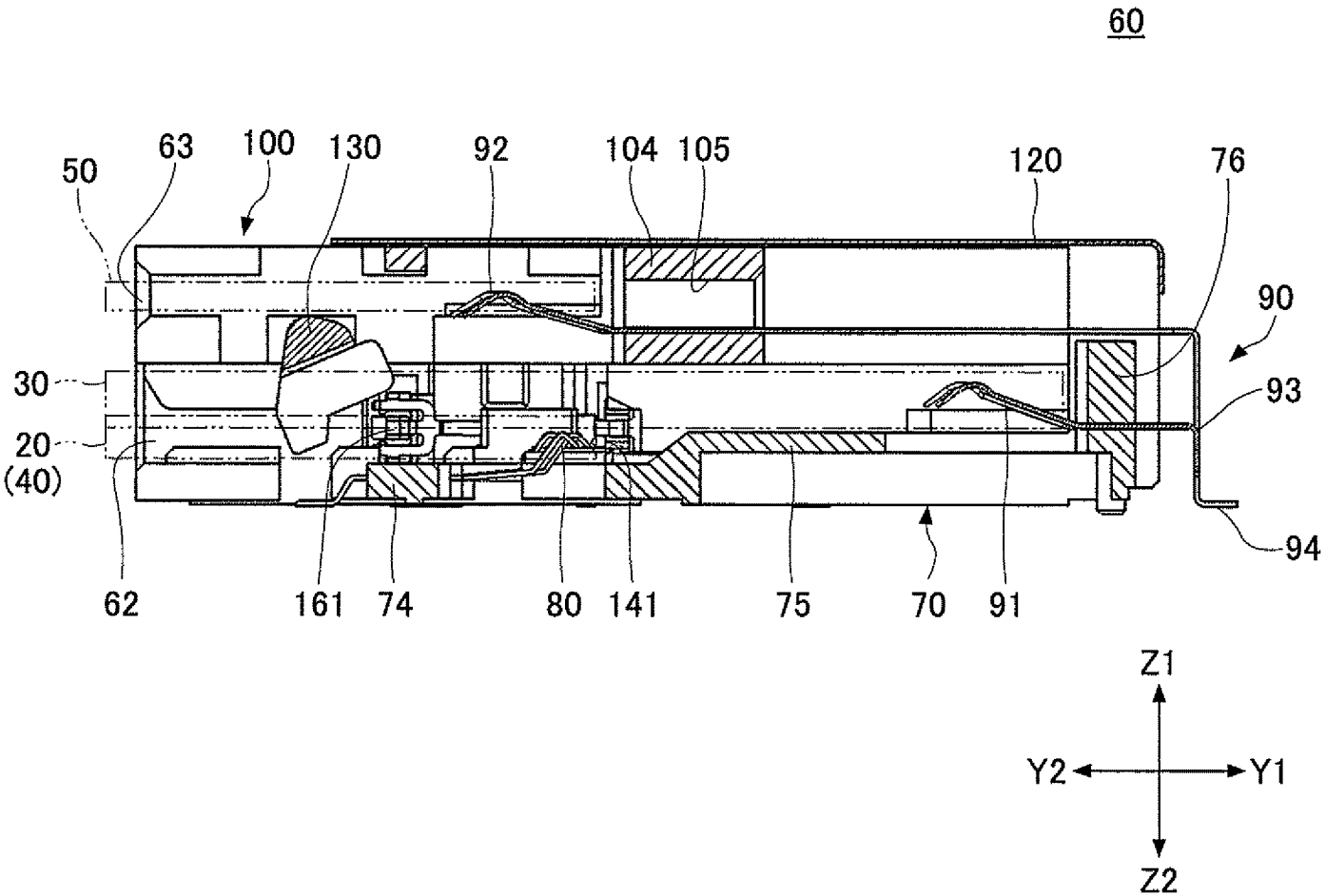
FIG.3 RELATED ART
FIG. 3 is a cross-sectional view of the card connector of FIG. 1 taken along line A-A.
Figure 4:
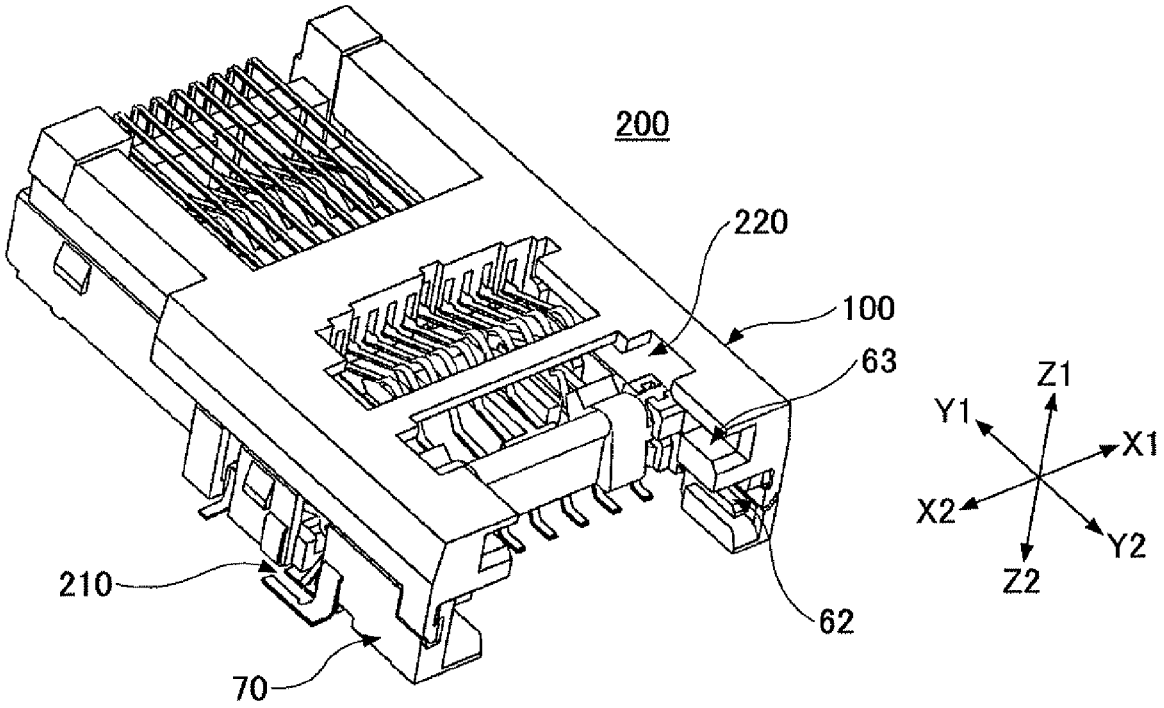
FIG. 4 is a perspective view of a card connector according to a first embodiment of the present invention.

FIG. 4 is a perspective view of a card connector 200 according to a first embodiment of the present invention. In FIG. 4, the same elements as or elements corresponding to those illustrated in FIG. 1 through FIG. 3 are referred to by the same reference numerals, and a description thereof is omitted.

Referring to FIG. 4, the card connector 200 includes the lower housing module 70 and the upper housing 100. The lower insertion slot 62 is provided in the lower housing module 70. The upper insertion slot 63 is provided in the upper housing 100. The card connector 200 further includes a switch mechanism 210 provided on the X2 side surface of the lower housing module 70. The card connector 200 includes the cover member 120, which is removed and not illustrated in FIG. 4.

A description is given of a configuration of the switch mechanism 210.

Figure 5:
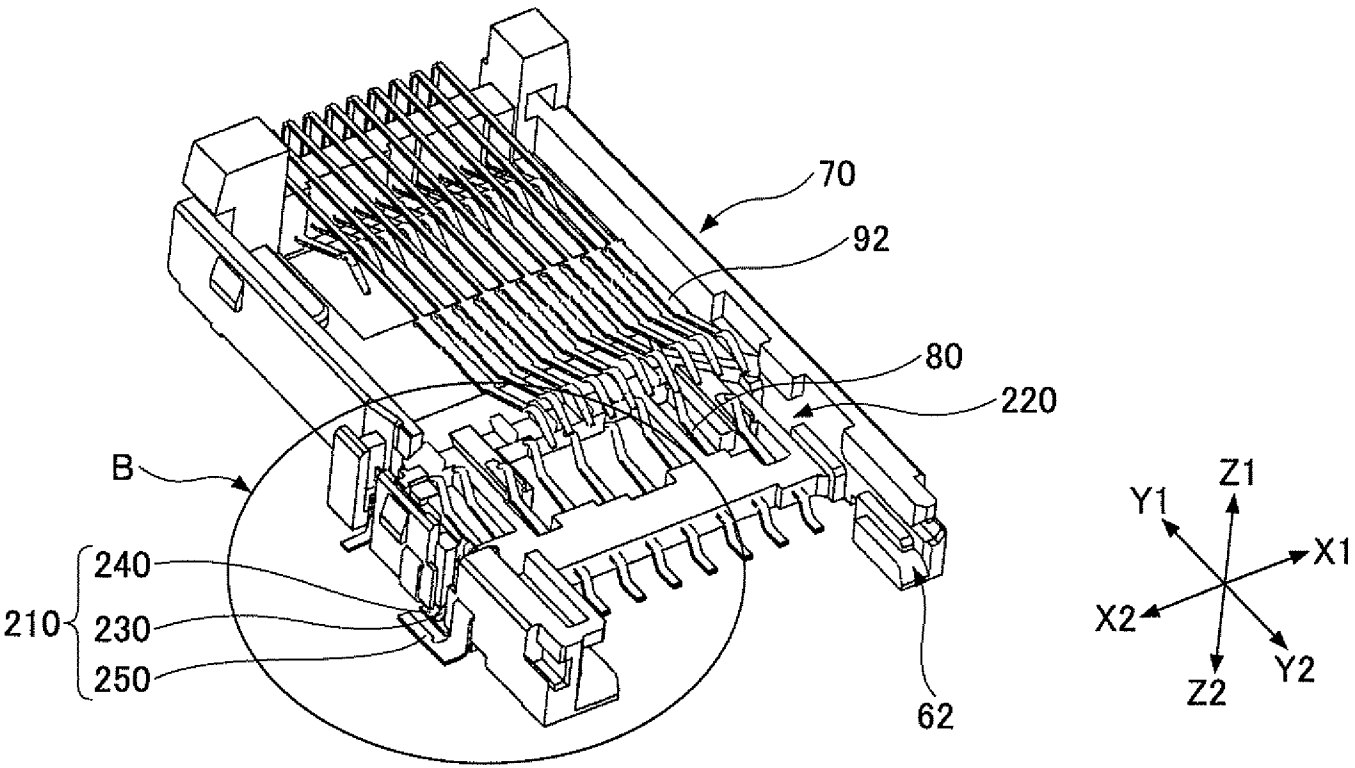
FIG. 5 is a perspective view of a lower housing module of the card connector according to the first embodiment of the present invention.
Figure 6A:
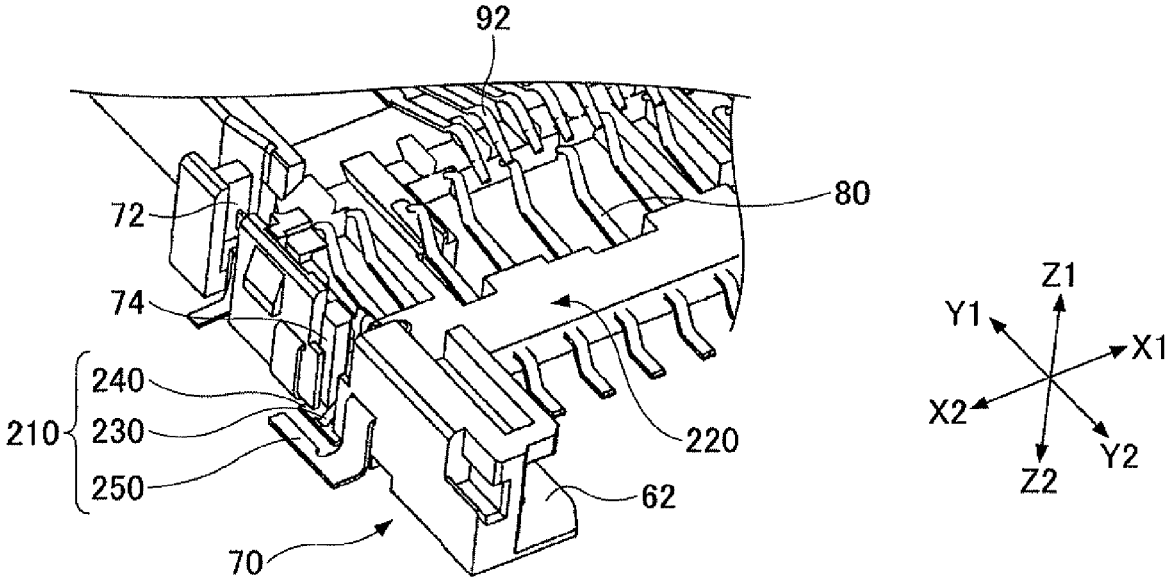
FIG. 6A is an enlarged view from the X2 side of the circled portion of the lower housing module indicated by arrow B in FIG. 5 according to the first embodiment of the present invention.
Figure 6B:
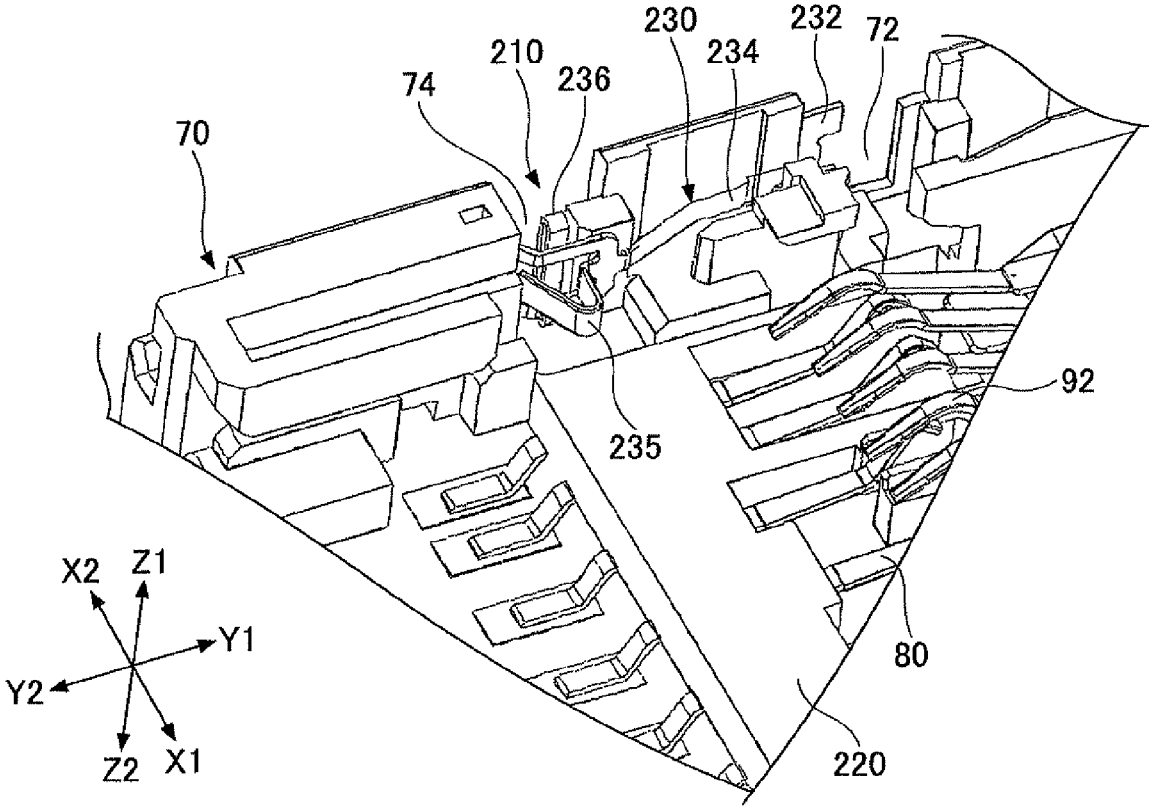
FIG. 6B is an enlarged view from the X1 side of the circled portion of the lower housing module indicated by arrow B in FIG. 5 according to the first embodiment of the present invention.

FIG. 5 is a perspective view of the lower housing module 70. FIG. 6A is an enlarged view from the X2 side of the circled portion of the lower housing module 70 indicated by arrow B in FIG. 5. FIG. 6B is an enlarged view from the X1 side of the circled portion of the lower housing module 70 indicated by arrow B in FIG. 5.

As illustrated in FIG. 5 and FIGS. 6A and 6B, the lower housing module 70 includes a card insertion part 220 communicating with the lower insertion slot 62. The switch mechanism 210 is provided on the X2 side of the card insertion part 220.

The switch mechanism 210 includes a movable terminal 230, a first fixed terminal 240, and a second fixed terminal 250. (See also FIGS. 8A and 8B and FIG. 9.) The movable terminal 230 is configured to deform elastically in response to insertion of a memory card into the card insertion part 220. The first fixed terminal 240 is for detecting the insertion of the memory card by the elastic deformation of the movable terminal 230. The second fixed terminal 250 is for detecting the enablement or inhibition of writing (to the memory card) by the elastic deformation of the movable terminal 230.

In this embodiment, by way of example, a description is given of the case of inserting the first memory card 20 (FIG. 1), in which the writing indication member (projection) 23 indicating the enablement or inhibition of writing is provided in a slidable manner, into the card insertion part 220.

Figure 7:
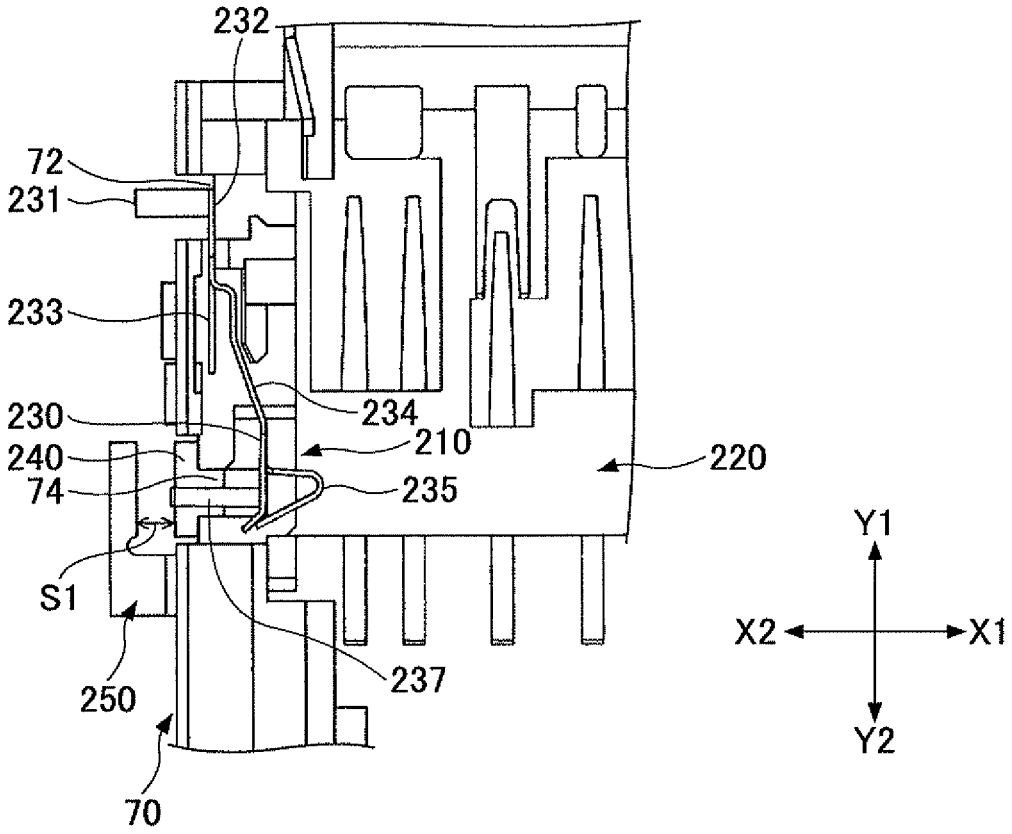
FIG. 7 is a plan view of a switch mechanism of the card connector according to the first embodiment of the present invention.
Figure 8A:
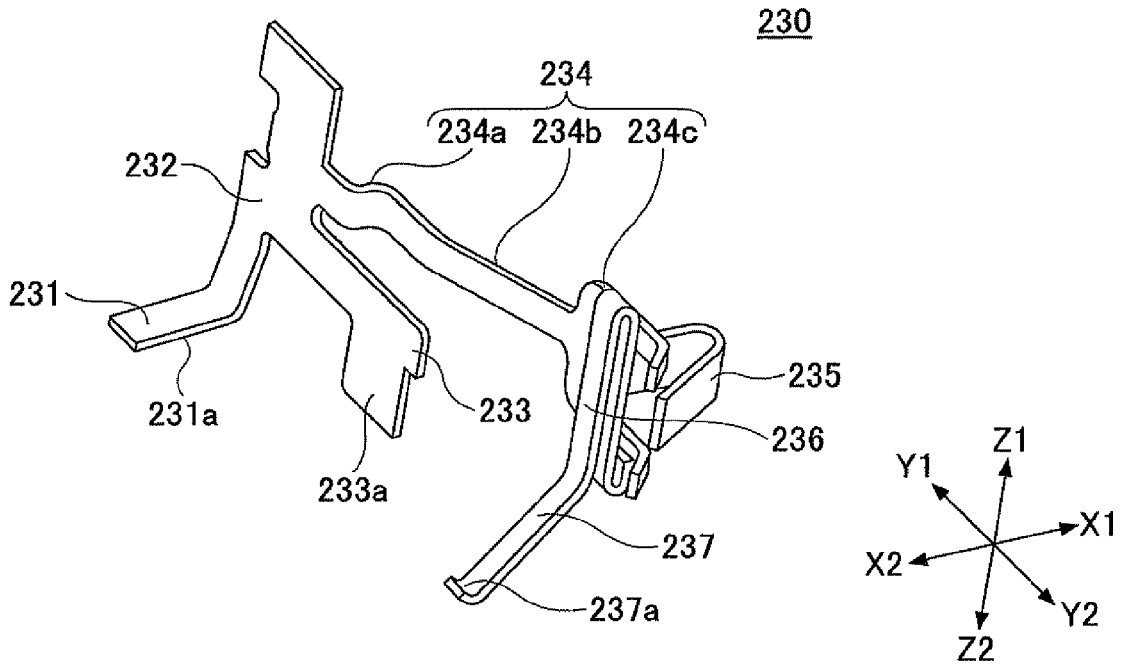
FIG. 8A is a perspective view of a movable terminal of the switch mechanism according to the first embodiment of the present invention.
Figure 8B:
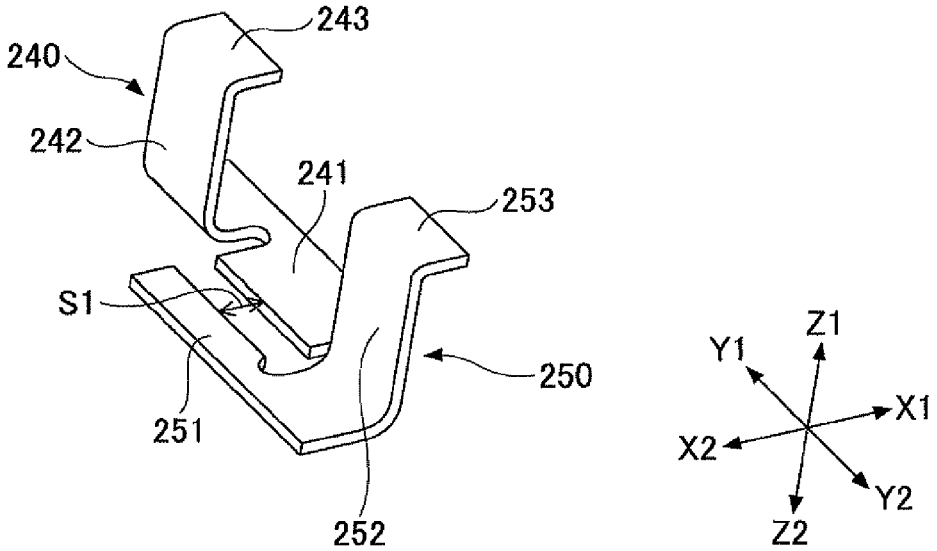
FIG. 8B is a perspective view of a first fixed terminal and a second fixed terminal of the switch mechanism according to the first embodiment of the present invention.

Referring to FIG. 7 and FIGS. 8A and 8B as well, the movable terminal 230 of the switch mechanism 210, which is formed by bending a blanked-out conductive metal plate, includes a lead terminal 231, a support part 232, a holding part 233, a flexible part 234, a card contact part 235, a bent part 236, and a wiping part 237.

The lead terminal 231 includes a horizontally-extending connection surface 231*a* to be soldered to a ground (GND) terminal of a printed board. The connection surface 231*a* extends so as to project in the X2 direction from a recess 72 (FIGS. 6A and 6B and FIG. 7) formed on the Y1 side on the X2-side surface of the lower housing module 70.

The support part 232 extends above the lead terminal 231 and comes into contact with the inner wall of the recess 72 formed on the X2-side surface of the lower housing module 50.

The holding part 233 extends horizontally from the vertically middle position of the support part 232, and includes an engagement part 233*a* at its end. The engagement part 233*a* is fit into and engages a slit in the recess 72.

The flexible part 234 is positioned above the holding part 233 and extends horizontally from the upper end of the support part 232. Further, the flexible part 234 includes a proximal end part 234*a*, an elastic deformation part 234*b*, and a distal end part 234*c*.

The proximal end part 234*a* is supported by the support part 232 and is bent inward (toward the card insertion part 220), and serves as a point of support for the elastic deformation part 234*b*.

The elastic deformation part 234*b* extends from the proximal end part 234*a* with an inclination toward the X1 direction. The elastic deformation part 234*b* is elastically deformable in the X1 direction and the X2 direction on the proximal end part 234 serving as a point of support.

The distal end part 234*c* is provided at the Y2 end of the elastic deformation part 234*b* and holds the card contact part 235.

The card contact part 235 is rounded and has a curved surface to project from the distal end part 234*c* in the X1 direction when viewed from above (from the Z1 direction) as illustrated in FIG. 7. As described below, the card contact part 235 comes into contact with the X2-side surface of the first memory card 20 during its insertion into the card insertion part 220.

The bent part 236 is provided on the X2 side of the distal end part 234*c*. The bent part 236 is bent into a vertically-elongated inverse U-letter shape (extending in the Z1 direction and the Z2 direction). Therefore, when a stress in the X1 or X2 direction is applied to the bent part 236, the inverse U-letter shaped portion of the bent part 236 elastically deforms in the direction in which the bent part 236 is pressed, so that the impact in the X1 or X2 direction is reduced. Further, the bent part 236 also elastically supports the wiping part 237.

The wiping part 237 extends downward from the bent part 236 with an inclination at a predetermined angle to the bent part 236. The wiping part 237 includes a contact part 237*a* at its lower end. The contact part 237*a* is bent upward so as to come into sliding contact with the first fixed terminal 240 and the second fixed terminal 250. The contact part 237*a* is formed so as to extend in the X2 direction from a recess 74 (FIGS. 6A and 6B and FIG. 7) formed on the Y2 side on the X2-side surface of the lower housing module 70. The first fixed terminal 240 and the second fixed terminal 250 are disposed on the X2 side of the recess 74.

The contact part 237*a* has a curved lower surface. The curved surface is pressed downward by a change in the inclination angle of the wiping part 237 to come into close contact with the first fixed terminal 240 and the second fixed terminal 250. With the insertion of the first memory card 20, the card contact part 235 comes into contact with the X2-side surface of the first memory card 20, so that the wiping part 237 as well as the bent part 236 is pushed outward in the X2 direction. Therefore, as described below, the contact part 237*a* of the wiping part 237 slides on (comes into sliding contact with) the upper surface of the first fixed terminal 240 and the upper surface of the second fixed terminal 250.

Referring to, for example, FIG. 8B, the first fixed terminal 240 has an angular C-letter shape when viewed in the Y1 direction. The first fixed terminal 240 includes a contact part 241, a vertical part 242, and an engagement part 243. The contact part 241 has upper and lower surfaces each formed in a horizontal plane. The lower surface of the contact part 241 is soldered to a circuit pattern on the printed board. The vertical part 242 extends vertically (in the Z1 direction) from the contact part 241. The engagement part 243 extends from the upper end of the vertical part 242 with an inclination to the X1 side, for example, in the X1 direction. The engagement part 243 is press-fit into a slit provided on the X2-side surface of the lower housing module 70.

The second fixed terminal 250 has a hand crank shape when viewed in the Y1 or Y2 direction (FIG. 8B). The second fixed terminal 250 includes a contact part 251, a vertical part 252 and an engagement part 253. The contact part 251 has upper and lower flat surfaces each formed in a horizontal plane. The lower surface of the contact part 251 is soldered to a circuit pattern on the printed board. The vertical part 252 extends vertically (in the Z1 direction) from the contact part 251. The engagement part 253 extends from the upper end of the vertical part 252 with an inclination to the X1 side, for example, in the X1 direction. The engagement part 253 is press-fit into a slit provided on the X2-side surface of the lower housing module 70.

Figure 9:
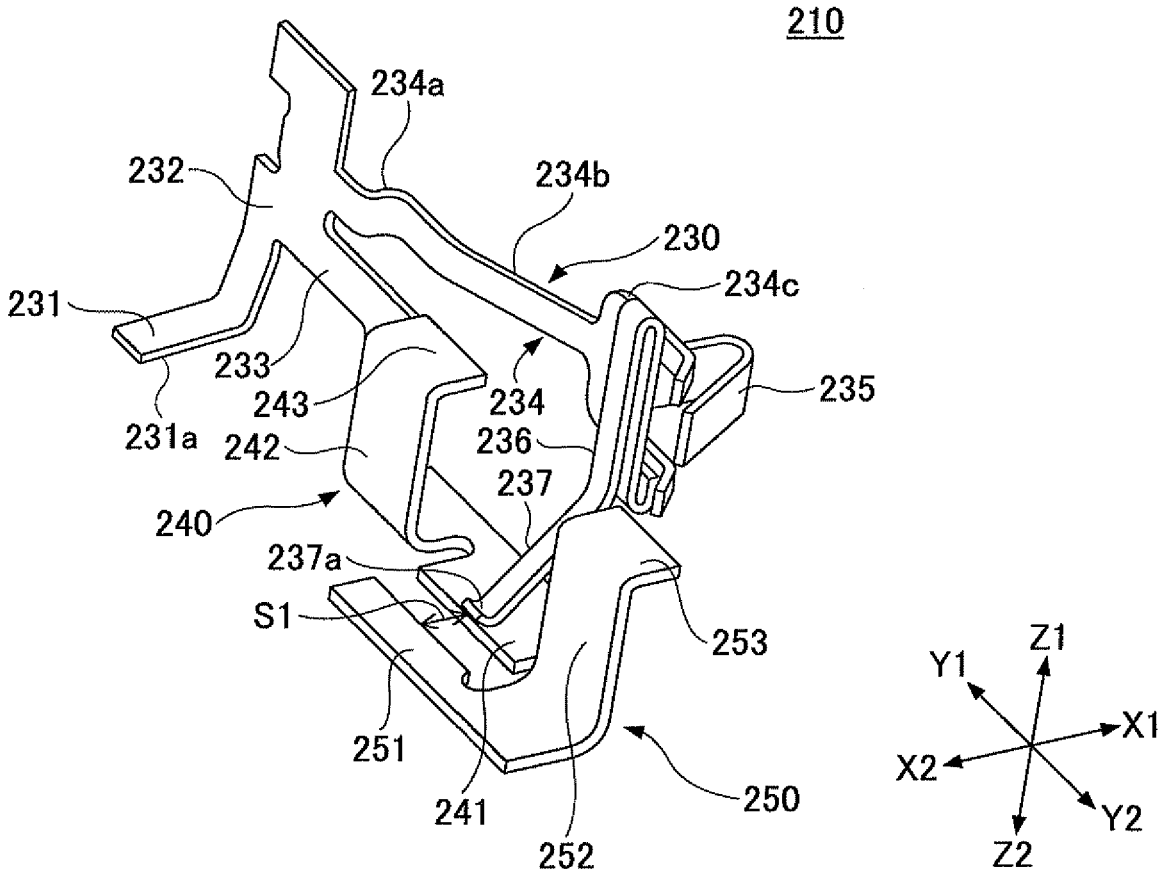
FIG. 9 is a perspective view of the switch mechanism in an attached state according to the first embodiment of the present invention.

FIG. 9 is a perspective view of the switch mechanism 210, illustrating its attached state. In FIG. 9, the lower housing module 70 is not illustrated.

Referring to FIG. 9, the first fixed terminal 240 and the second fixed terminal 250 are attached to the lower housing module 70 so that the contact part 241 of the first fixed terminal 240 and the contact part 251 of the second fixed terminal 250 lie side by side along the Y-axis across a gap S1 from each other in the X1 and the X2 direction. Further, the movable terminal 230 is attached to the lower housing module 70 so that the wiping part 237 crosses the contact parts 241 and 251 along the X-axis. With the lateral elastic deformation of the flexible part 234 (in the X1 or X2 direction), the contact part 237*a* at the end of the wiping part 237 is displaced (slides) to a position to come into contact with the contact part 241 or 251 or to the position of the gap S1. The gap S1 is a neutral region between the contact part 241 and the contact part 251. The width (size) of the gap S1, that is, the distance between the contact parts 241 and 251 along the X-axis, is greater than the width of the contact part 237*a* (that is, the size of the contact part 237*a* along the X-axis).

Next, a description is given of a detecting operation of the switch mechanism 210.

Figure 10A:
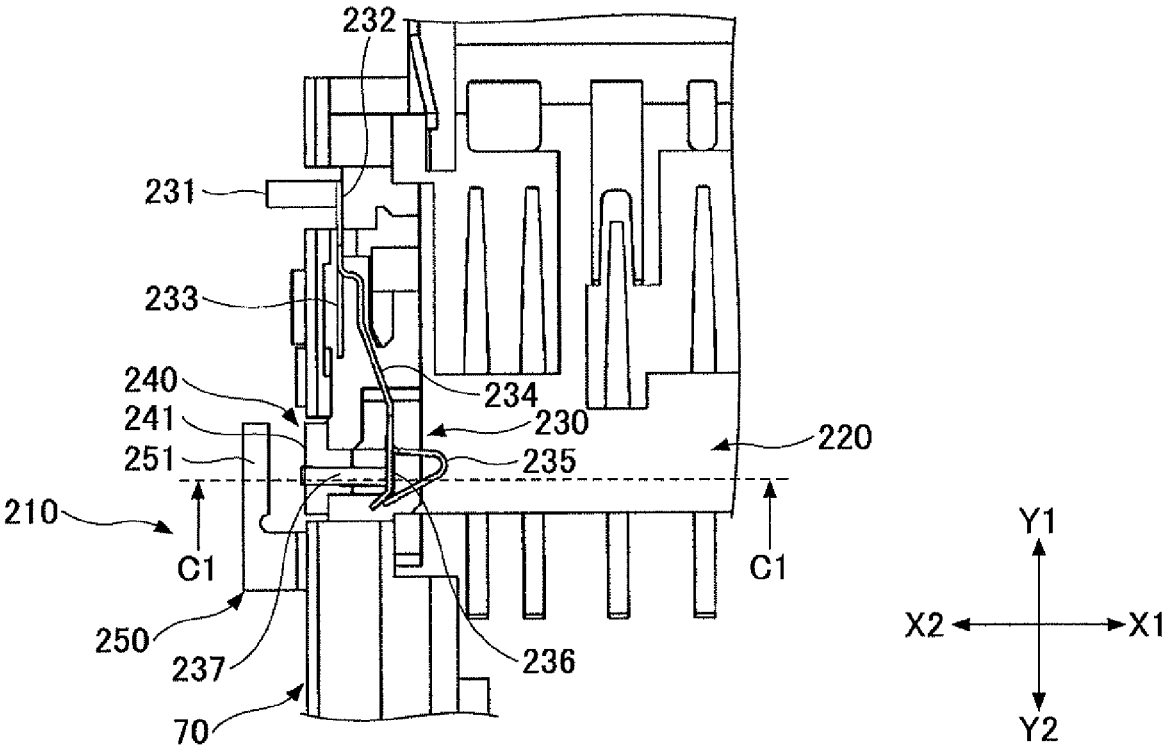
FIG. 10A is a plan view of the switch mechanism at a time when a first memory card is not inserted according to the first embodiment of the present invention.
Figure 10B:
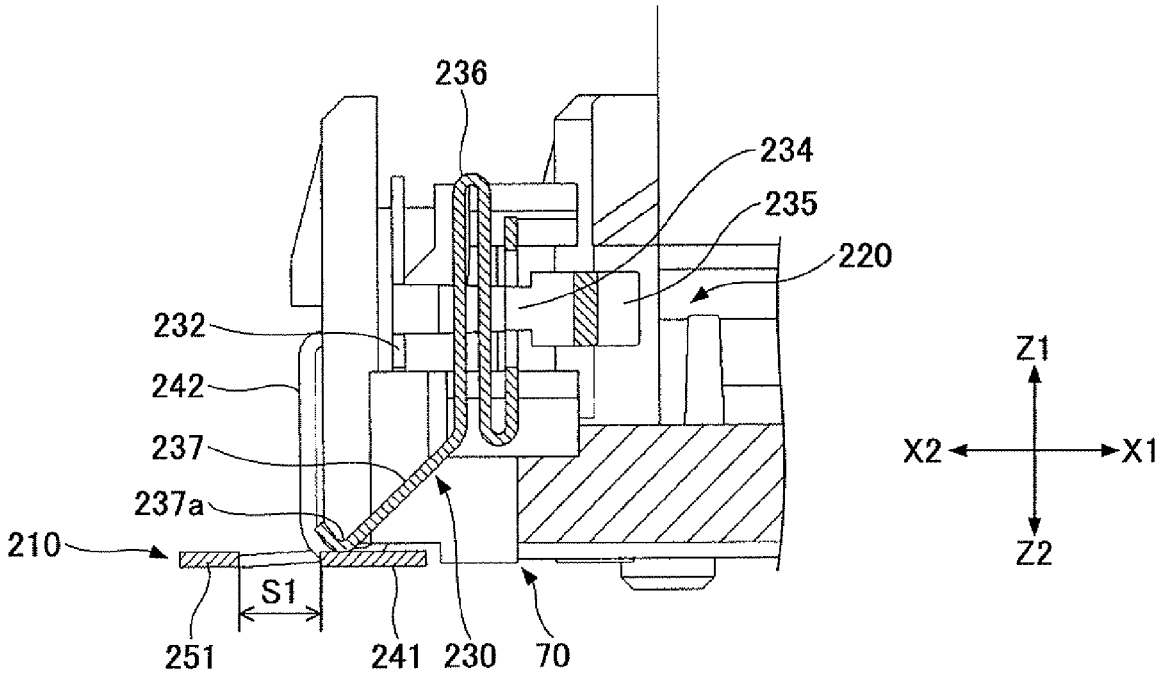
FIG. 10B is a cross-sectional view of the structure illustrated in FIG. 10A taken along broken line C1-C1 according to the first embodiment of the present invention.

FIG. 10A is a plan view of the switch mechanism 210 at a time when the first memory card 20 is not inserted. FIG. 10B is a cross-sectional view of the structure illustrated in FIG. 10A taken along broken line C1-C1.

Referring to FIGS. 10A and 10B, when the first memory card 20 is not inserted through the lower insertion slot 62 of the lower housing module 70, the flexible part 234 of the movable terminal 230 is at its original (reference) position with the card contact part 235 of the movable terminal 230 projecting into the card insertion part 220.

The wiping part 237 of the movable terminal 230 is stationary with the contact part 237*a* in contact with the upper surface of the contact part 241, pressing the contact part 241 downward.

Figure 10C:
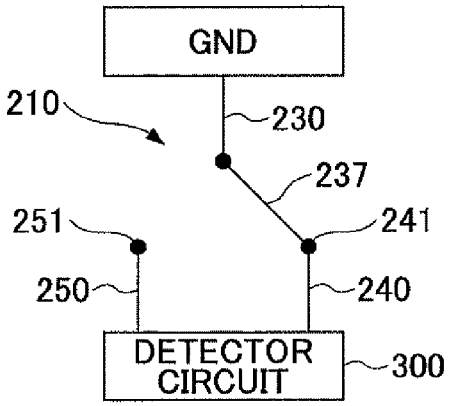
FIG. 10C is a schematic diagram illustrating the state of the switch mechanism when the first memory card is not inserted according to the first embodiment of the present invention.

FIG. 10C is a schematic diagram illustrating the state of the switch mechanism 210 when the first memory card 20 is not inserted.

Referring to FIG. 10C, the wiping part 237 of the movable terminal 230 is in contact with the contact part 241 of the first fixed terminal 240. As a result, the first fixed terminal 240 is ON while the second fixed terminal 250 is OFF. The movable terminal 230 is connected to ground (GND), and the first fixed terminal 240 and the second fixed terminal 250 are connected to a detector circuit 300 provided on the printed board. Accordingly, the detector circuit 300 receives the detection signal output by the switch mechanism 210, and determines that the first memory card 20 is not inserted based on the combination of the output states of detection signals (ON, OFF) from the first fixed terminal 240 and the detection signal from the second fixed terminal 250.

Figure 11A:
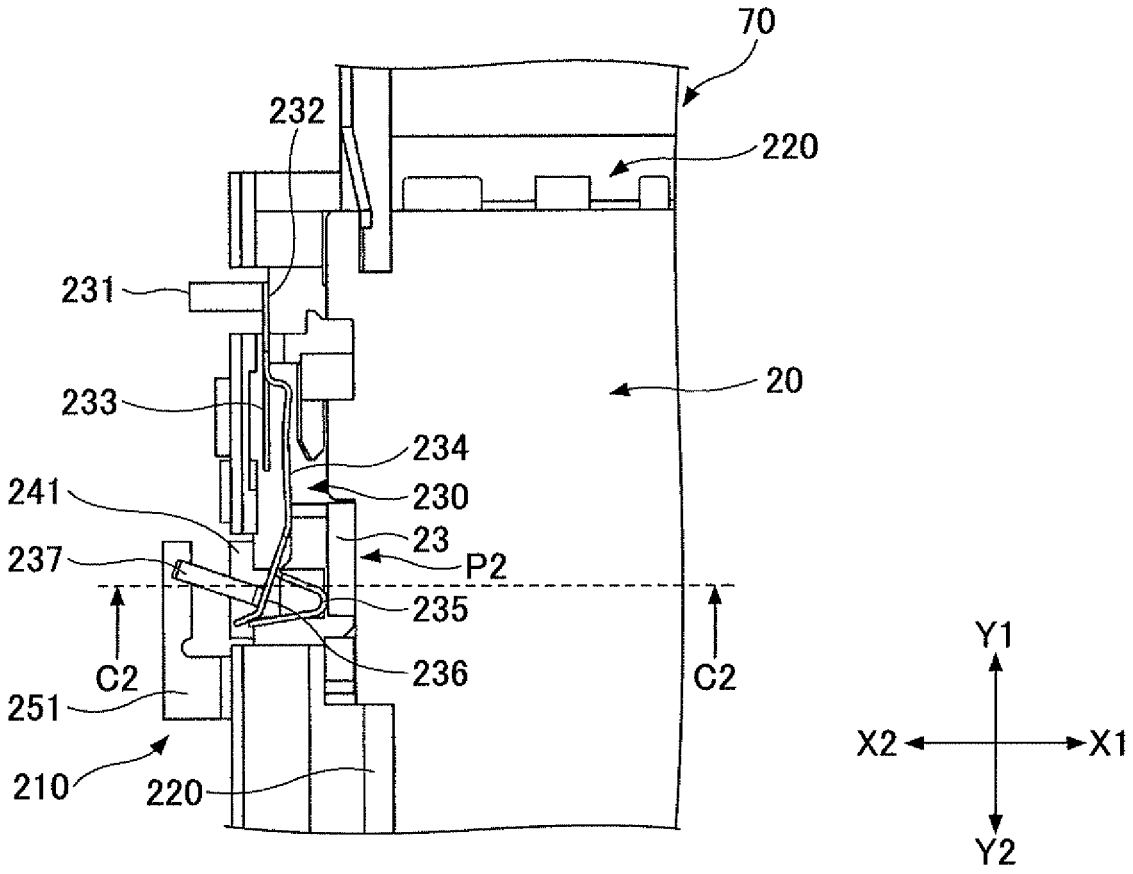
FIG. 11A is a plan view of the switch mechanism at a time when the first memory card in a write enable state is inserted into a card insertion part according to the first embodiment of the present invention.
Figure 11B:
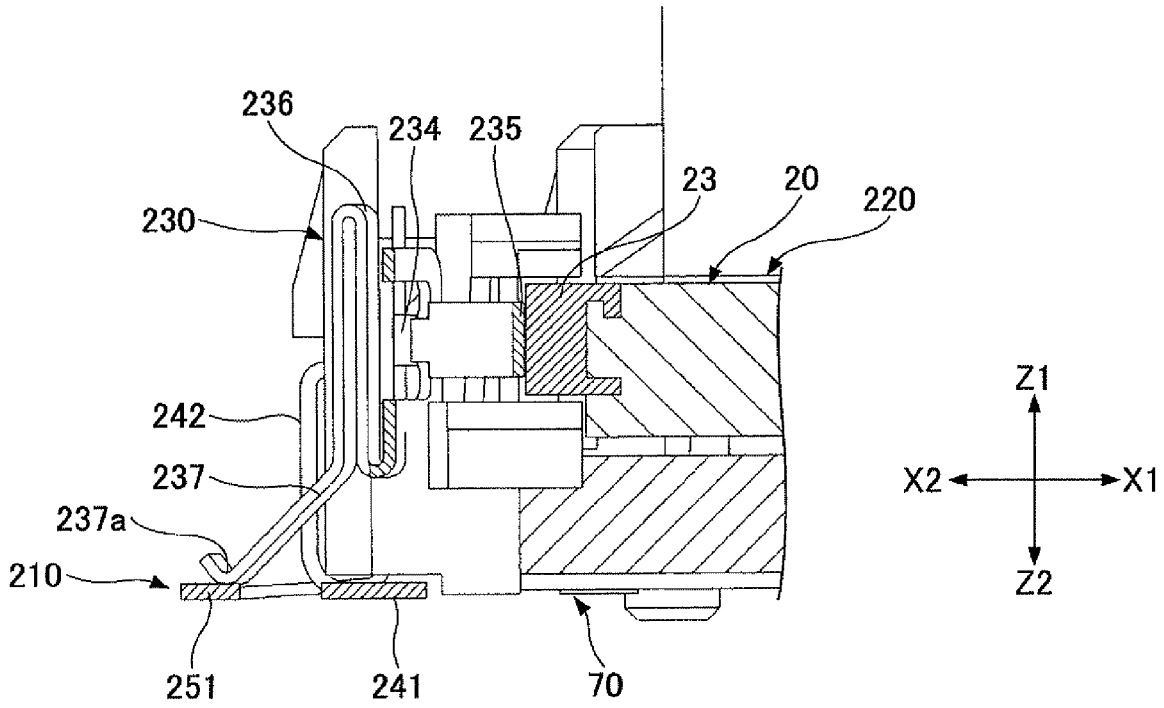
FIG. 11B is a cross-sectional view of the structure illustrated in FIG. 11A taken along broken line C2-C2 according to the first embodiment of the present invention.

FIG. 11A is a plan view of the switch mechanism 210 at a time when the first memory card 20 in a write enable state is inserted into the card insertion part 220. FIG. 11B is a cross-sectional view of the structure illustrated in FIG. 11A taken along broken line C2-C2.

Referring to FIGS. 11A and 11B, when the first memory card 20 is inserted through the lower insertion slot 62 of the lower housing module 70, the card contact part 235 of the movable terminal 230 comes into contact with the X2-side surface of the first memory card 20 to be pushed outward in the X2 direction.

Further, when the writing indication member 23 of the first memory card 20, inserted into the card insertion part 220 of the lower housing module 70 and attached, is at the write enable position P2, the card contact part 235 of the movable terminal 230 comes into contact with the writing indication member 23.

As a result, the flexible part 234 of the movable terminal 230 elastically deforms toward the X2 direction, and the contact part 237*a* at the end of the wiping part 237 of the movable terminal 230 is detached from the contact part 241 to be displaced in the X2 direction across the gap S1 to a position where the contact part 237*a* comes into contact with the upper surface of the contact part 251 of the second fixed terminal 250. Then, the contact part 237*a* of the wiping part 237 comes into sliding contact with (slides on) the upper surface of the contact part 251 of the second fixed terminal 250.

Further, the wiping part 237 is pushed outward in the X2 direction by the bent part 236 while being subject to resistance from the sliding contact of the contact part 237*a* with the upper surface of the contact part 251 and bent slightly. As a result, the contact part 237*a* of the wiping part 237 slides to perform a wiping operation while pressing the contact part 251 downward with the spring force of the movable terminal 230.

Figure 11C:
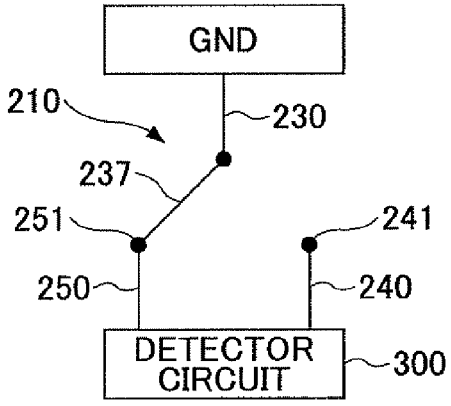
FIG. 11C is a schematic diagram illustrating the operating state of the switch mechanism when the first memory card in the write enable state is inserted according to the first embodiment of the present invention.

FIG. 11C is a schematic diagram illustrating the operating state of the switch mechanism 210 when the first memory card 20 in the write enable state is inserted.

Referring to FIG. 11C, the wiping part 237 of the movable terminal 230 is in contact with the contact part 251 of the second fixed terminal 250. As a result, the second fixed terminal 250 is ON, while the first fixed terminal 240 is OFF. Accordingly, the detector circuit 300 receives the detection signal output by the switch mechanism 210, and determines that the first memory card 20 is attached and the writing indication member 23 of the first memory card 20 is at the write enable position P2 based on the combination of the output states of detection signals (OFF, ON) from the first fixed terminal 240 and the detection signal from the second fixed terminal 250.

Figure 12A:
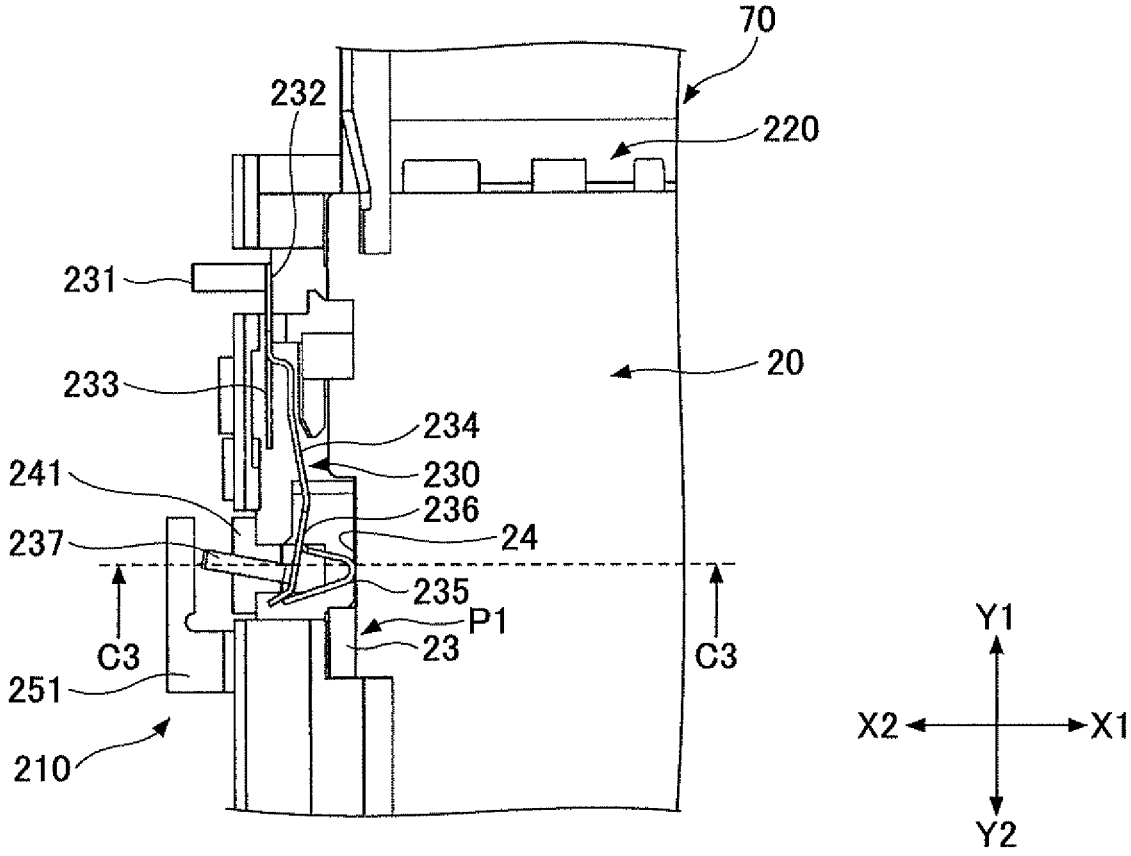
FIG. 12A is a plan view of the switch mechanism at a time when the first memory card in a write inhibit state is inserted into the card insertion part according to the first embodiment of the present invention.
Figure 12B:
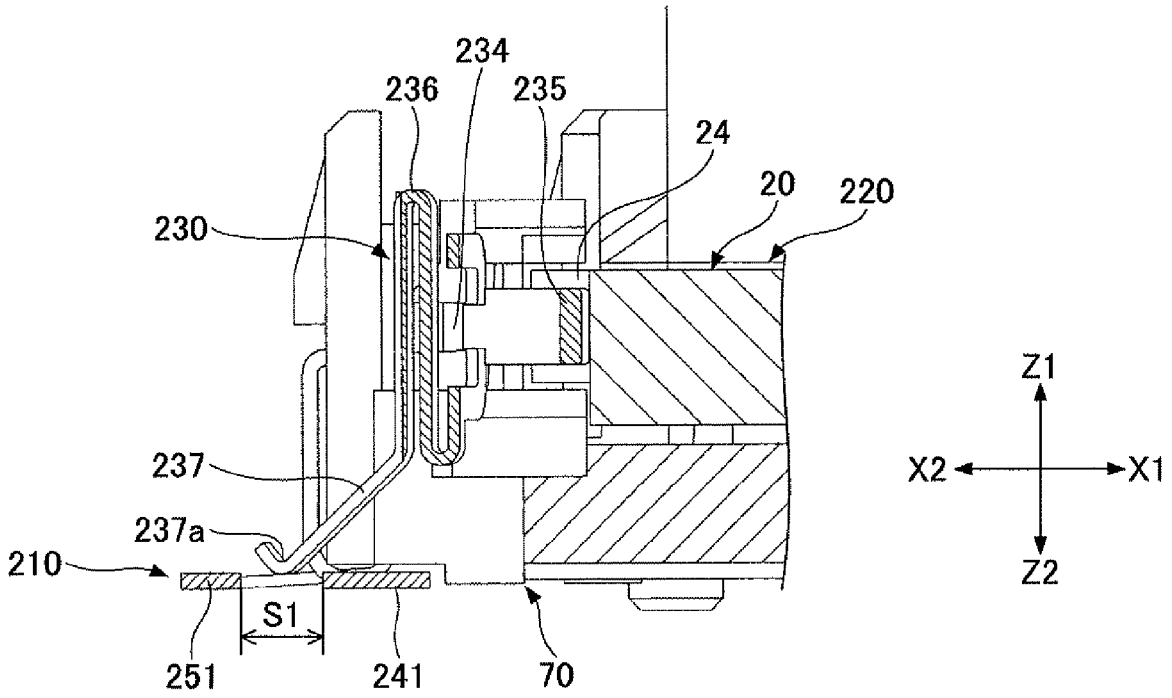
FIG. 12B is a cross-sectional view of the structure illustrated in FIG. 12A taken along broken line C3-C3 according to the first embodiment of the present invention.

FIG. 12A is a plan view of the switch mechanism 210 at a time when the first memory card 20 in a write inhibit state is inserted into the card insertion part 220. FIG. 12B is a cross-sectional view of the structure illustrated in FIG. 12A taken along broken line C3-C3.

Referring to FIGS. 12A and 12B, when the first memory card 20 is inserted through the lower insertion slot 62 of the lower housing module 70, the card contact part 235 of the movable terminal 230 comes into contact with the X2-side surface of the first memory card 20 to be pushed outward in the X2 direction.

Further, when the writing indication member 23 of the first memory card 20 inserted into the card insertion part 220 of the lower housing module 70 is at the write inhibit position P1, a recess 24 formed on the X2-side surface of the first memory card 20 comes into contact with the card contact part 235 of the movable terminal 230.

As a result, the wiping part 237 of the movable terminal 230 returns in the X1 direction when the card contact part 235 comes into contact with the recess 24 formed on the X2-side surface of the first memory card 20, after being displaced in the X2 direction with the insertion of the first memory card 20. The amount of returning in the X1 direction is determined to be approximately half of the distance between the contact part 241 and the contact part 251.

Therefore, the contact part 237*a* of the wiping part 237 is displaced to the neutral region formed between the contact part 241 and the contact part 251 after once coming into sliding contact with the upper surface of the contact part 251 of the second fixed terminal 250. That is, the contact part 237*a* of the wiping part 237 stops in the neutral region (the gap S1), where the contact part 237*a* contacts neither the contact surface 241 nor the contact surface 251.

Figure 12C:
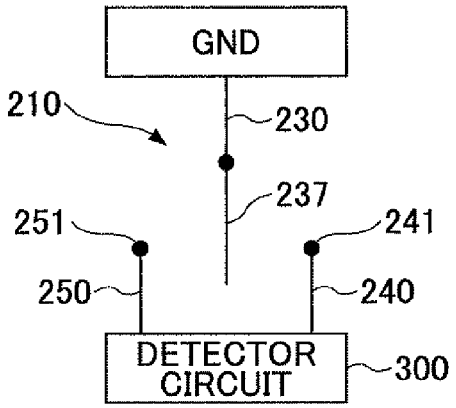
FIG. 12C is a schematic diagram illustrating the operating state of the switch mechanism when the first memory card in the write inhibit state is inserted according to the first embodiment of the present invention.

FIG. 12C is a schematic diagram illustrating the operating state of the switch mechanism 210 when the first memory card 20 in the write inhibit state is inserted.

Referring to FIG. 12C, the wiping part 237 of the movable terminal 230 is at the neutral position (in the neutral region) in contact with neither the contact part 241 or 251. As a result, both the first fixed terminal 240 and the second fixed terminal 250 are OFF. Accordingly, the detector circuit 300 receives no detection signals from the switch mechanism 210, and determines that the first memory card 20 is attached and the writing indication member 23 of the first memory card 20 is at the write inhibit position P1 based on the combination of the output states of detection signals (OFF, OFF) from the first fixed terminal 240 and the second fixed terminal 250.

Thus, according to the card connector 200, the amount of displacement of the movable terminal 230 changes based on the state of the first memory card 20 inserted, so that the movable terminal 230 comes into contact with (ON) the first fixed terminal 240 or the second fixed terminal 250 or loses contact with (is separated from) (OFF) one or both of the first fixed terminal 240 and the second fixed terminal 250. This reduces the number of movable terminals so as to facilitate assembly of a connector, thus making it possible to improve production efficiency.

[b] Second Embodiment

Figure 13:
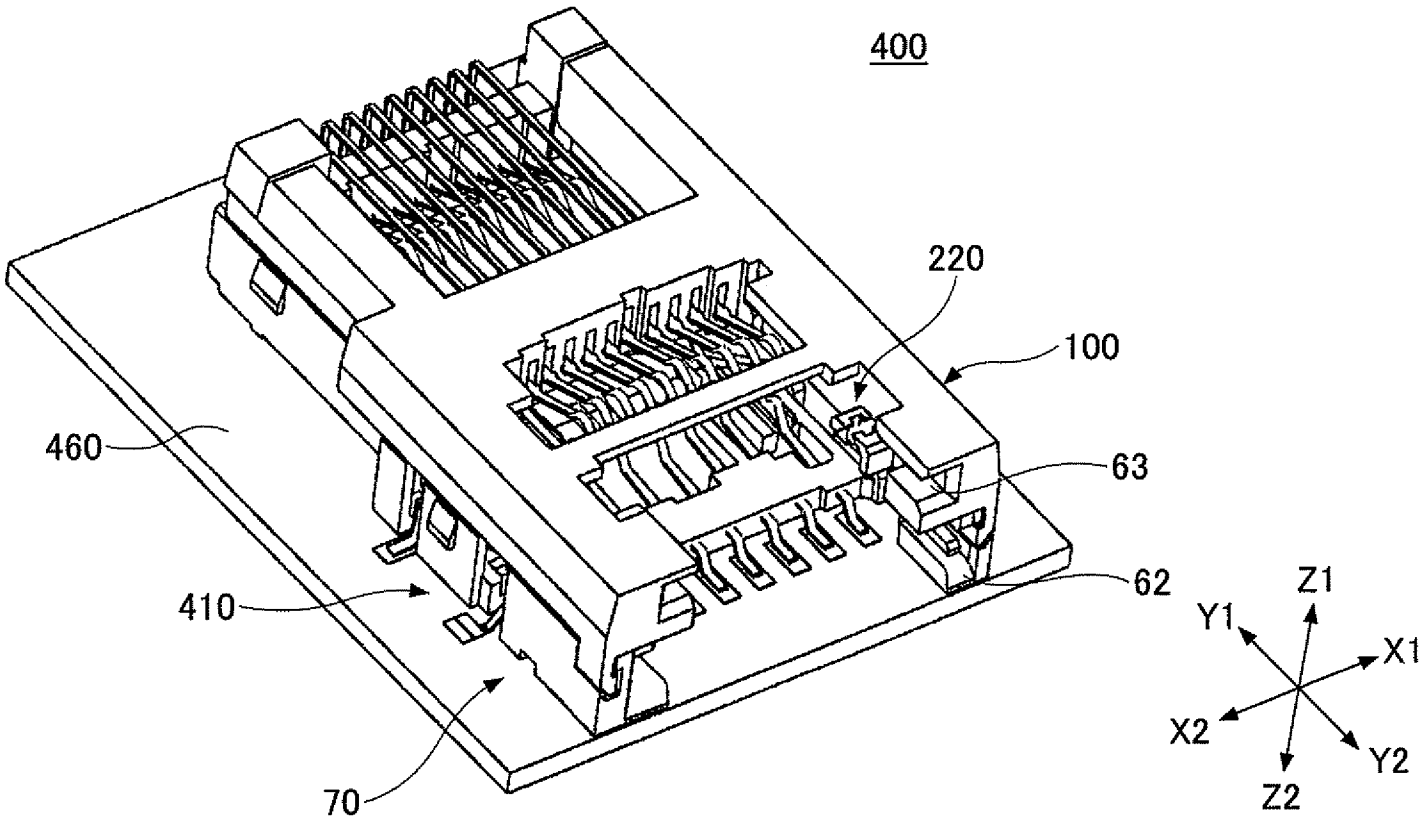
FIG. 13 is a perspective view of a card connector according to a second embodiment of the present invention.

FIG. 13 is a perspective view of a card connector 400 according to a second embodiment of the present invention. In FIG. 13, the same elements as those illustrated in FIG. 4 are referred to by the same reference numerals, and a description thereof is omitted.

Referring to FIG. 13, the card connector 400 includes the lower housing module 70 and the upper housing 100. The card connector 400 has a switch mechanism 410 provided on its X2-side surface.

A description is given of a configuration of the switch mechanism 410.

Figure 14:
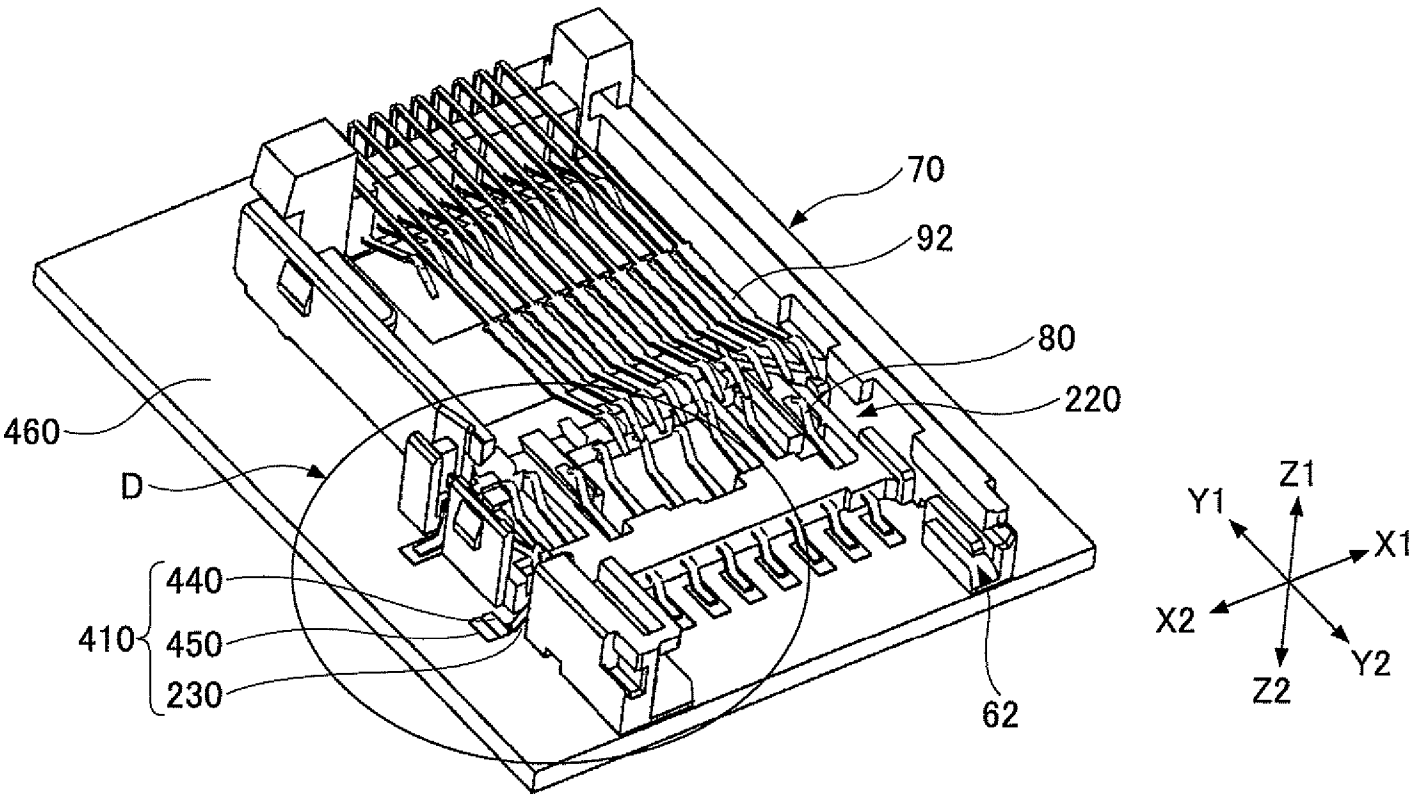
FIG. 14 is a perspective view of the lower housing module according to the second embodiment of the present invention.
Figure 15:
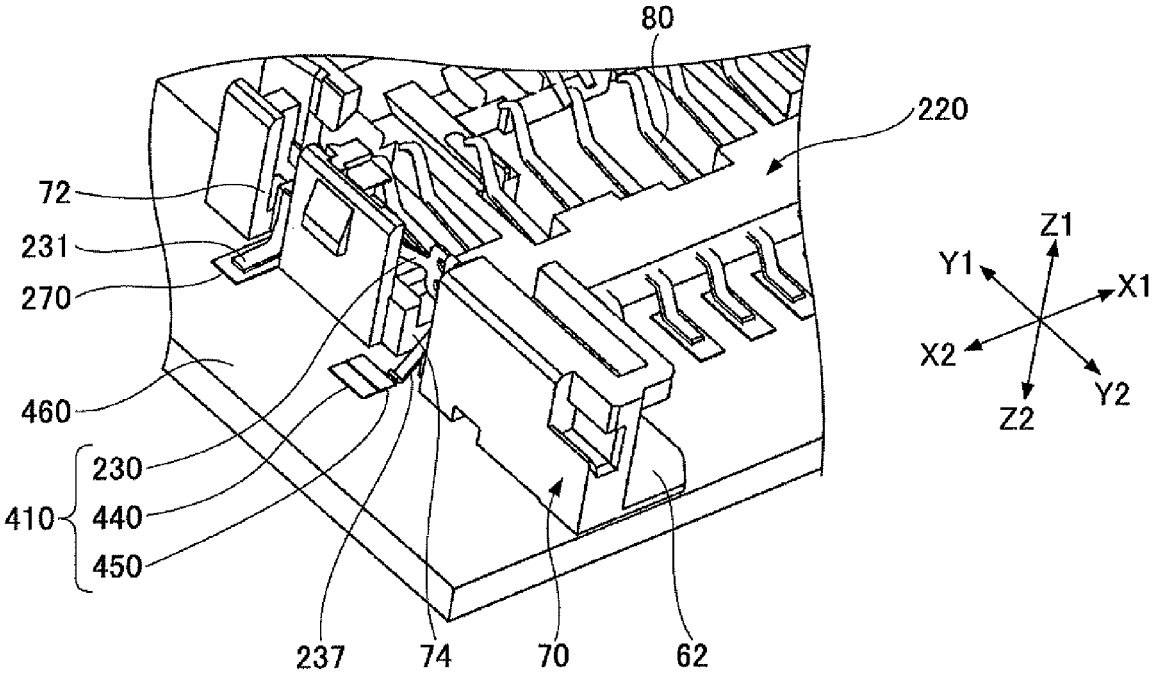
FIG. 15 is an enlarged view from the X2 side of the circled portion of the lower housing module indicated by arrow D in FIG. 14 according to the second embodiment of the present invention.

FIG. 14 is a perspective view of the lower housing module 70. FIG. 15 is an enlarged view from the X2 side of the circled portion of the lower housing module 70 indicated by arrow D in FIG. 14.

Referring to FIG. 14 and FIG. 15, the switch mechanism 410 is provided on the X2 side of the card insertion part 220 communicating with the lower insertion slot 62. The lower housing module 70 is mounted on the upper surface of a printed board 460. The lower housing module 70 is fixed to the printed board 460 with fasteners such as screw members.

The switch mechanism 410 includes the movable terminal 230, a first fixed terminal 440, and a second fixed terminal 450. The movable terminal 230 has the same configuration as in the first embodiment, and a description thereof is omitted.

The first fixed terminal 440 and the second fixed terminal 450 are thin films formed by printing or plating so as to be exposed directly on the upper surface of the printed board 460. Further, the first fixed terminal 440 and the second fixed terminal 450 are connected to the detector circuit 300 (not graphically illustrated in FIG. 14 and FIG. 15) through circuit patterns formed on the printed board 460.

Accordingly, in this embodiment, the first fixed terminal 440 and the second fixed terminal 450 are formed in the process of manufacturing the printed board 460, thus making it possible to reduce the number of components of the card connector 400. Therefore, compared with the configuration of the above-described first embodiment, it is possible to reduce costs by saving time and effort for processing the first fixed terminal 440 and the second fixed terminal 450 individually and attaching the first fixed terminal 440 and the second fixed terminal 450 to the lower housing module 70.

Like the first fixed terminal 240 of the first embodiment, the first fixed terminal 440 is for detecting the insertion of a memory card by the elastic deformation of the movable terminal 230. Like the second fixed terminal 250 of the first embodiment, the second fixed terminal 450 is for detecting the enablement or inhibition of writing (to the memory card) by the elastic deformation of the movable terminal 230.

Figure 16:
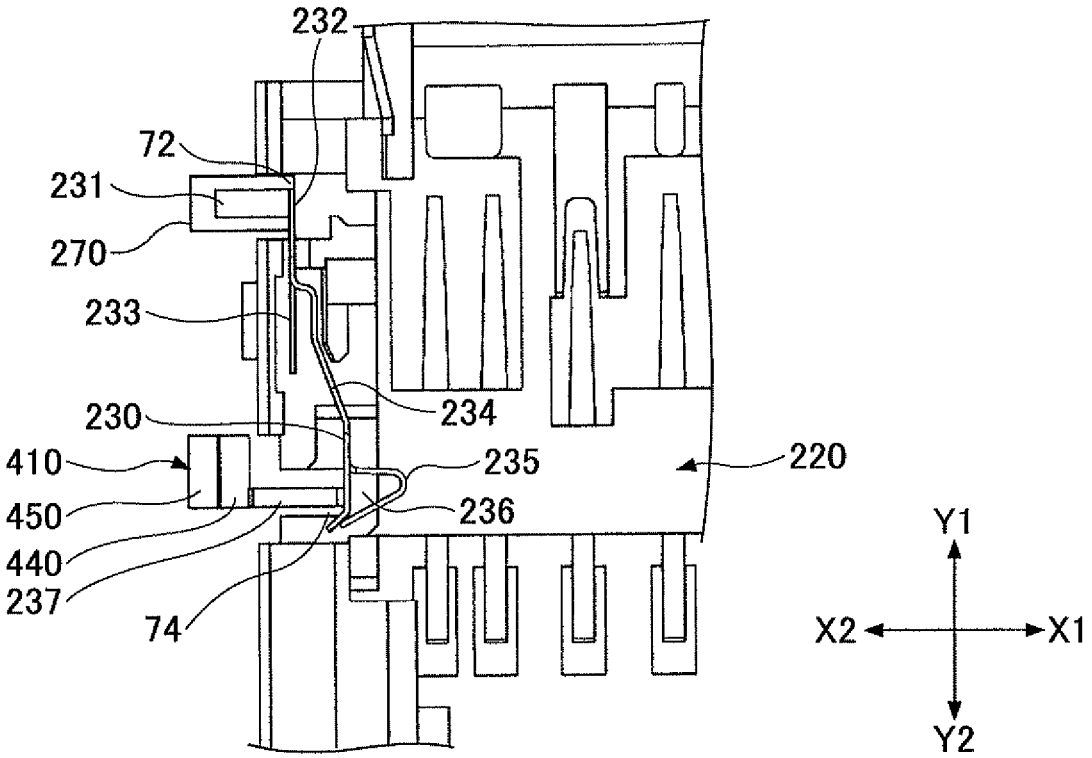
FIG. 16 is a plan view of a switch mechanism of the card connector according to the second embodiment of the present invention.

FIG. 16 is a plan view of the switch mechanism 410. Referring to FIG. 16, each of the first fixed terminal 440 and the second fixed terminal 450 of the switch mechanism 410 has a rectangular shape elongated along the Y-axis. Further, the first fixed terminal 440 and the second fixed terminal 450 are provided side by side across a minute gap from each other in the X1 and the X2 direction.

Further, the movable terminal 230 is attached to the lower housing module 70 so that the wiping part 237 crosses the first fixed terminal 440 and the second fixed terminal 450 along the X-axis. With the lateral elastic deformation of the flexible part 234 (in the X1 or X2 direction), the contact part 237*a* at the end of the wiping part 237 is displaced to a detection region where the contact part 237*a* comes into contact with the first fixed terminal 440 or the second fixed terminal 450 or to a neutral region outside the first fixed terminal 440 and the second fixed terminal 450.

The lead terminal 231 of the movable terminal 230 is soldered to a ground (GND) electrode 470 formed on the printed board 460.

Next, a description is given of a detecting operation of the switch mechanism 410.

Figure 17A:
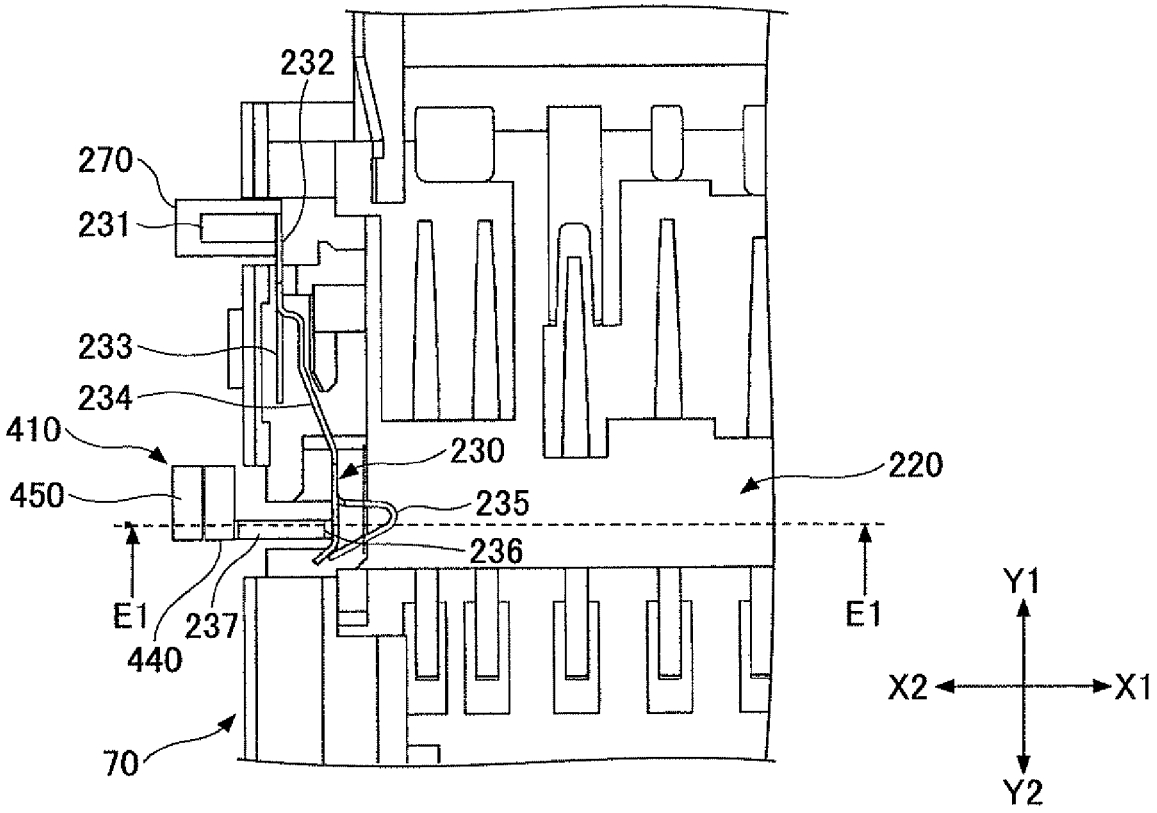
FIG. 17A is a plan view of the switch mechanism at a time when the first memory card is not inserted according to the second embodiment of the present invention.
Figure 17B:
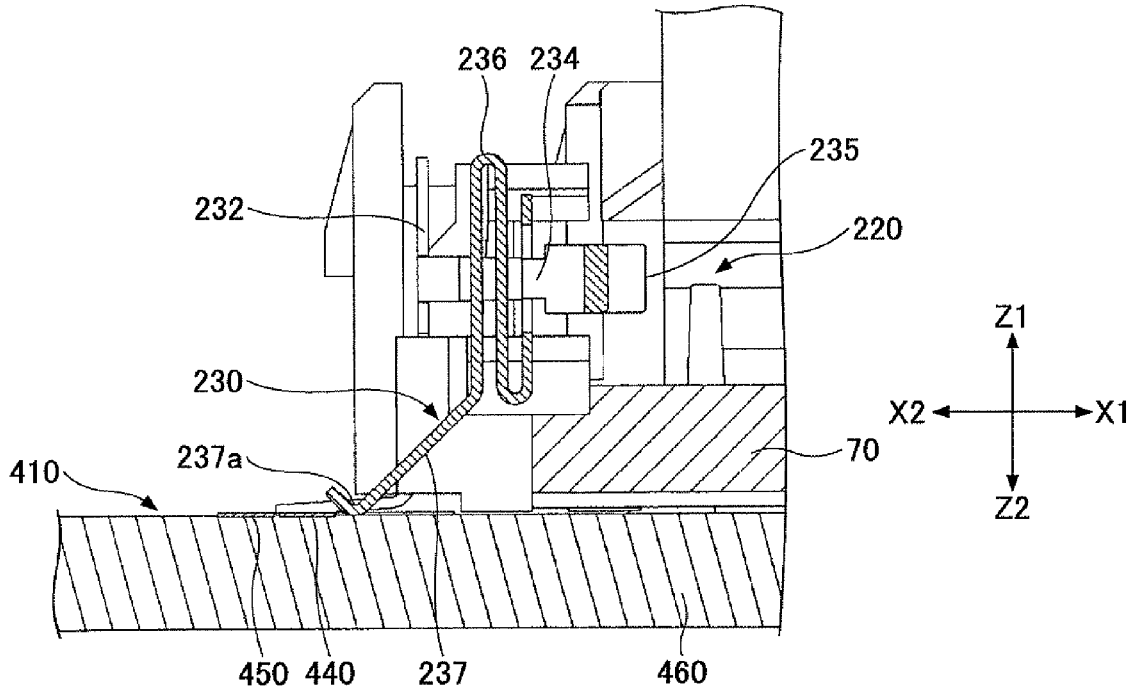
FIG. 17B is a cross-sectional view of the structure illustrated in FIG. 17A taken along broken line E1-E1 according to the second embodiment of the present invention.

FIG. 17A is a plan view of the switch mechanism 410 at a time when the first memory card 20 is not inserted. FIG. 17B is a cross-sectional view of the structure illustrated in FIG. 17A taken along broken line E1-E1.

Referring to FIGS. 17A and 17B, when the first memory card 20 is not inserted through the lower insertion slot 62 of the lower housing module 70, the flexible part 234 of the movable terminal 230 is at its original (reference) position with the card contact part 235 of the movable terminal 230 projecting into the card insertion part 220.

The wiping part 237 of the movable terminal 230 is stationary in a neutral state without contacting the first fixed terminal 440 and the second fixed terminal 450 with the contact part 237*a* in contact with the upper surface (insulating layer) of the printed board 460 in a neutral region on the X1 side of the first fixed terminal 440.

Figure 17C:
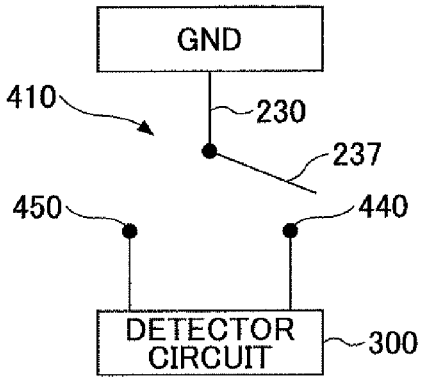
FIG. 17C is a schematic diagram illustrating the state of the switch mechanism when the first memory card is not inserted according to the second embodiment of the present invention.

FIG. 17C is a schematic diagram illustrating the state of the switch mechanism 410 when the first memory card 20 is not inserted.

Referring to FIG. 17C, the wiping part 237 of the movable terminal 230 is separated from (out of contact with) the first fixed terminal 440 and the second fixed terminal 450. As a result, the first fixed terminal 440 and the second fixed terminal are OFF. Accordingly, the detector circuit 300 receives no detection signals from the switch mechanism 410, and determines that the first memory card 20 is not inserted based on the combination of the output states of detection signals (OFF, OFF) from the first fixed terminal 440 and the second fixed terminal 450.

Figure 18A:
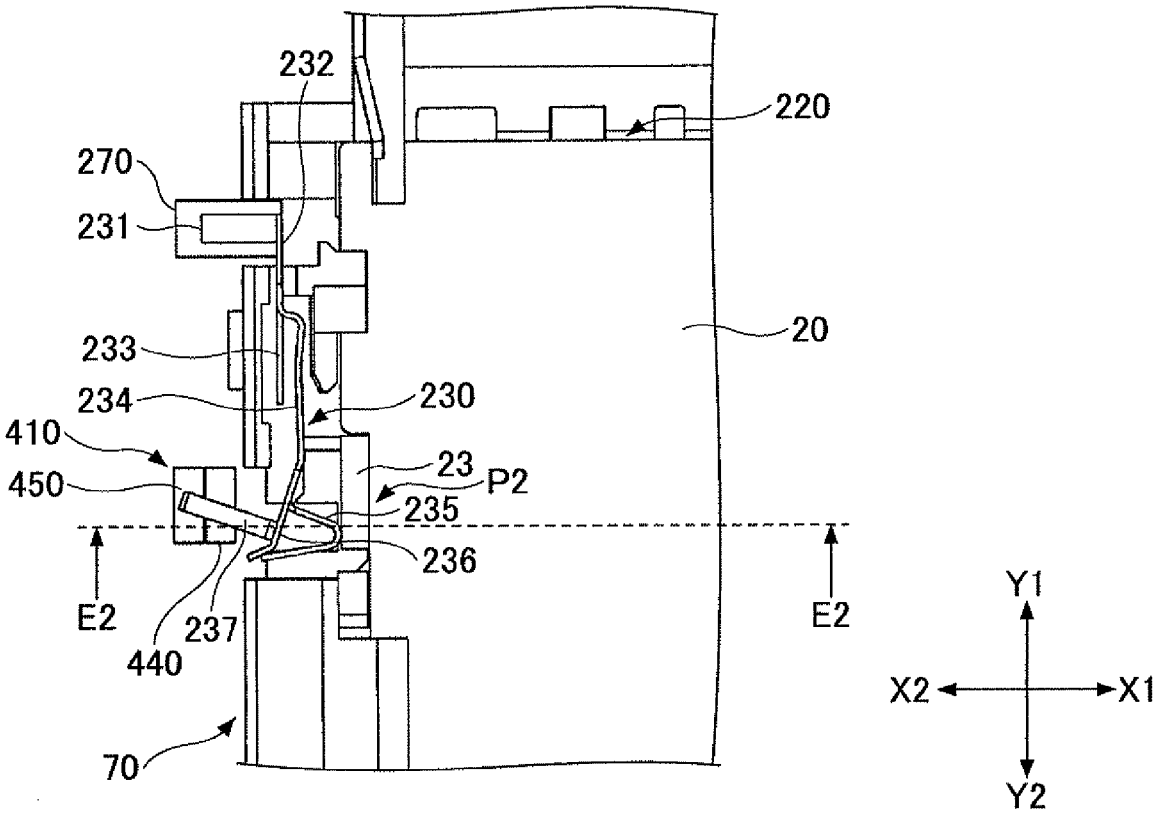
FIG. 18A is a plan view of the switch mechanism at a time when the first memory card in the write enable state is inserted into the card insertion part according to the second embodiment of the present invention.
Figure 18B:
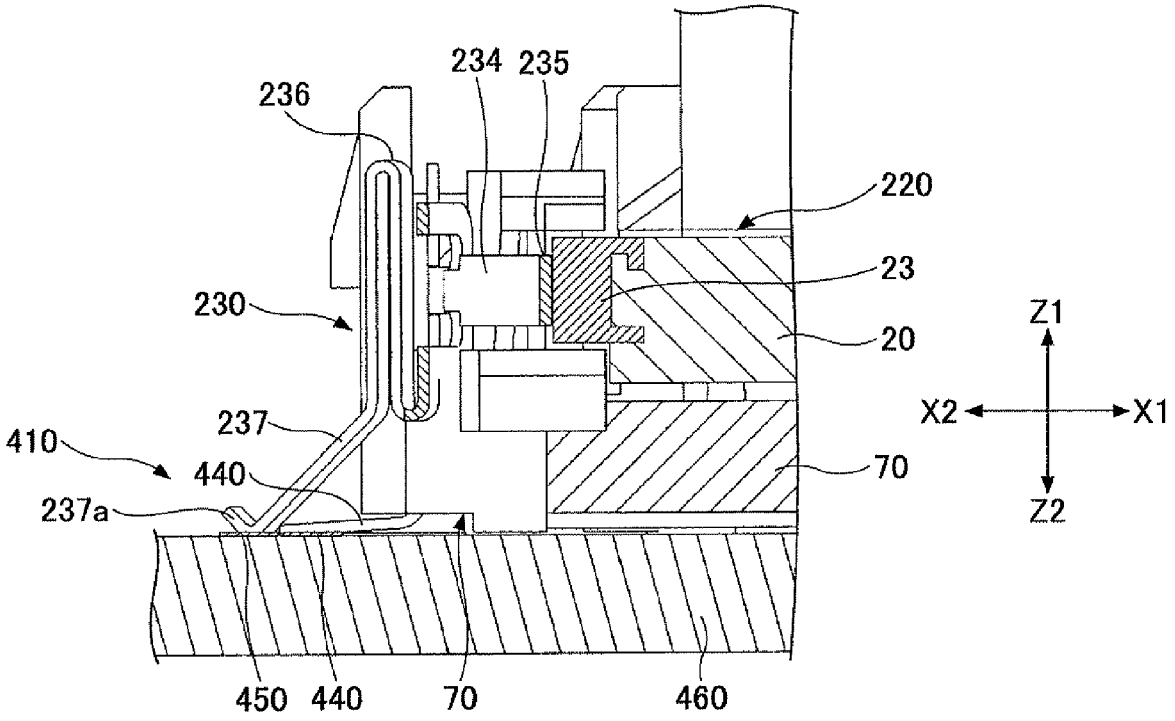
FIG. 18B is a cross-sectional view of the structure illustrated in FIG. 18A taken along broken line E2-E2 according to the second embodiment of the present invention.

FIG. 18A is a plan view of the switch mechanism 410 at a time when the first memory card 20 in the write enable state is inserted into the card insertion part 220. FIG. 18B is a cross-sectional view of the structure illustrated in FIG. 18A taken along broken line E2-E2.

Referring to FIGS. 18A and 18B, when the first memory card 20 is inserted through the lower insertion slot 62 of the lower housing module 70, the card contact part 235 of the movable terminal 230 comes into contact with the X2-side surface of the first memory card 20 to be pushed outward in the X2 direction.

Further, when the writing indication member 23 of the first memory card 20, inserted into the card insertion part 220 of the lower housing module 70 and attached, is at the write enable position P2, the card contact part 235 of the movable terminal 230 comes into contact with the writing indication member 23.

As a result, the flexible part 234 of the movable terminal 230 elastically deforms toward the X2 direction, and the contact part 237*a* at the end of the wiping part 237 of the movable terminal 230 is displaced across the first fixed terminal 440 to a detection position where the contact part 237*a* comes into contact with the upper surface of the second fixed terminal 450. Then, the wiping part 237 is pushed outward in the X2 direction by the bent part 236 while being subject to resistance from the sliding contact of the contact part 237*a* with the upper surface of the second fixed terminal 450 and bent slightly. As a result, the contact part 237*a* of the wiping part 237 slides to perform a wiping operation while pressing the upper surface of the second fixed terminal 450 with the spring force of the movable terminal 230.

Figure 18C:
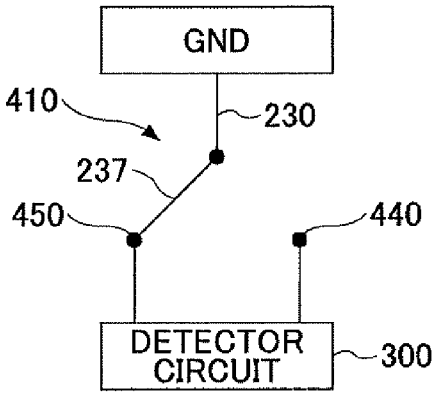
FIG. 18C is a schematic diagram illustrating the operating state of the switch mechanism when the first memory card in the write enable state is inserted according to the second embodiment of the present invention.

FIG. 18C is a schematic diagram illustrating the operating state of the switch mechanism 410 when the first memory card 20 in the write enable state is inserted.

Referring to FIG. 18C, the wiping part 237 of the movable terminal 230 is in contact with the upper surface of the second fixed terminal 450. As a result, the second fixed terminal 450 is ON, while the first fixed terminal 440 is OFF. Accordingly, the detector circuit 300 receives the detection signal output by the switch mechanism 410, and determines that the first memory card 20 is attached and the writing indication member 23 of the first memory card 20 is at the write enable position P2 based on the combination of the output states of detection signals (OFF, ON) from the first fixed terminal 440 and the second fixed terminal 450.

Figure 19A:
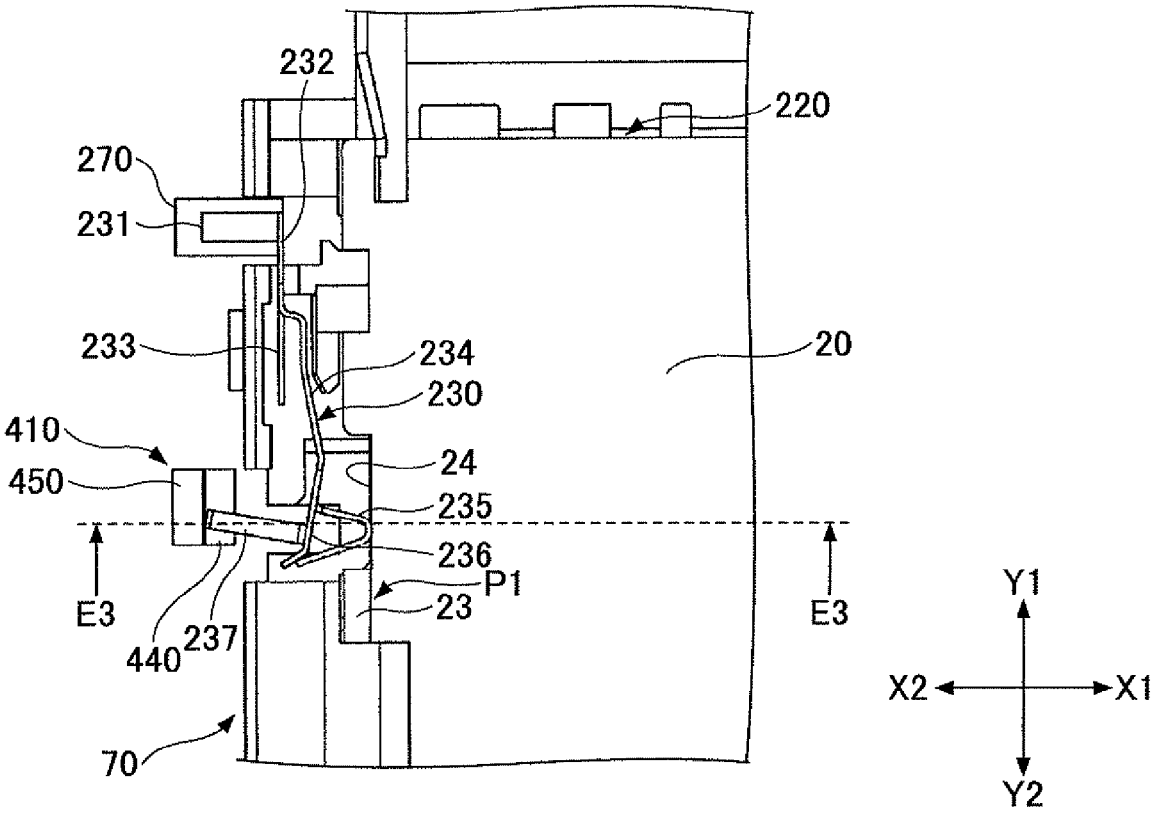
FIG. 19A is a plan view of the switch mechanism at a time when the first memory card in the write inhibit state is inserted into the card insertion part according to the second embodiment of the present invention.
Figure 19B:
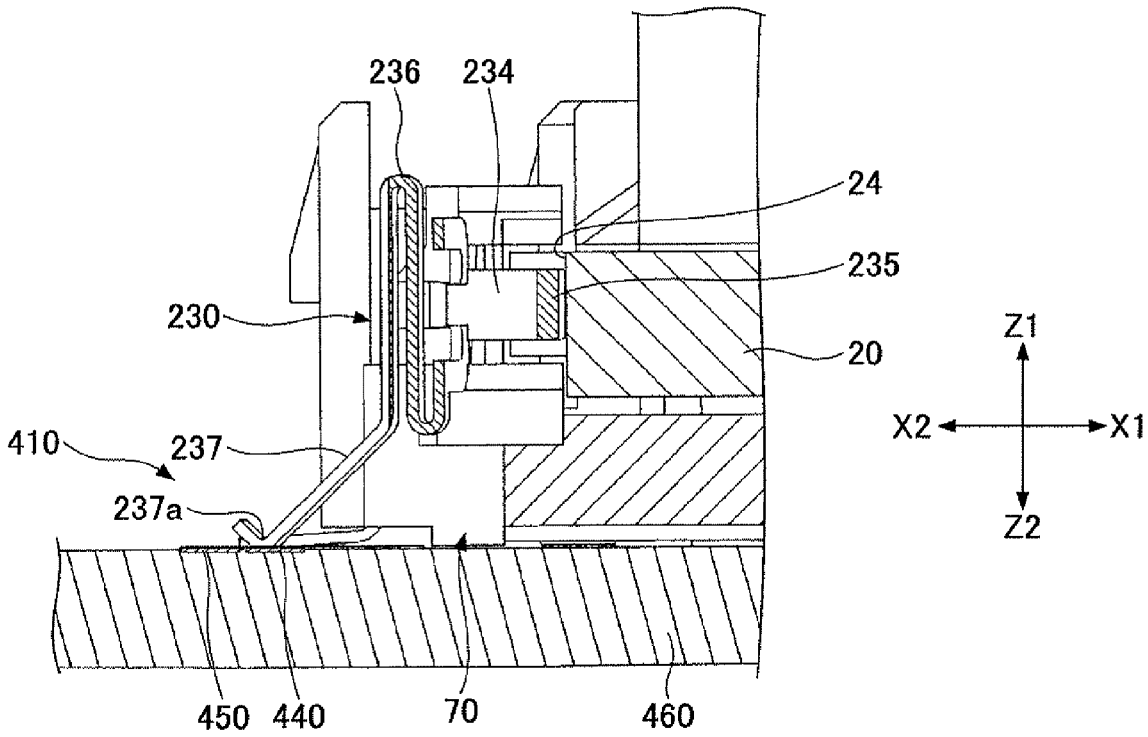
FIG. 19B is a cross-sectional view of the structure illustrated in FIG. 19A taken along broken line E3-E3 according to the second embodiment of the present invention.

FIG. 19A is a plan view of the switch mechanism 410 at a time when the first memory card 20 in the write inhibit state is inserted into the card insertion part 220. FIG. 19B is a cross-sectional view of the structure illustrated in FIG. 19A taken along broken line E3-E3.

Referring to FIGS. 19A and 19B, when the first memory card 20 is inserted through the lower insertion slot 62 of the lower housing module 70, the card contact part 235 of the movable terminal 230 comes into contact with the X2-side surface of the first memory card 20 to be pushed outward in the X2 direction.

Further, when the writing indication member 23 of the first memory card 20 inserted into the card insertion part 220 of the lower housing module 70 is at the write inhibit position P1, the recess 24 formed on the X2-side surface of the first memory card 20 comes into contact with the card contact part 235 of the movable terminal 230.

As a result, the wiping part 237 of the movable terminal 230 returns in the X1 direction when the card contact part 235 comes into contact with the recess 24 formed on the X2-side surface of the first memory card 20, after being displaced in the X2 direction with the insertion of the first memory card 20. The amount of returning in the X1 direction is determined to be approximately equal to the pitch (the distance between the centers) of the first fixed terminal 440 and the second fixed terminal 450.

Therefore, the contact part 237*a* of the wiping part 237 is displaced to a position where the contact part 237*a* comes into sliding contact with the upper surface of the first fixed terminal 440 after once coming into sliding contact with the upper surface of the second fixed terminal 450.

Figure 19C:
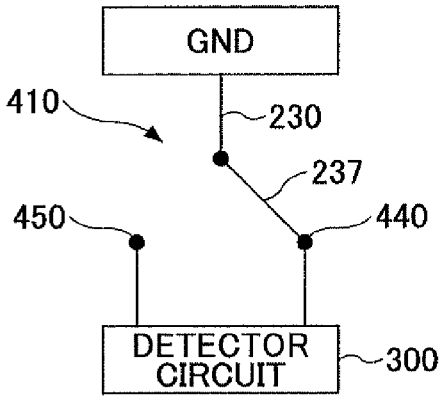
FIG. 19C is a schematic diagram illustrating the operating state of the switch mechanism when the first memory card in the write inhibit state is inserted according to the second embodiment of the present invention.

FIG. 19C is a schematic diagram illustrating the operating state of the switch mechanism 410 when the first memory card 20 in the write inhibit state is inserted.

Referring to FIG. 19C, the wiping part 237 of the movable terminal 230 is at a position to contact only the first fixed terminal 440. As a result, the first fixed terminal 440 is ON, while the second fixed terminal 450 is OFF. Accordingly, the detector circuit 300 receives the detection signal output by the switch mechanism 410, and determines that the first memory card 20 is attached and the writing indication member 23 of the first memory card 20 is at the write inhibit position P1 based on the combination of the output states of detection signals (ON, OFF) from the first fixed terminal 440 and the second fixed terminal 450.

Thus, according to the card connector 400, the amount of displacement of the movable terminal 230 changes based on the state of the first memory card 20 inserted, so that the movable terminal 230 comes into contact with (ON) the first fixed terminal 440 or the second fixed terminal 450 or loses contact with (is separated from) (OFF) one or both of the first fixed terminal 440 and the second fixed terminal 450. This reduces the number of movable terminals so as to facilitate assembly of a connector, thus making it possible to improve production efficiency.

[c] Third Embodiment

Figure 20:
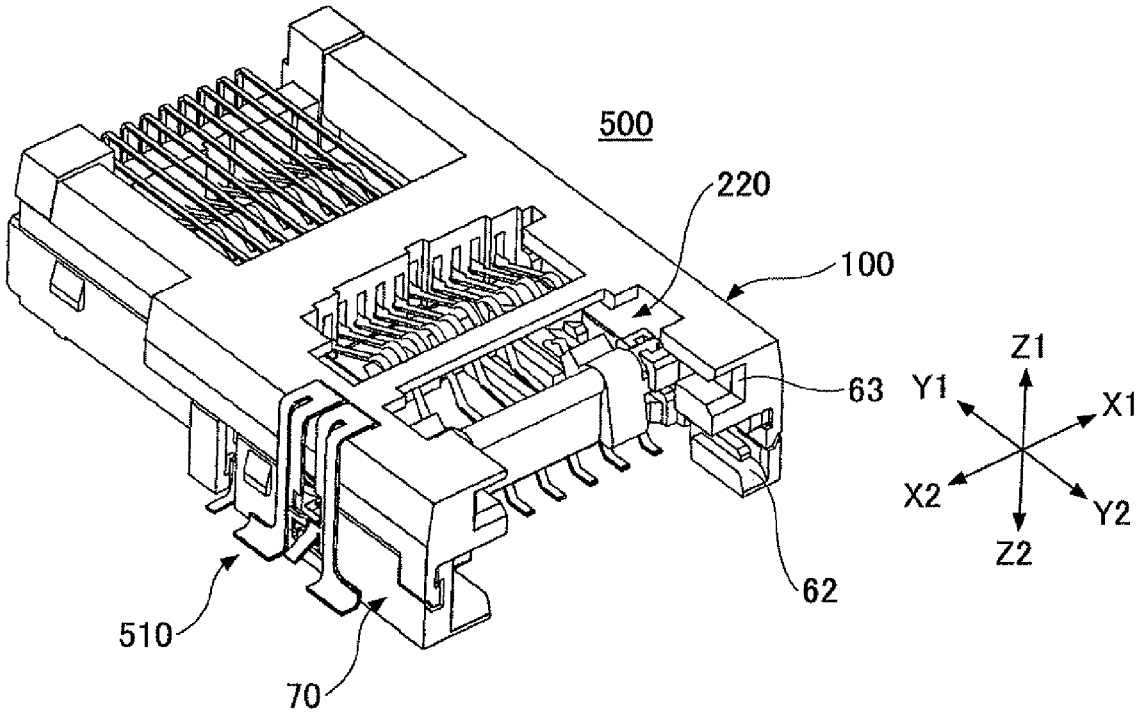
FIG. 20 is a perspective view of a card connector according to a third embodiment of the present invention.

FIG. 20 is a perspective view of a card connector 500 according to a third embodiment of the present invention. In FIG. 20, the same elements as those illustrated in FIG. 4 and FIG. 13 are referred to by the same reference numerals, and a description thereof is omitted.

Referring to FIG. 20, the card connector 500 includes the lower housing module 70 and the upper housing 100. The card connector 500 has a switch mechanism 510 provided on its X2-side surface.

A description is given of a configuration of the switch mechanism 510.

Figure 21:
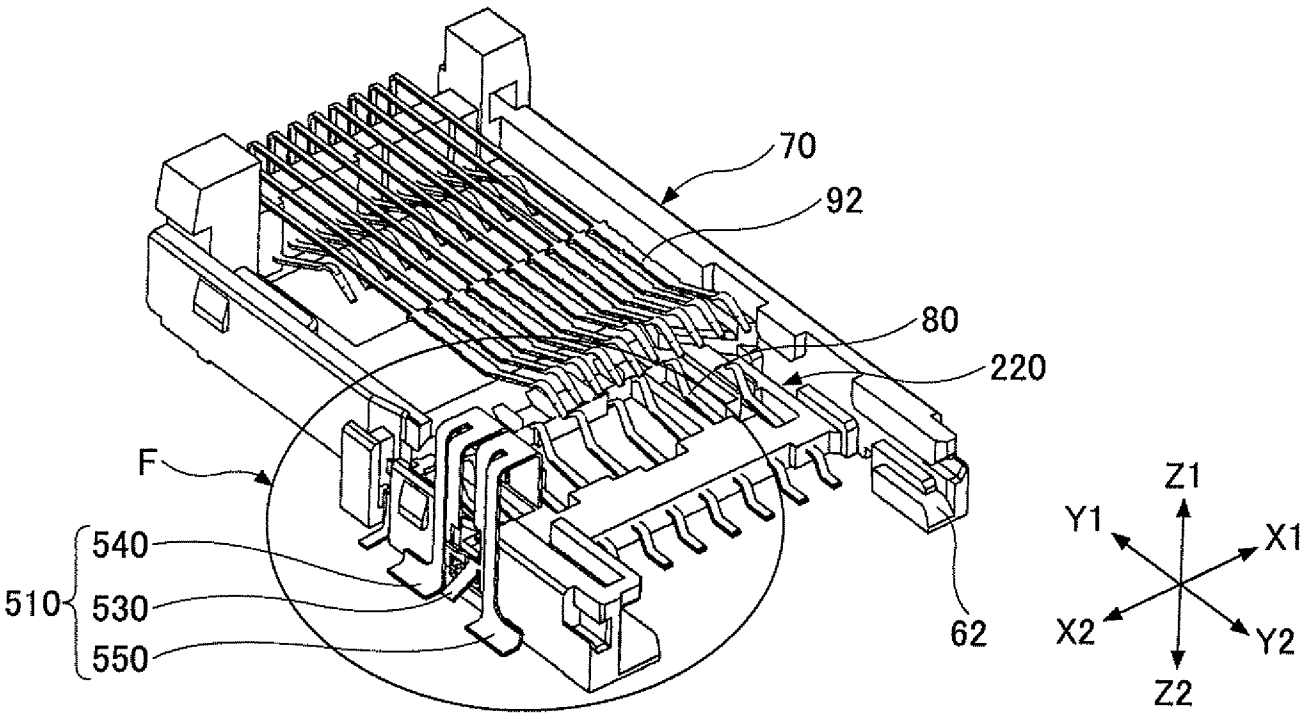
FIG. 21 is a perspective view of the lower housing module according to the third embodiment of the present invention.
Figure 22:
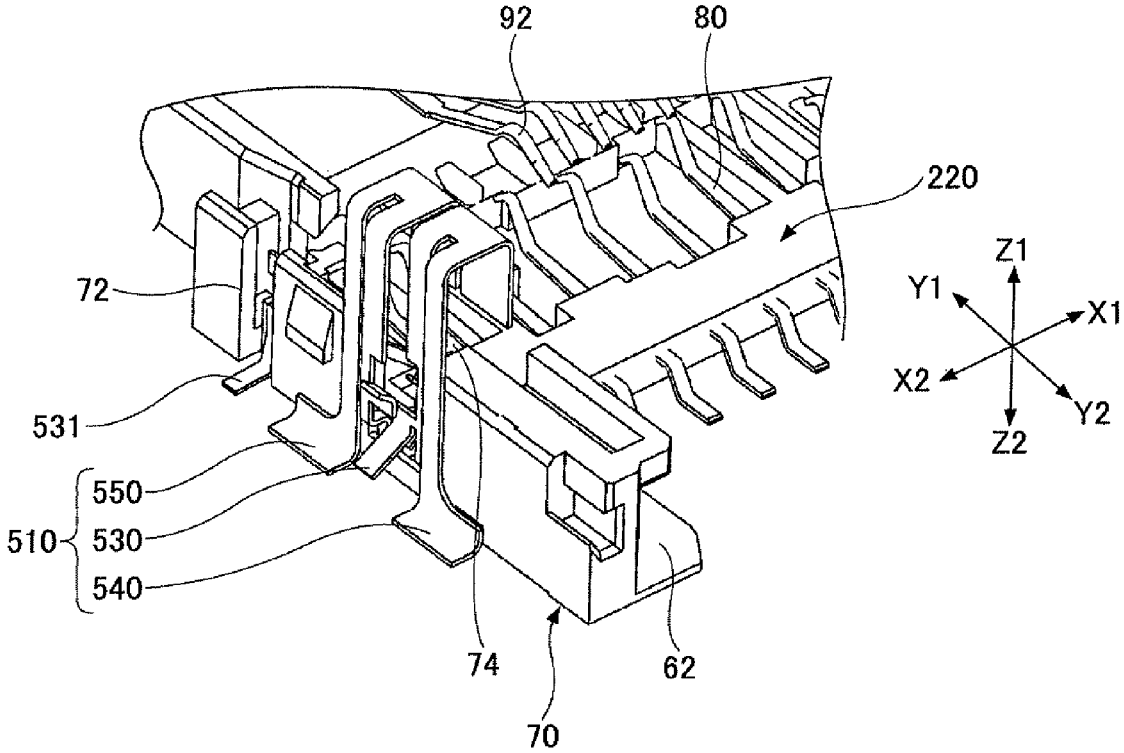
FIG. 22 is an enlarged view from the X2 side of the circled portion of the lower housing module indicated by arrow F in FIG. 21 according to the third embodiment of the present invention.
Figure 23:
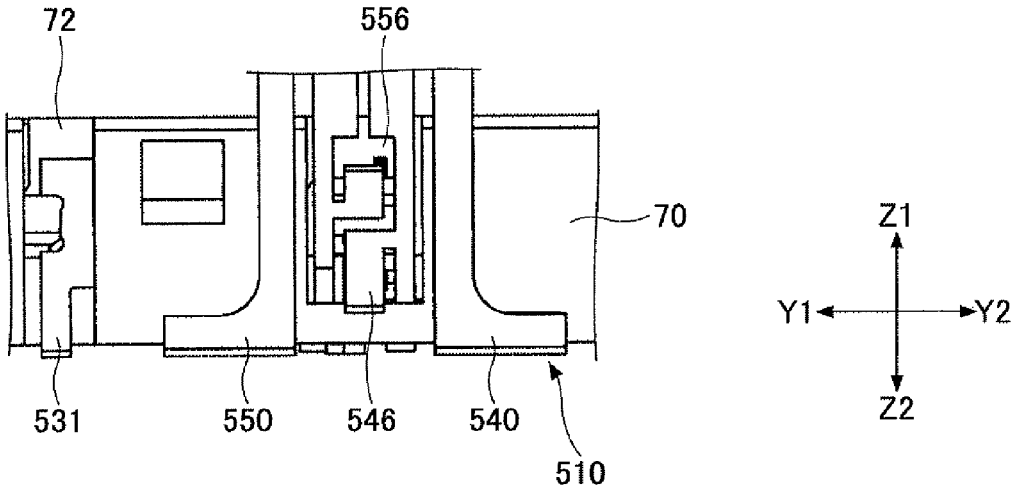
FIG. 23 is an X2-side view of part of a switch mechanism of the card connector according to the third embodiment of the present invention.
Figure 24:
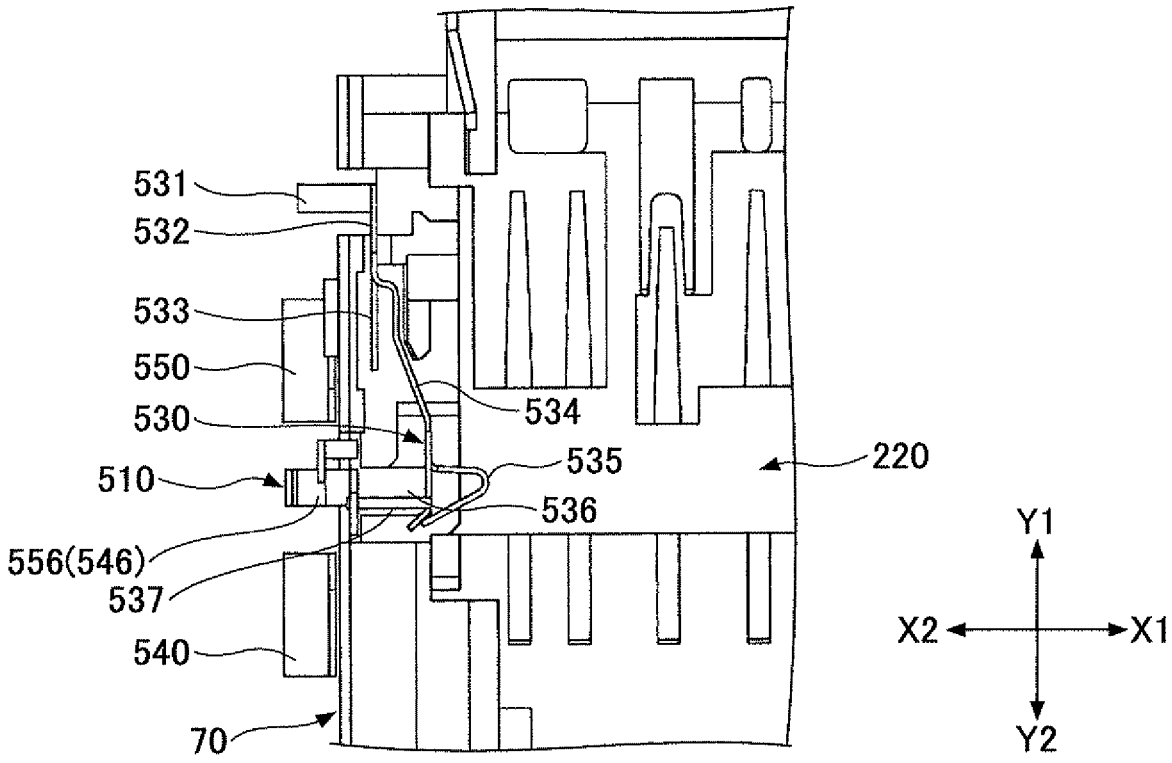
FIG. 24 is a plan view of the switch mechanism according to the third embodiment of the present invention.

FIG. 21 is a perspective view of the lower housing module 70. FIG. 22 is an enlarged view from the X2 side of the circled portion of the lower housing module 70 indicated by arrow F in FIG. 21. FIG. 23 is an X2-side view of part of the switch mechanism 510. FIG. 24 is a plan view of the switch mechanism 510.

Referring to FIG. 21 through FIG. 24, the switch mechanism 510 is provided on the X2 side of the card insertion part 220. The switch mechanism 510 includes a movable terminal 230, a first fixed terminal 540, and a second fixed terminal 550.

Figure 25A:
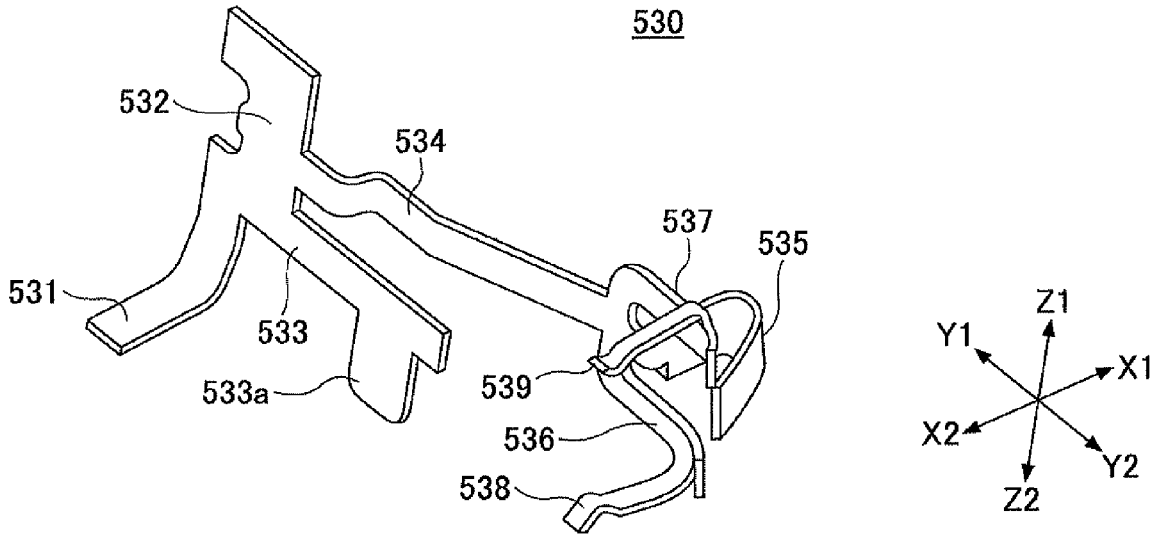
FIG. 25A is a perspective view of a movable terminal of the switch mechanism according to the third embodiment of the present invention.

FIG. 25A is a perspective view of the movable terminal 530. Referring to FIG. 25A, like the movable terminal 230 (FIG. 8A) of the above-described first embodiment, the movable terminal 530 includes a lead terminal 531, a support part 532, a holding part 533, a flexible part 534, and a card contact part 535. The movable terminal 530 further includes a pair of arm parts 536 and 537 and a first wiping part 538 and a second wiping part 539 extending in the X2 direction from the ends of the arm parts 536 and 537, respectively. The arm parts 536 and 537 extend from the end of the flexible part to be vertically spaced from each other into a bifurcate shape.

The first wiping part 538 extends in the X2 direction below the second wiping part 539 (that is, the second wiping part 539 extends in the X2 direction above the first wiping part 538). The first wiping part 538 and the second wiping part 539 are laterally axisymmetric (in the X1 and the X2 direction) in the same vertical plane.

Figure 25B:
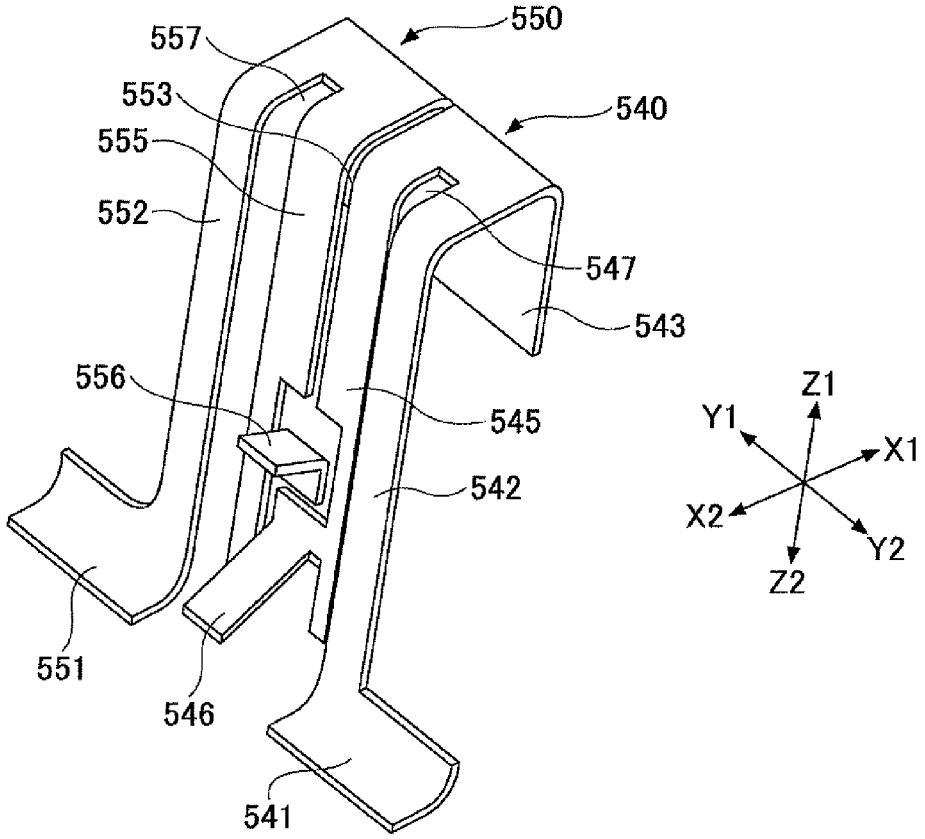
FIG. 25B is a perspective view of a first fixed terminal and a second fixed terminal of the switch mechanism according to the third embodiment of the present invention.

FIG. 25B is a perspective view of the first fixed terminal 540 and the second fixed terminal 550.

The first fixed terminal 540 has a crank shape in a view from the Y1 side. The first fixed terminal 540 includes a contact part 541, a vertical part 542, an engagement part 543, a drooped part 545, and a first contact part 546. The contact part 541 has an L-letter shape with a horizontal surface to be soldered to a circuit pattern on the printed board and a vertical surface.

The vertical part 542 extends in a vertical direction (the Z1 direction) from the contact part 541 so as to have its upper end positioned above the lower housing module 70 as illustrated in FIG. 20 through FIG. 22. The engagement part 543 extends in the X1 direction from the upper end of the vertical part 542 to be bent downward so as to have its lower end press-fit into a slit provided at the upper surface of the lower housing module 70.

The drooped part 545 stems from the upper end of the engagement part 543 to extend downward side by side with the vertical part 542 (with an offset along the X-axis) with a gap 547 between the drooped part 545 and the vertical part 542. The first contact part 546 is provided at the lower end of the drooped part 545 so as to face the first wiping part 538.

Like the first fixed terminal 540, the second fixed terminal 550 has a crank shape in a view from the Y1 side. The second fixed terminal 550 includes a contact part 551, a vertical part 552, an engagement part 553, a drooped part 555, and a second contact part 556. The contact part 551 has an L-letter shape with a horizontal surface to be soldered to a circuit pattern on the printed board and a vertical surface.

The vertical part 552 extends in a vertical direction (the Z1 direction) from the contact part 551 so as to have its upper end positioned above the lower housing module 70 as illustrated in FIG. 20 through FIG. 22. The engagement part 553 extends in the X1 direction from the upper end of the vertical part 552 to be bent downward so as to have its lower end press-fit into a slit provided at the upper surface of the lower housing module 70.

The drooped part 555 stems from the upper end of the engagement part 553 to extend downward side by side with the vertical part 552 (with an offset along the X-axis) with a gap 557 between the drooped part 555 and the vertical part 552. The first contact part 556 is provided at the lower end of the drooped part 555 so as to face the second wiping part 539.

As illustrated in FIG. 25B, the first fixed terminal 540 and the second fixed terminal 550 are provided to be vertically axisymmetric in shape in a view from the X2 side, while the first contact part 546 which comes into contact with the first wiping part 538 and the second contact part 556 which comes into contact with the second wiping part 539 are offset along the X-axis.

Figure 26:
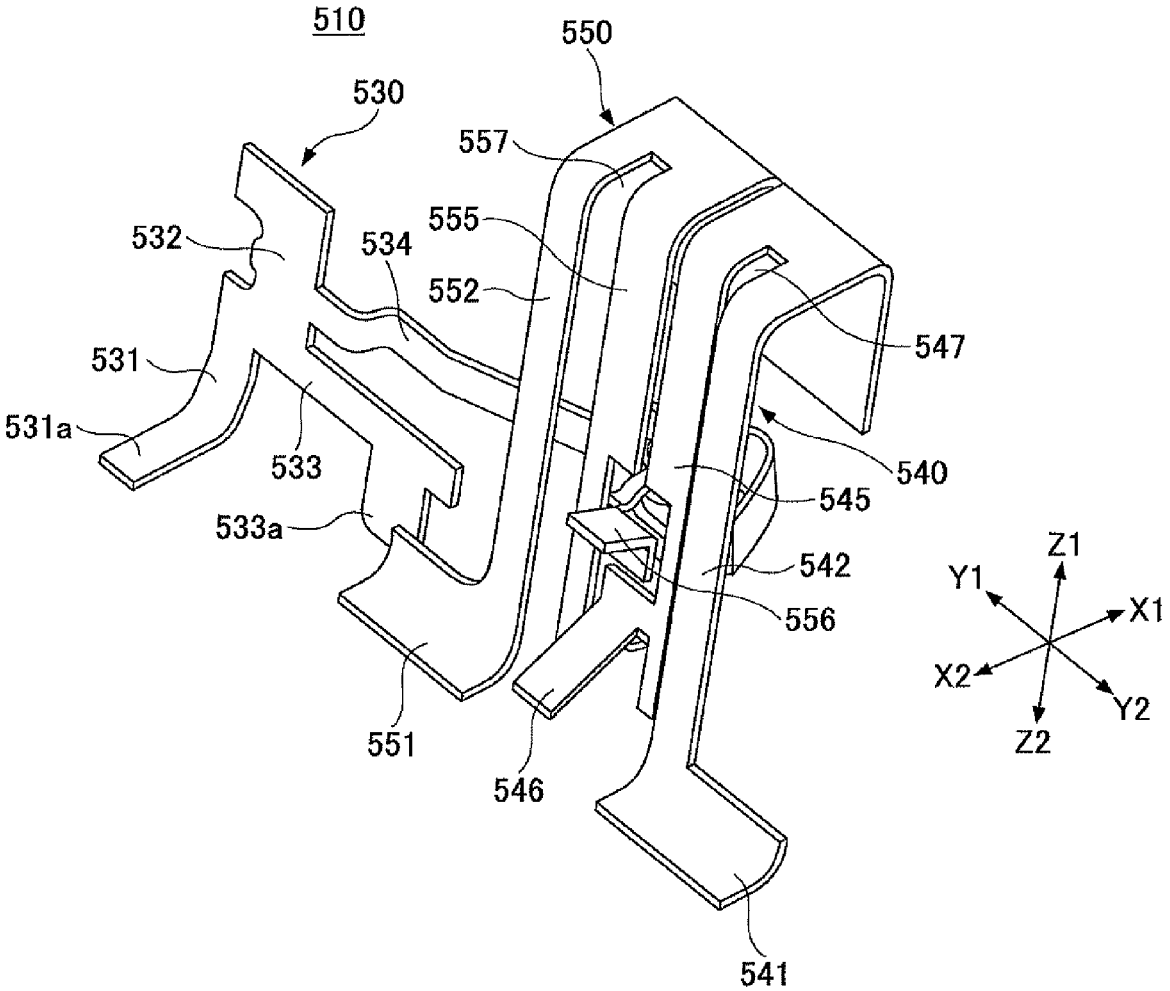
FIG. 26 is an X2-side perspective view (from outside the lower housing module) of the movable terminal, the first fixed terminal, and the second fixed terminal in an attached state according to the third embodiment of the present invention.
Figure 27:
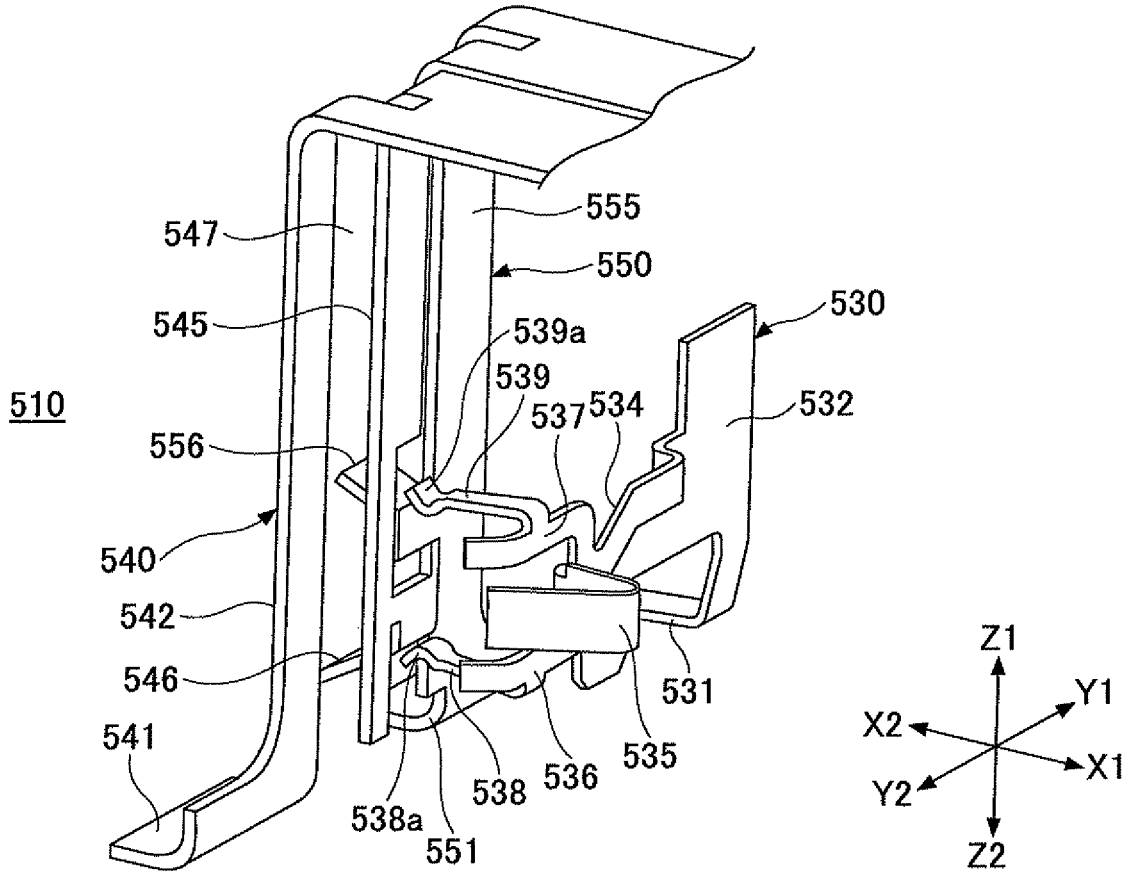
FIG. 27 is an X1-side perspective view (from inside the lower housing module) of the movable terminal, the first fixed terminal, and the second fixed terminal in the attached state according to the third embodiment of the present invention.

FIG. 26 is an X2-side perspective view (from outside the lower housing module 70) of the movable terminal 530, the first fixed terminal 540, and the second fixed terminal 550 in an attached state. FIG. 27 is an X1-side perspective view (from inside the lower housing module 70) of the movable terminal 530, the first fixed terminal 540, and the second fixed terminal 550 in the attached state. In FIG. 26 and FIG. 27, the engagement parts 543 and 553 and the lower housing module 70 are not illustrated.

As illustrated in FIG. 26 and FIG. 27, in the switch mechanism 510, the first wiping part 538 and the second wiping part 539 of the movable terminal 530 face (are opposed to) the first contact part 546 of the first fixed terminal 540 and the second contact part 556 of the second fixed terminal 550, respectively, from inside the lower housing module 70.

The first contact part 546 of the first fixed terminal 540 is inclined downward. The first wiping part 538 includes a contact part 538*a* at its end. The contact part 538*a* is rounded and has its end inclined downward so as to reduce sliding resistance at the time of contact with (the lower surface of) the first contact part 546. The second contact part 556 of the second fixed terminal 550 is inclined upward. The second wiping part 539 includes a contact part 539*a* at its end. The contact part 539*a* is rounded and has its end inclined upward so as to reduce sliding resistance at the time of contact with (the upper surface of) the second contact part 556.

Next, a description is given of a detecting operation of the switch mechanism 510.

Figure 28A:
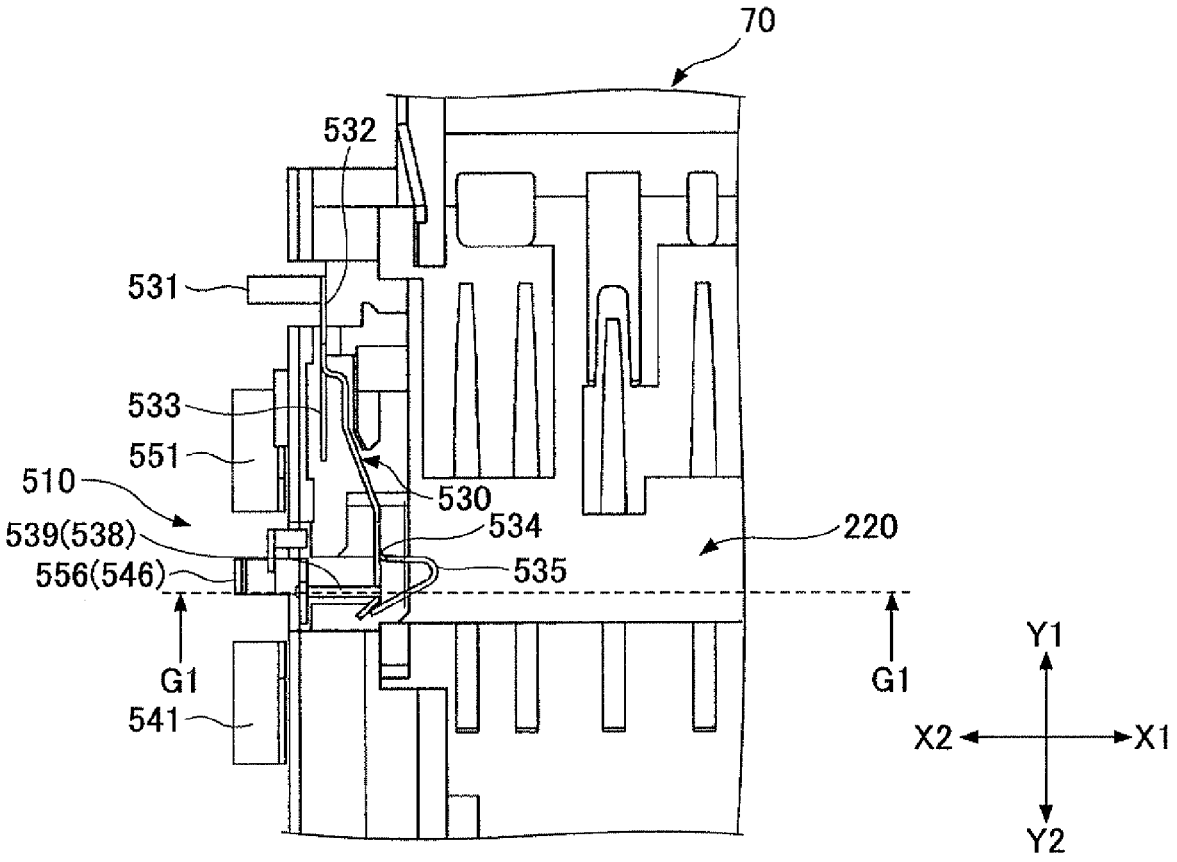
FIG. 28A is a plan view of the switch mechanism at a time when the first memory card is not inserted according to the third embodiment of the present invention.
Figure 28B:
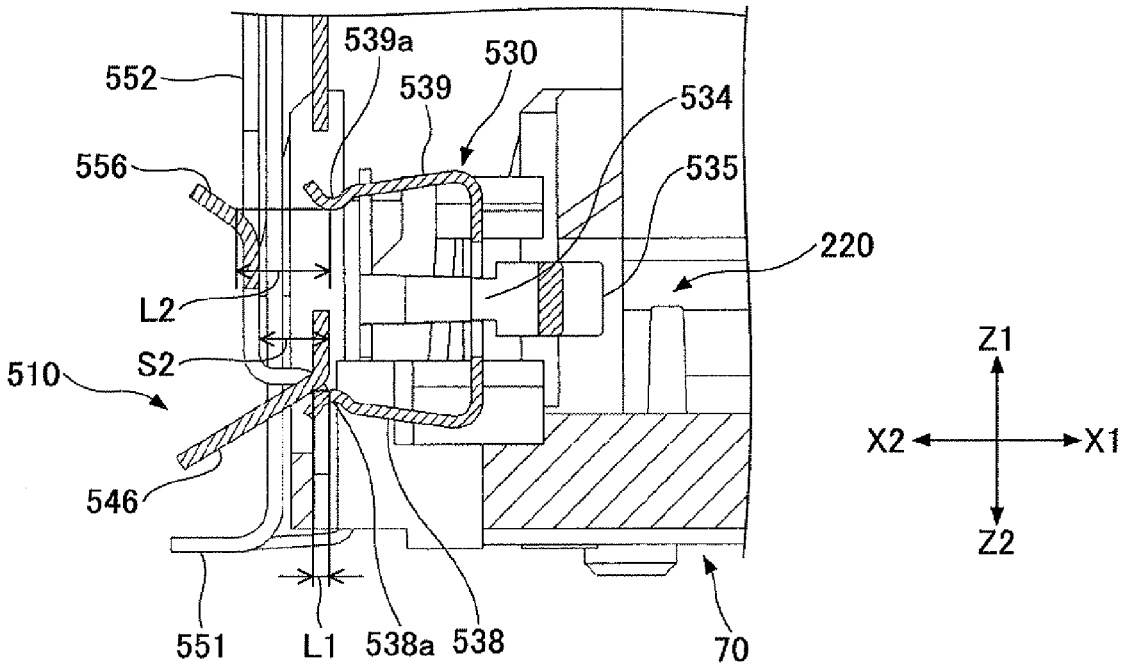
FIG. 28B is a cross-sectional view of the structure illustrated in FIG. 28A taken along broken line G1-G1 according to the third embodiment of the present invention.

FIG. 28A is a plan view of the switch mechanism 510 at a time when the first memory card 20 is not inserted. FIG. 28B is a cross-sectional view of the structure illustrated in FIG. 28A taken along broken line G1-G1.

Referring to FIGS. 28A and 28B, when the first memory card 20 is not inserted through the lower insertion slot 62 of the lower housing module 70, the flexible part 534 of the movable terminal 530 is at its original (reference) position with the card contact part 535 of the movable terminal 530 projecting into the card insertion part 220.

When the first memory card 20 is not inserted, the first wiping part 538 and the second wiping part 539 of the movable terminal 530 are positioned in a neutral region spaced apart from the first contact part 546 and the second contact part 556 of the first fixed terminal 540 and the second fixed terminal 550, respectively. Further, there is an offset S2 (FIG. 28B) between the first contact part 546 of the first fixed terminal 540 and the second contact part 556 of the second fixed terminal 550 along the X-axis. That is, the offset (distance or interval) between the X1 end of the first contact part 546 and the X1 end of the second contact part 556 is the offset S2.

Further, a distance L1 between the contact part 538*a* of the first wiping part 538 and (the lower surface of) the contact part 546 of the first fixed terminal 540 is shorter than a distance L2 between the contact part 539*a* of the second wiping part 539 and (the upper surface of) the contact part 556 of the second fixed terminal 550 by a predetermined ratio. For example, the distance L1 may be approximately one-fifth of the distance L2.

That is, according to this embodiment, the distance L1 is shorter than the distance L2 (L1<L2). Accordingly, when the flexible part 534 of the movable terminal 530 is displaced in the X2 direction, first, the contact part 538*a* of the first wiping part 538 comes into contact with the first contact part 546 of the first fixed terminal 540. Then, the flexible part 534 of the movable terminal 530 is further displaced in the X2 direction so that the contact part 539*a* of the second wiping part 539 comes into contact with the contact part 556 of the second fixed terminal 550. Therefore, according to the switch mechanism 510 of this embodiment, the state where a detection signal is obtained from the first fixed terminal 540 and the state where detection signals are obtained from the first fixed terminal 540 and the second fixed terminal 550 are switched with a time difference in accordance with the amounts of displacement of the first wiping part 538 and the second wiping part 539 of the movable terminal 530.

Figure 28C:
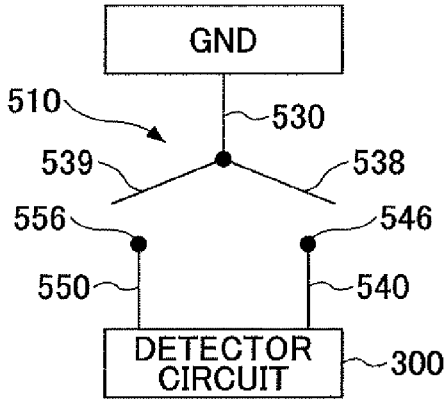
FIG. 28C is a schematic diagram illustrating the state of the switch mechanism when the first memory card is not inserted according to the third embodiment of the present invention.

FIG. 28C is a schematic diagram illustrating the state of the switch mechanism 510 when the first memory card 20 is not inserted.

Referring to FIG. 28C, the contact part 538*a* of the first wiping part 538 and the contact part 539*a* of the second wiping part 539 of the movable terminal 530 are separated from the first contact part 546 of the first fixed terminal 540 and the second contact part 556 of the second fixed terminal 550, respectively (in a neutral position), so that the first wiping part 538 and the second wiping part 539 are out of contact with the first contact part 546 and the second contact part 556, respectively, to be in the OFF state.

Accordingly, the detector circuit 300 receives no detection signals from the switch mechanism 510, and determines that the first memory card 20 is not inserted based on the combination of the output states of detection signals (OFF, OFF) from the first fixed terminal 540 and the second fixed terminal 550.

Figure 29A:
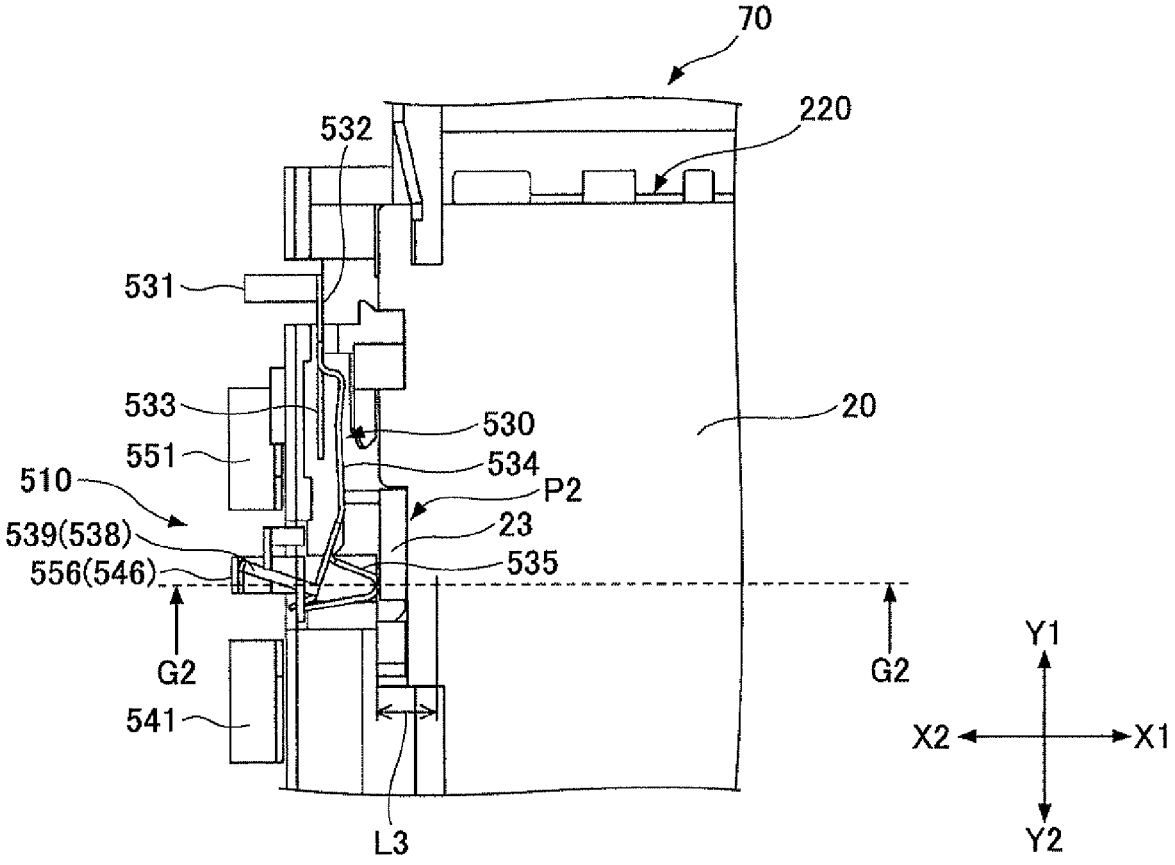
FIG. 29A is a plan view of the switch mechanism at a time when the first memory card in the write enable state is inserted into the card insertion part according to the third embodiment of the present invention.
Figure 29B:
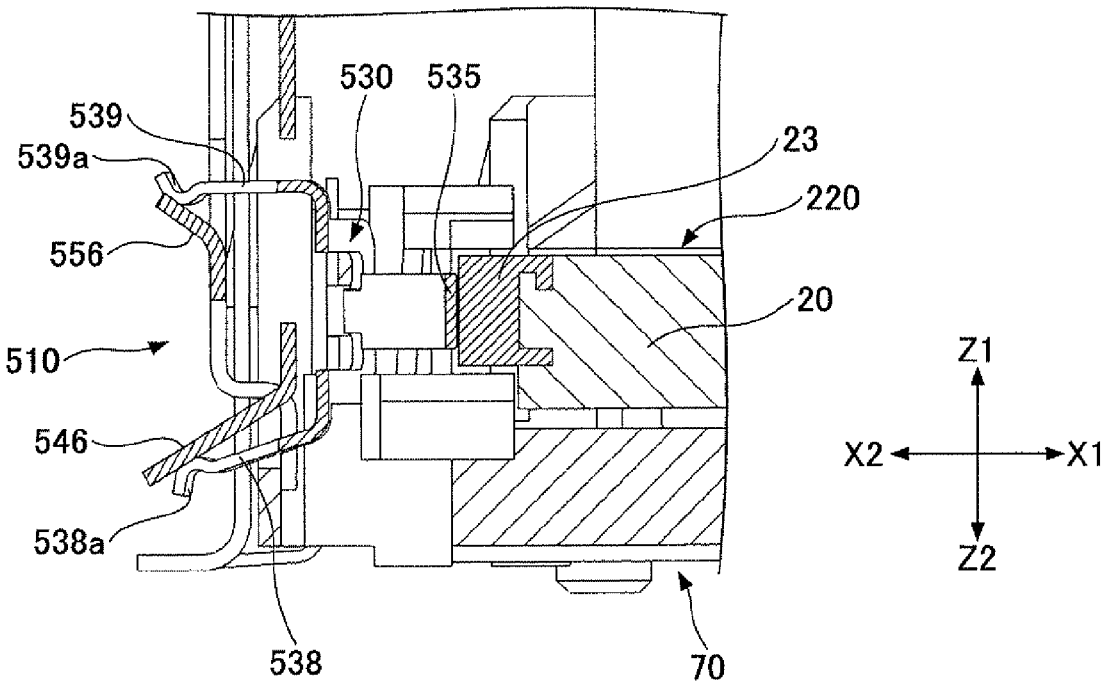
FIG. 29B is a cross-sectional view of the structure illustrated in FIG. 29A taken along broken line G2-G2 according to the third embodiment of the present invention.

FIG. 29A is a plan view of the switch mechanism 510 at a time when the first memory card 20 in the write enable state is inserted into the card insertion part 220. FIG. 29B is a cross-sectional view of the structure illustrated in FIG. 29A taken along broken line G2-G2.

Referring to FIGS. 29A and 29B, when the first memory card 20 is inserted through the lower insertion slot 62 of the lower housing module 70, the card contact part 535 of the movable terminal 530 comes into contact with the X2-side surface of the first memory card 20 to be pushed outward in the X2 direction.

Further, when the writing indication member 23 of the first memory card 20, inserted into the card insertion part 220 of the lower housing module 70 and attached, is at the write enable position P2, the card contact part 535 of the movable terminal 530 comes into contact with the writing indication member 23.

As a result, the card contact part 535 of the movable terminal 530 comes into contact with the X2-side surface of the writing indication member 23 to be displaced in the X2 direction. In this case, the amount of displacement of the card contact part 535 is greater than the distance L2 between the contact part 539*a* of the second wiping part 539 and the second contact part 556 of the second fixed terminal 550 (FIG. 28B). That is, when the writing indication member 23 is in the write enable state, letting the amount of displacement of the first wiping part 538 and the second wiping part 539 of the movable terminal 530 be L3, the distance L1, the distance L2, and the distance L3 satisfy L1<L2<L3. Accordingly, the contact part 538*a* of the first wiping part 538 and the contact part 539*a* of the second wiping part 539 come into contact with (the lower surface of) the first contact part 546 of the first fixed terminal 540 and (the upper surface of) the second contact part 556 of the second fixed terminal 550, respectively.

During the operation of detecting the first wiping part 538 and the second wiping part 539, when the first wiping part 538 and the second wiping part 539 are displaced the distance L1, the contact part 538*a* of the first wiping part 538 comes into contact with the first contact part 546 of the first fixed terminal 540. Then, the first wiping part 538 and the second wiping part 539 are further displaced in the X2 direction with the contact part 538*a* of the first wiping part 538 sliding on and along the lower surface of the first contact part 546 of the first fixed terminal 540 while performing a wiping operation. When the first wiping part 538 and the second wiping part 539 are displaced the distance L2, the contact part 539*a* of the second wiping part 539 comes into contact with the second contact part 556 of the second fixed terminal 550.

Then, the card contact part 535 of the movable terminal 530 is pushed outward further in the X2 direction, so that the contact part 539*a* of the second wiping part 539 also slides on the upper surface of the second contact part 556 of the second fixed terminal 550 to perform a wiping operation. In this operating state, the first wiping part 538 and the second wiping part 539 are bent to widen the gap between the first wiping part 538 and the second wiping part 539, sliding along the inclined lower and upper surfaces of the first contact part 546 and the second contact part 556, respectively. Accordingly, the first wiping part 538 and the second wiping part 539 are bent to move away from each other along the Z-axis, so as to ensure their contacts with the first contact part 546 and the second contact part 556, respectively, with increasing pressing contact forces.

Figure 29C:
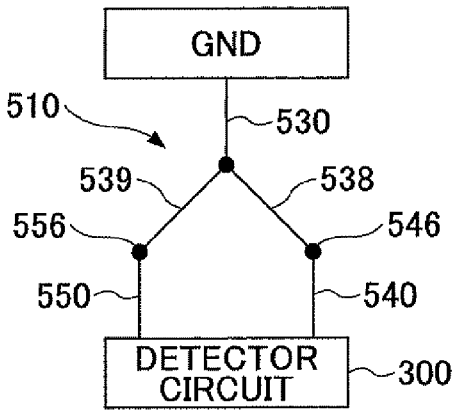
FIG. 29C is a schematic diagram illustrating the operating state of the switch mechanism when the first memory card in the write enable state is inserted according to the third embodiment of the present invention.

FIG. 29C is a schematic diagram illustrating the operating state of the switch mechanism 510 when the first memory card 20 in the write enable state is inserted.

Referring to FIG. 29C, the first wiping part 538 and the second wiping part 539 of the movable terminal 530 are in contact with the first contact part 546 of the first fixed terminal 540 and the second contact part 556 of the second fixed terminal 550, respectively, so that both of the first fixed terminal 540 and the second fixed terminal 550 are ON. Accordingly, the detector circuit 300 receives the detection signals output by the switch mechanism 510, and determines that the first memory card 20 is attached and the writing indication member 23 of the first memory card 20 is at the write enable position P2 based on the combination of the output states of detection signals (ON, ON) from the first fixed terminal 540 and the second fixed terminal 550.

Figure 30A:
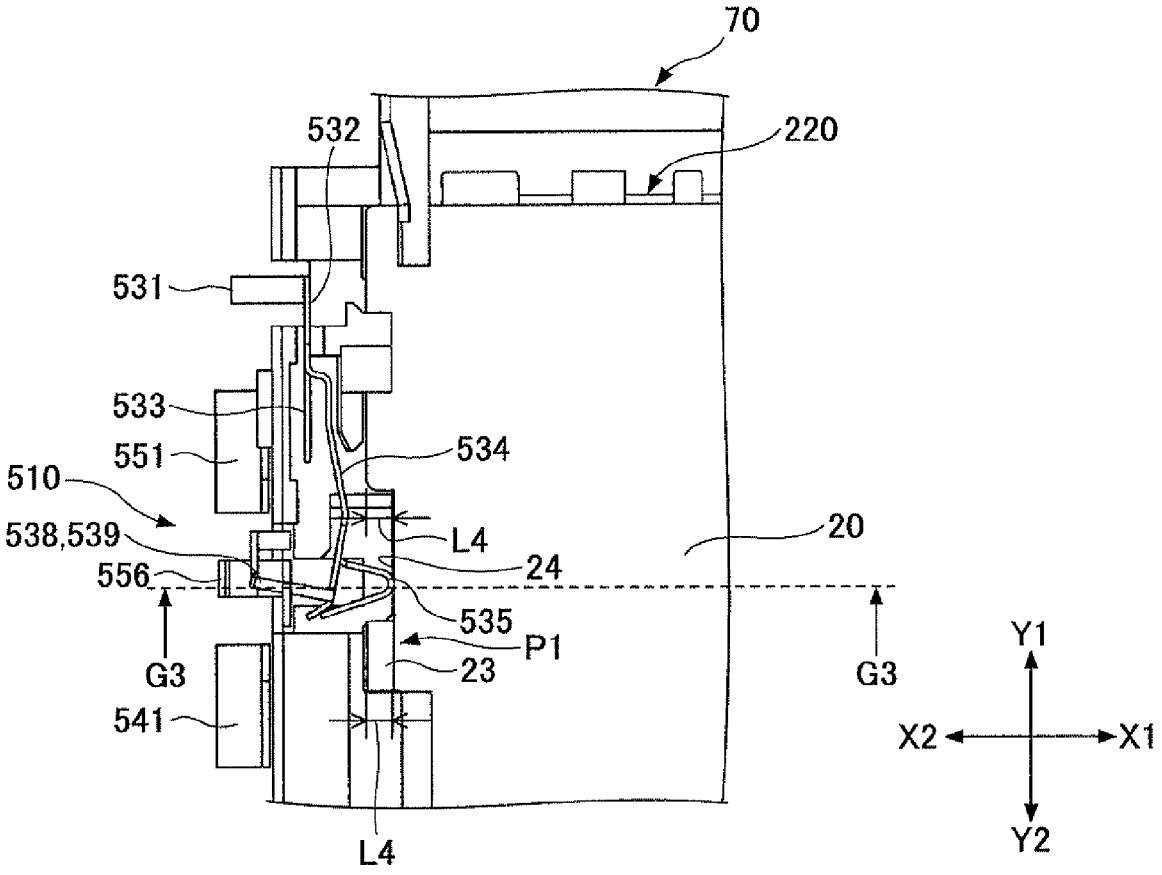
FIG. 30A is a plan view of the switch mechanism at a time when the first memory card in the write inhibit state is inserted into the card insertion part according to the third embodiment of the present invention.
Figure 30B:
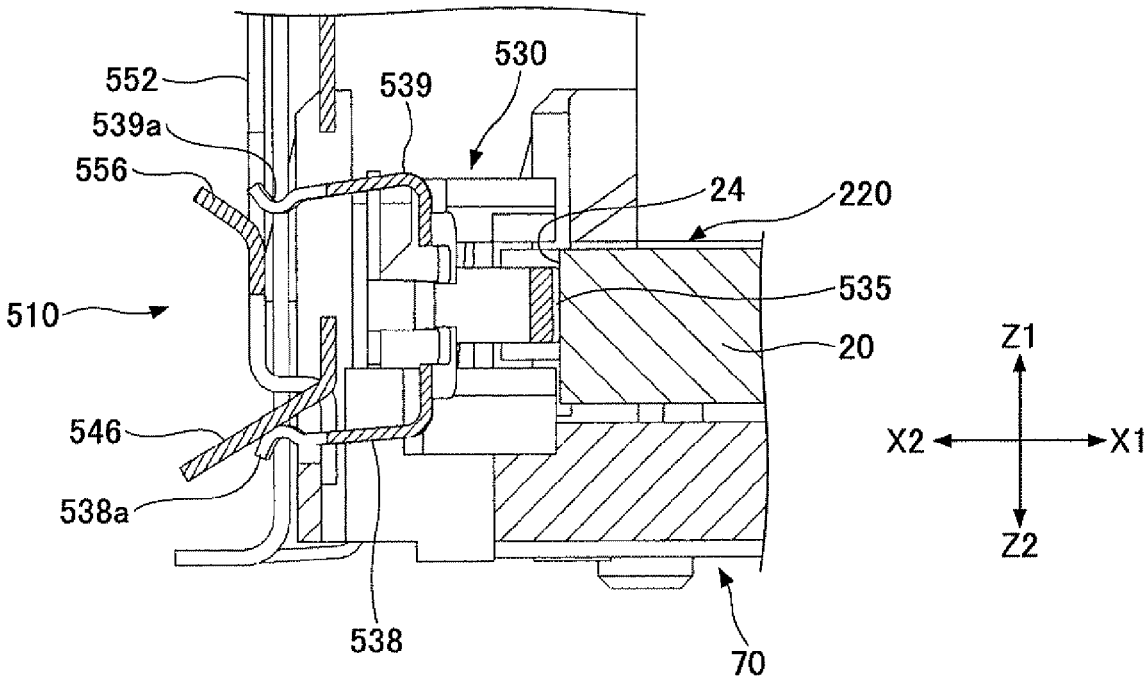
FIG. 30B is a cross-sectional view of the structure illustrated in FIG. 30A taken along broken line G3-G3 according to the third embodiment of the present invention.

FIG. 30A is a plan view of the switch mechanism 510 at a time when the first memory card 20 in the write inhibit state is inserted into the card insertion part 220. FIG. 30B is a cross-sectional view of the structure illustrated in FIG. 30A taken along broken line G3-G3.

Referring to FIGS. 30A and 30B, when the first memory card 20 is inserted through the lower insertion slot 62 of the lower housing module 70, the card contact part 535 of the movable terminal 530 comes into contact with the X2-side surface of the first memory card 20 to be pushed outward in the X2 direction.

Further, when the writing indication member 23 of the first memory card 20 inserted into the card insertion part 220 of the lower housing module 70 is at the write inhibit position P1, the recess 24 formed on the X2-side surface of the first memory card 20 comes into contact with the card contact part 535 of the movable terminal 530.

As a result, the first wiping part 538 and the second wiping part 539 of the movable terminal 530 return a distance L4 (the width of the writing indication member 23) in the X1 direction when the card contact part 535 comes into contact with the recess 24 formed on the X2-side surface of the first memory card 20, after being displaced the distance L3 (>L2) in the X2 direction with the insertion of the first memory card 20. The amount of returning in the X1 direction, or the distance L4, is determined to satisfy L2<L4<L3.

Therefore, the contact part 538*a* of the first wiping part 538 remains in contact with the first contact part 546 of the first fixed terminal 540, while the contact part 539*a* of the second wiping part 539 is separated from and out of contact with the second contact part 556 of the second fixed terminal 550.

Figure 30C:
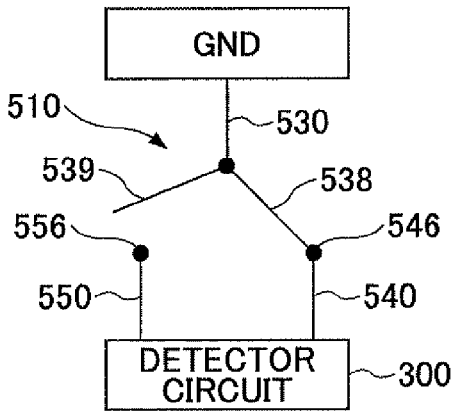
FIG. 30C is a schematic diagram illustrating the operating state of the switch mechanism when the first memory card in the write inhibit state is inserted according to the third embodiment of the present invention.

FIG. 30C is a schematic diagram illustrating the operating state of the switch mechanism 510 when the first memory card 20 in the write inhibit state is inserted.

Referring to FIG. 30C, the first wiping part 538 of the movable terminal 530 is in contact with the first fixed terminal 540 so that the first fixed terminal 540 is ON, while the second wiping part 539 of the movable terminal 530 is out of contact with the second fixed terminal 550 so that the second fixed terminal 550 is OFF. Accordingly, the detector circuit 300 receives the detection signal output by the switch mechanism 510, and determines that the first memory card 20 is attached and the writing indication member 23 of the first memory card 20 is at the write inhibit position P1 based on the combination of the output states of detection signals (ON, OFF) from the first fixed terminal 540 and the second fixed terminal 550.

Thus, according to the card connector 500, the amount of displacement of the movable terminal 530 changes based on the state of the first memory card 20 inserted, so that the movable terminal 530 comes into contact with (ON) or loses contact with (OFF) the first fixed terminal 540 and/or the second fixed terminal 550. This reduces the number of movable terminals so as to facilitate assembly of a connector, thus making it possible to improve production efficiency.

[d] Fourth Embodiment

Figure 31:
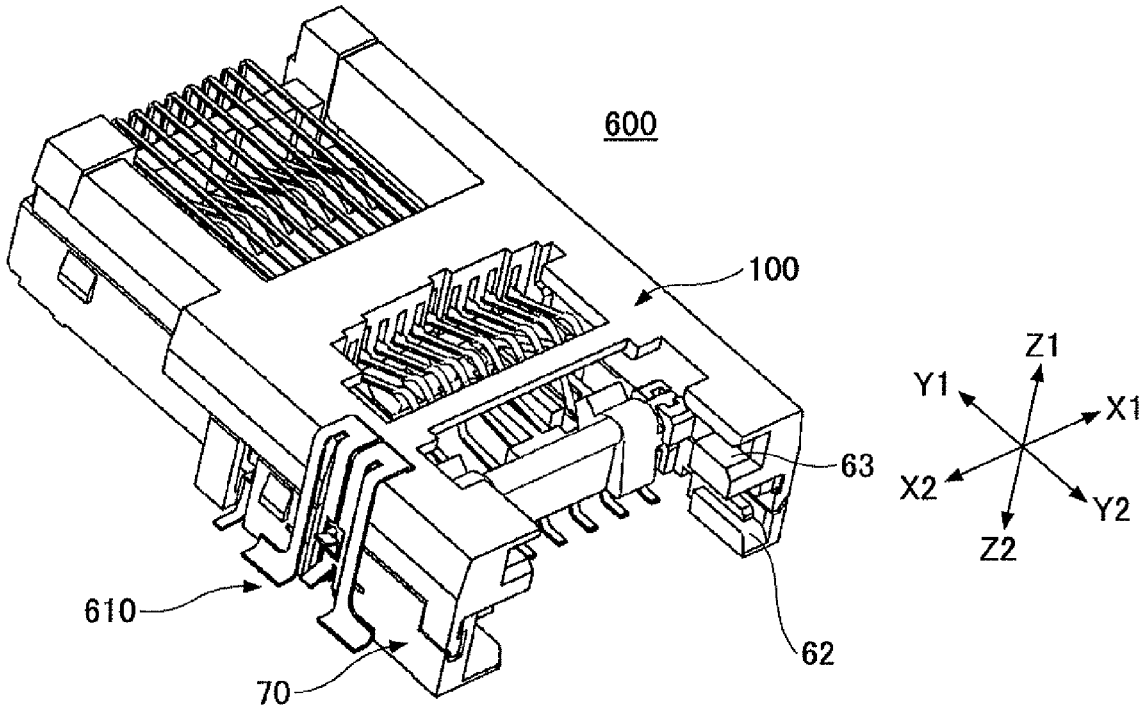
FIG. 31 is a perspective view of a card connector according to a fourth embodiment of the present invention.

FIG. 31 is a perspective view of a card connector 600 according to a fourth embodiment of the present invention. In FIG. 31, the same elements as those illustrated in FIG. 4, FIG. 13, and FIG. 20 are referred to by the same reference numerals, and a description thereof is omitted.

Referring to FIG. 31, the card connector 600 includes the lower housing module 70 and the upper housing 100. The card connector 600 has a switch mechanism 610 provided on its X2-side surface.

A description is given of a configuration of the switch mechanism 610.

Figure 32:
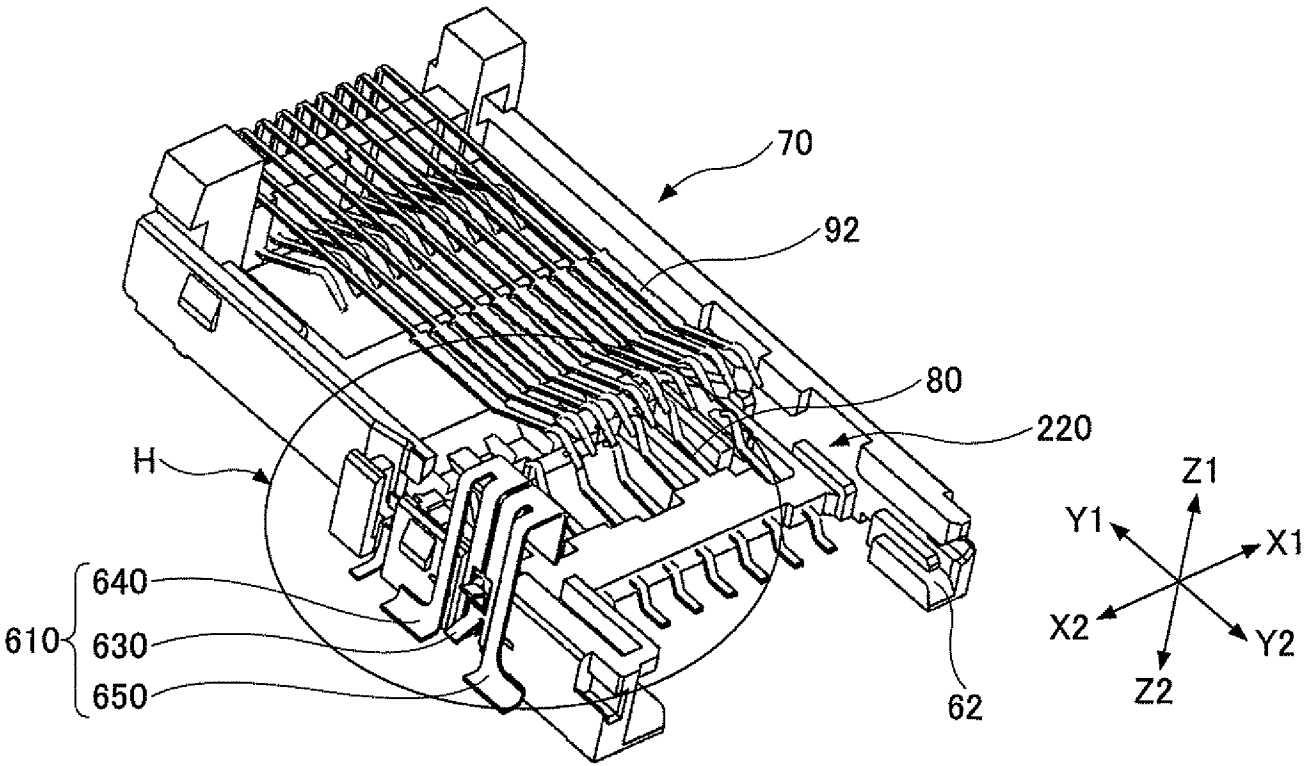
FIG. 32 is a perspective view of the lower housing module according to the fourth embodiment of the present invention.
Figure 33:
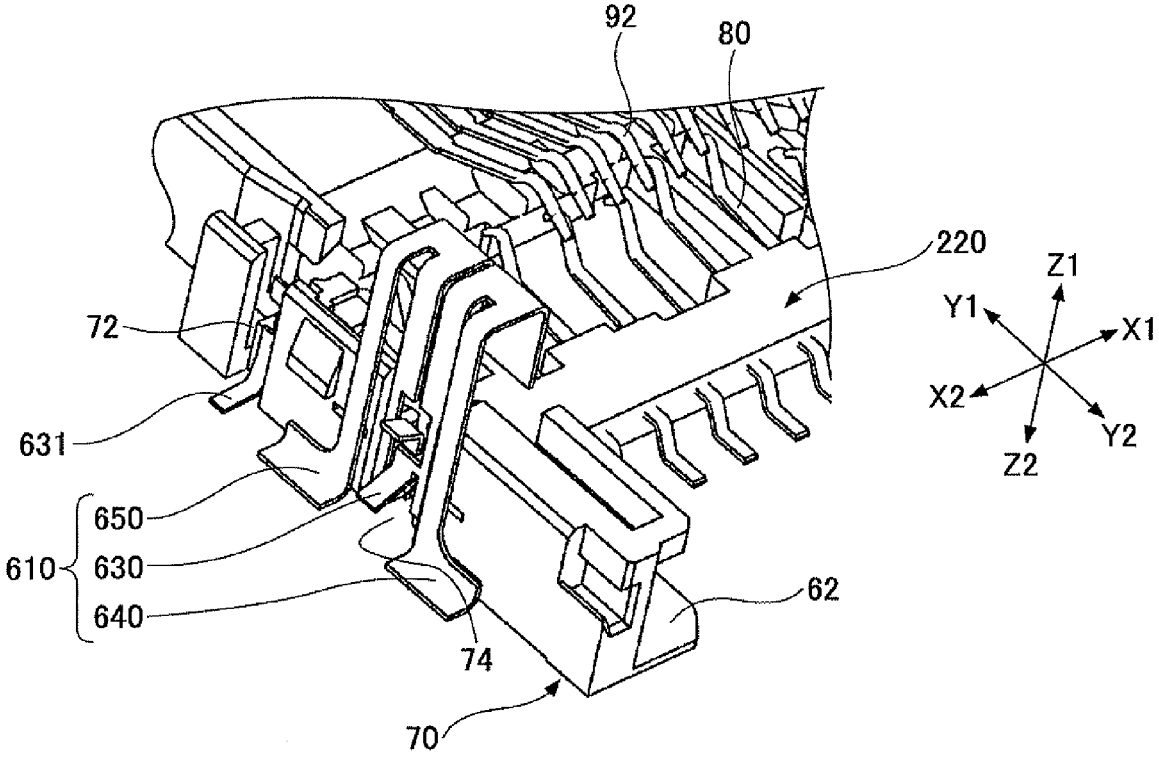
FIG. 33 is an enlarged view from the X2 side of the circled portion of the lower housing module indicated by arrow H in FIG. 32 according to the fourth embodiment of the present invention.
Figure 34:
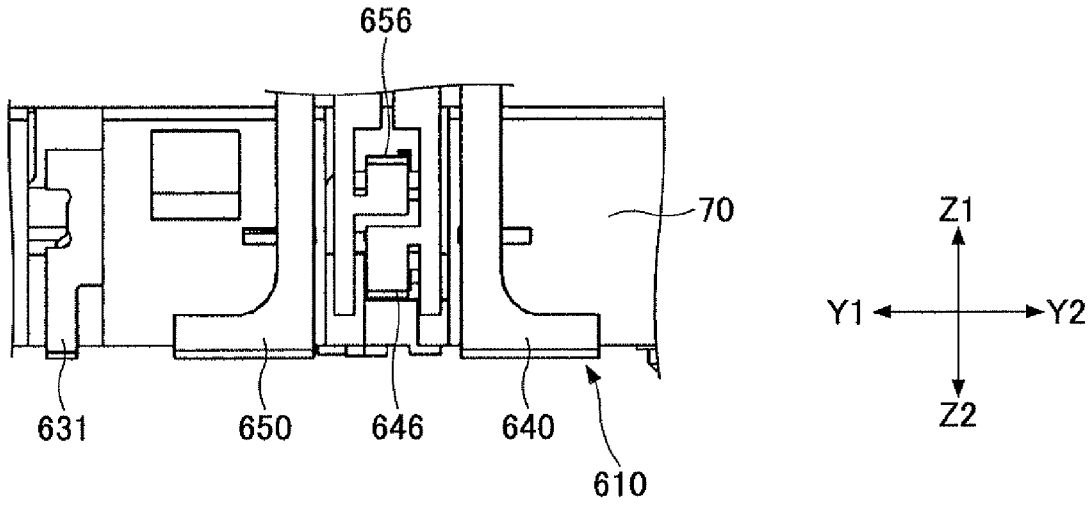
FIG. 34 is an X2-side view of part of a switch mechanism of the card connector according to the fourth embodiment of the present invention.
Figure 35:
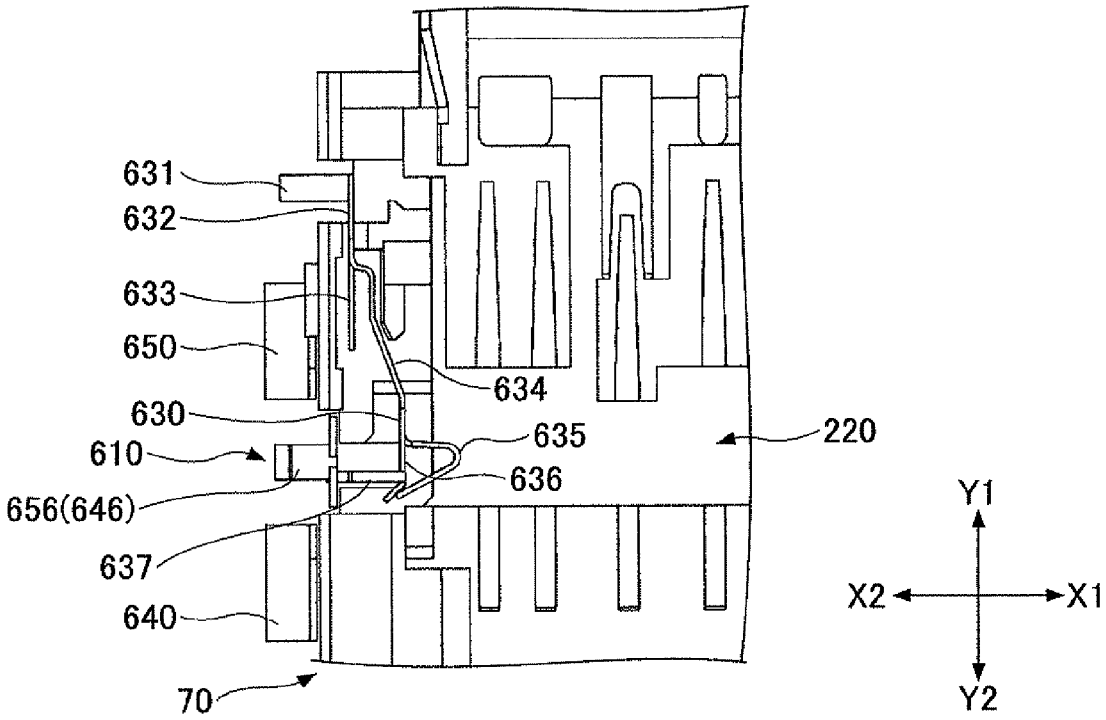
FIG. 35 is a plan view of the switch mechanism according to the fourth embodiment of the present invention.

FIG. 32 is a perspective view of the lower housing module 70. FIG. 33 is an enlarged view from the X2 side of the circled portion of the lower housing module 70 indicated by arrow H in FIG. 32. FIG. 34 is an X2-side view of part of the switch mechanism 610. FIG. 35 is a plan view of the switch mechanism 610.

Referring to FIG. 32 through FIG. 35, the switch mechanism 610 is provided on the X2 side of the card insertion part 220. The switch mechanism 610 includes a movable terminal 630, a first fixed terminal 640, and a second fixed terminal 650. The movable terminal 630, the first fixed terminal 640, and the second fixed terminal 650 have the same shapes as the movable terminal 530, the first fixed terminal 540, and the second fixed terminal 550, respectively, of the above-described third embodiment except that the first wiping part 538 and the second wiping part 539 and the first contact part 546 and the second contact part 556 of the third embodiment are different in shape from the corresponding parts of the switch mechanism 610 of the fourth embodiment. Accordingly, the detecting operation of the switch mechanism 610 is different in timing from that of the switch mechanism 510.

Figure 36A:
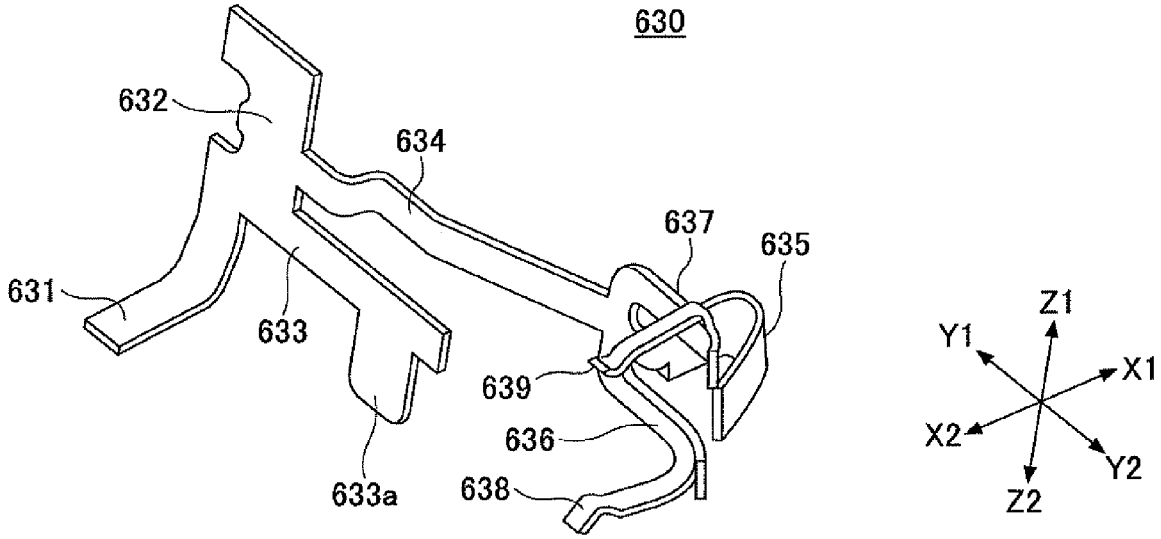
FIG. 36A is a perspective view of a movable terminal of the switch mechanism according to the fourth embodiment of the present invention.

FIG. 36A is a perspective view of the movable terminal 630. Referring to FIG. 36A, like the movable terminal 530 (FIG. 25A) of the above-described third embodiment, the movable terminal 630 includes a lead terminal 631, a support part 632, a holding part 633, a flexible part 634, a card contact part 635, a pair of arm parts 636 and 637, a first wiping part 638, and a second wiping part 639.

Figure 36B:
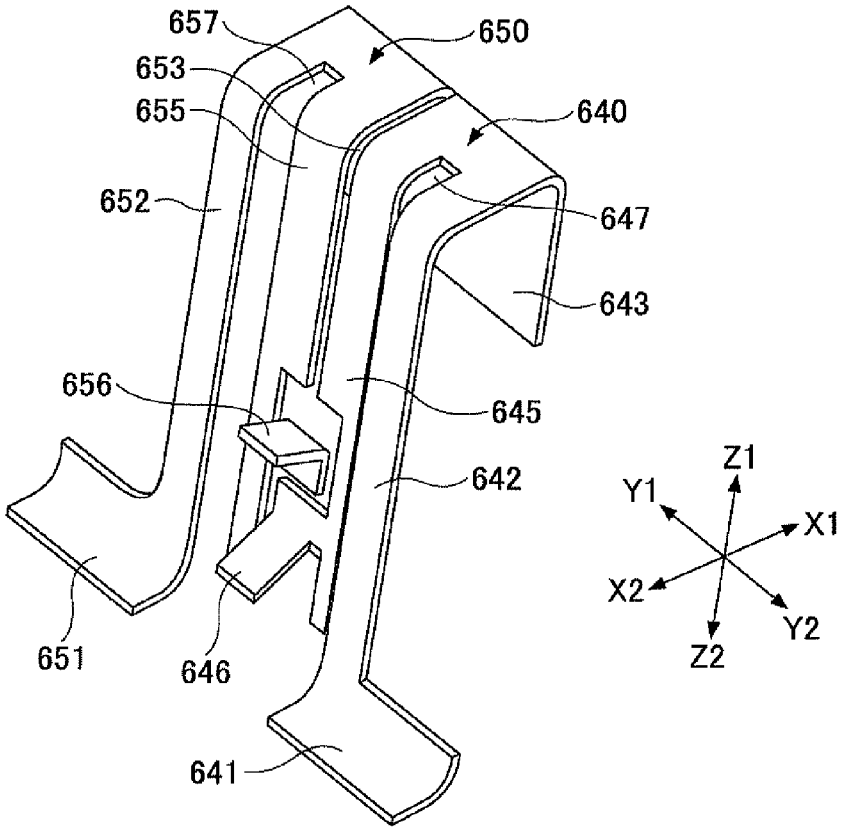
FIG. 36B is a perspective view of a first fixed terminal and a second fixed terminal of the switch mechanism according to the fourth embodiment of the present invention.

FIG. 36B is a perspective view of the first fixed terminal 640 and the second fixed terminal 650.

Referring to FIG. 36B, like the first fixed terminal 540 of the above-described third embodiment, the first fixed terminal 640 includes a contact part 641, a vertical part 642, an engagement part 643, a drooped part 645, and a first contact part 646. The contact part 641 has an L-letter shape with a horizontal surface to be soldered to a circuit pattern on the printed board and a vertical surface.

The vertical part 642 extends in a vertical direction (the Z1 direction) from the contact part 641 so as to have its upper end positioned above the lower housing module 70 as illustrated in FIG. 31 through FIG. 33. The engagement part 643 extends in the X1 direction from the upper end of the vertical part 642 to be bent downward so as to have its lower end press-fit into a slit provided at the upper surface of the lower housing module 70.

The drooped part 645 stems from the upper end of the engagement part 643 to extend downward side by side with the vertical part 642 (with an offset along the X-axis) with a gap 647 between the drooped part 645 and the vertical part 642. The first contact part 646 is provided at the lower end of the drooped part 645 so as to face the first wiping part 638.

Like the first fixed terminal 640, the second fixed terminal 650 has a crank shape in a view from the Y1 side. The second fixed terminal 650 includes a contact part 651, a vertical part 652, an engagement part 653, a drooped part 655, and a second contact part 656. The contact part 651 has an L-letter shape with a horizontal surface to be soldered to a circuit pattern on the printed board and a vertical surface.

The vertical part 652 extends in a vertical direction (the Z1 direction) from the contact part 651 so as to have its upper end positioned above the lower housing module 70 as illustrated in FIG. 31 through FIG. 33. The engagement part 653 extends in the X1 direction from the upper end of the vertical part 652 to be bent downward so as to have its lower end press-fit into a slit provided at the upper surface of the lower housing module 70.

The drooped part 655 stems from the upper end of the engagement part 653 to extend downward side by side with the vertical part 652 (with an offset along the X-axis) with a gap 657 between the drooped part 655 and the vertical part 652. The first contact part 656 is provided at the lower end of the drooped part 655 so as to face the second wiping part 639.

Figure 37:
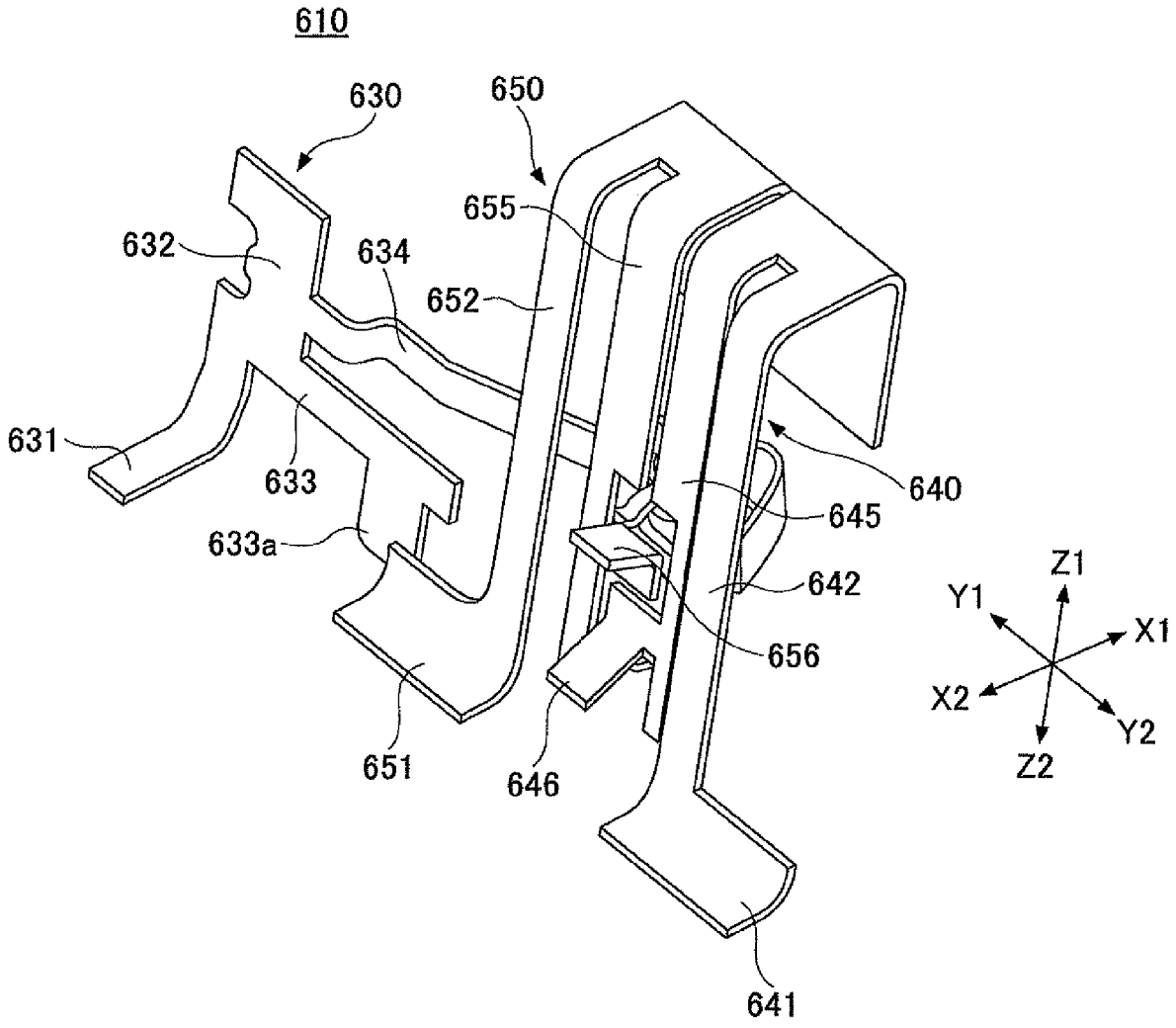
FIG. 37 is an X2-side perspective view (from outside the lower housing module) of the movable terminal, the first fixed terminal, and the second fixed terminal in an attached state according to the fourth embodiment of the present invention.
Figure 38:
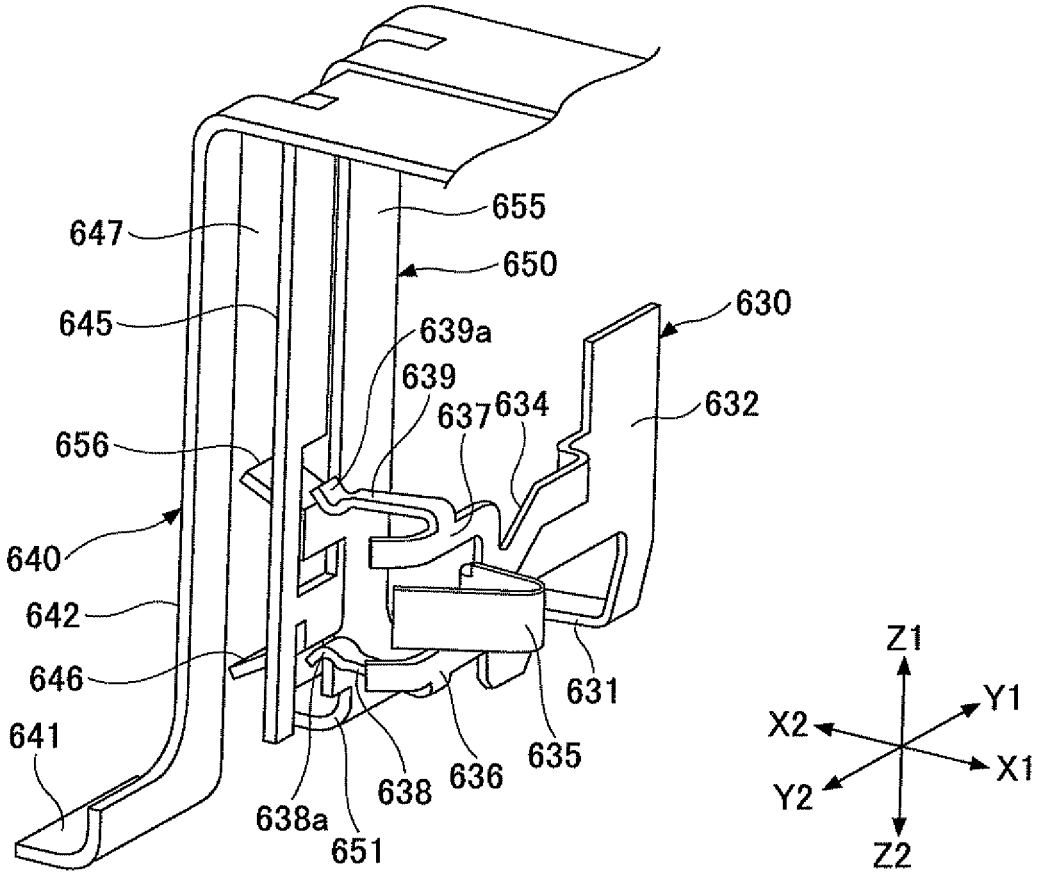
FIG. 38 is an X1-side, perspective view (from inside the lower housing module) of the movable terminal, the first fixed terminal, and the second fixed terminal in the attached state according to the fourth embodiment of the present invention.

FIG. 37 is an X2-side perspective view (from outside the lower housing module 70) of the movable terminal 630, the first fixed terminal 640, and the second fixed terminal 650 in an attached state. FIG. 38 is an X1-side perspective view (from inside the lower housing module 70) of the movable terminal 630, the first fixed terminal 640, and the second fixed terminal 650 in the attached state. In FIG. 37 and FIG. 38, the engagement parts 643 and 653 and the lower housing module 70 are not illustrated.

As illustrated in FIG. 37 and FIG. 38, in the switch mechanism 610, the first wiping part 638 and the second wiping part 639 of the movable terminal 630 face (are opposed to) the first contact part 646 of the first fixed terminal 640 and the second contact part 656 of the second fixed terminal 650, respectively, from inside the lower housing module 70.

The first contact part 646 of the first fixed terminal 640 is inclined downward. The first wiping part 638 includes a contact part 638*a* at its end. The contact part 638*a* is rounded and has its end inclined downward so as to reduce sliding resistance at the time of contact with (the lower surface of) the first contact part 646. The second contact part 656 of the second fixed terminal 650 is inclined upward. The second wiping part 639 includes a contact part 639*a* at its end. The contact part 639*a* is rounded and has its end inclined upward so as to reduce sliding resistance at the time of contact with (the upper surface of) the second contact part 656.

Unlike in the above-described third embodiment, in this embodiment, the first contact part 646 of the first fixed terminal 640 and the second contact part 656 of the second fixed terminal 650 are at the same lateral position (in the X1 and the X2 direction). That is, the first contact part 646 of the first fixed terminal 640 is positioned under the second contact part 656 of the second fixed terminal 650 so that the first contact part 646 and the second contact part 656 are laterally axisymmetric (in the X1 and the X2 direction).

Further, the first wiping part 638 extends further in the X2 direction than the second wiping part 639 so that the contact part 638*a* of the first wiping part 638 is positioned further in the X2 direction than the contact part 639*a* of the second wiping part 639. That is, the distance (interval) between the first wiping part 638 of the movable terminal 630 and the first contact part 646 of the first fixed terminal 640 is shorter (smaller) than the distance (interval) between the second wiping part 639 of the movable terminal 630 and the second contact part 656 of the second fixed terminal 650.

Therefore, in the detecting operation described below, as the movable terminal 630 elastically deforms in the X2 direction with the insertion of the first memory card 20, first, the first wiping part 638 comes into contact with the first contact part 646 of the first fixed terminal 640. Thereafter, when the movable terminal 630 further deforms elastically in the X2 direction, the second wiping part 639 comes into contact with the second contact surface 656 of the second fixed terminal 650.

Next, a description is given of a detecting operation of the switch mechanism 610.

Figure 39A:
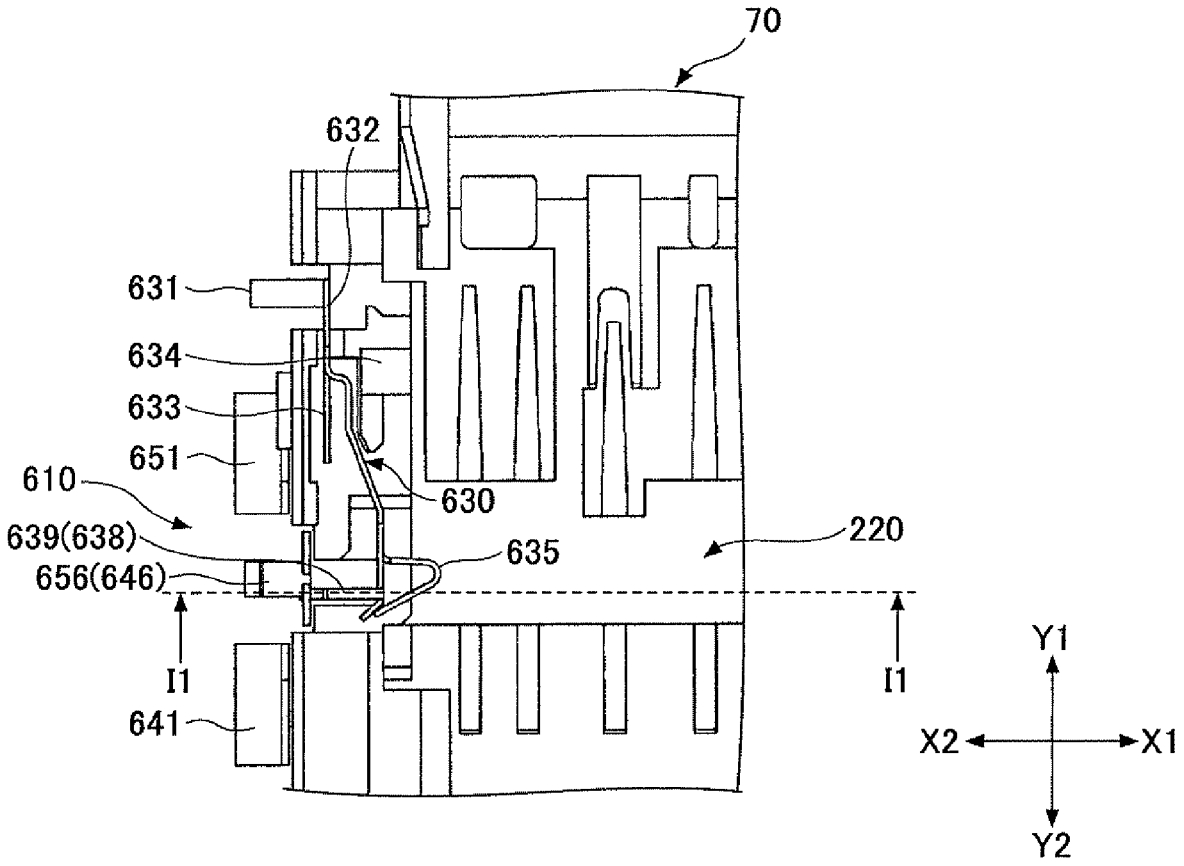
FIG. 39A is a plan view of the switch mechanism at a time when the first memory card is not inserted according to the fourth embodiment of the present invention.
Figure 39B:
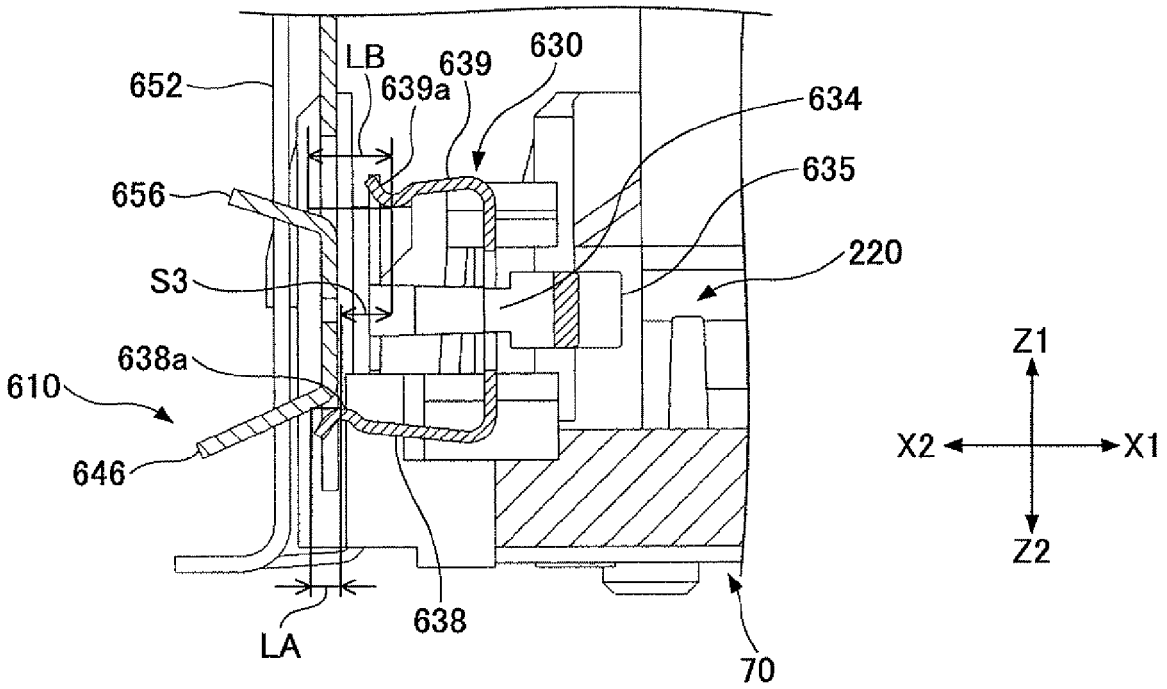
FIG. 39B is a cross-sectional view of the structure illustrated in FIG. 39A taken along broken line I1-I1 according to the fourth embodiment of the present invention.

FIG. 39A is a plan view of the switch mechanism 610 at a time when the first memory card 20 is not inserted. FIG. 39B is a cross-sectional view of the structure illustrated in FIG. 39A taken along broken line I1-I1.

Referring to FIGS. 39A and 39B, when the first memory card 20 is not inserted through the lower insertion slot 62 of the lower housing module 70, the flexible part 634 of the movable terminal 630 is at its original (reference) position with the card contact part 635 of the movable terminal 630 projecting into the card insertion part 220.

When the first memory card 20 is not inserted, the first wiping part 638 and the second wiping part 639 of the movable terminal 630 are separated from (out of contact with) the first contact part 646 of the first fixed terminal 640 and the second contact part 656 of the second fixed terminal 650, respectively. According to this embodiment, the first contact part 646 of the first fixed terminal 640 and the second contact part 656 of the second fixed terminal 650 are at the same lateral position (in the X1 and the X2 direction). On the other hand, there is an offset S3 (FIG. 393) between the contact part 638*a* of the first wiping part 638 and the contact part 639*a* of the second wiping part 639 along the X-axis.

Further, a distance LA between the contact part 638*a* of the first wiping part 638 and (the lower surface of) the contact part 646 of the first fixed terminal 640 is shorter than a distance LB between the contact part 639*a* of the second wiping part 639 and (the upper surface of) the contact part 656 of the second fixed terminal 650 by a predetermined ratio. For example, the distance LA may be approximately half of the distance LB.

That is, according to this embodiment, the distance LA is shorter than the distance LB (LA<LB). Accordingly, when the flexible part 634 of the movable terminal 630 is displaced in the X2 direction, first, the contact part 638*a* of the first wiping part 638 comes into contact with the first contact part 646 of the first fixed terminal 640. Then, the flexible part 634 of the movable terminal 630 is further displaced in the X2 direction so that the contact part 639*a* of the second wiping part 639 comes into contact with the contact part 656 of the second fixed terminal 650. Therefore, according to the switch mechanism 610 of this embodiment, the state where a detection signal is obtained from the first fixed terminal 640 and the state where detection signals are obtained from the first fixed terminal 640 and the second fixed terminal 650 are switched with a time difference in accordance with the amounts of displacement of the first wiping part 638 and the second wiping part 639 of the movable terminal 630.

Figure 39C:
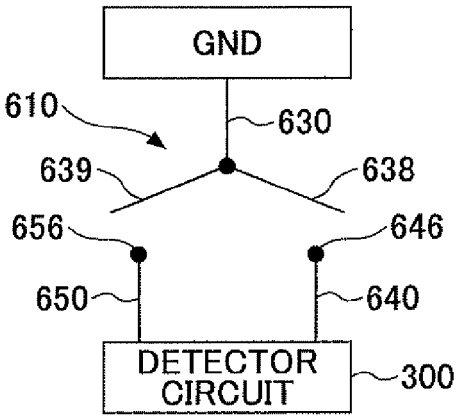
FIG. 39C is a schematic diagram illustrating the state of the switch mechanism when the first memory card is not inserted according to the fourth embodiment of the present invention.

FIG. 39C is a schematic diagram illustrating the state of the switch mechanism 610 when the first memory card 20 is not inserted.

Referring to FIG. 39C, the contact part 638*a* of the first wiping part 638 and the contact part 639*a* of the second wiping part 639 of the movable terminal 630 are separated from the first contact part 646 of the first fixed terminal 640 and the second contact part 656 of the second fixed terminal 650, respectively (in a neutral position), so that the first wiping part 638 and the second wiping part 639 are out of contact with the first contact part 646 and the second contact part 656, respectively, to be in OFF state.

Accordingly, the detector circuit 300 receives no detection signals from the switch mechanism 610, and determines that the first memory card 20 is not inserted based on the combination of the output states of detection signals (OFF, OFF) from the first fixed terminal 640 and the second fixed terminal 650.

Figure 40A:
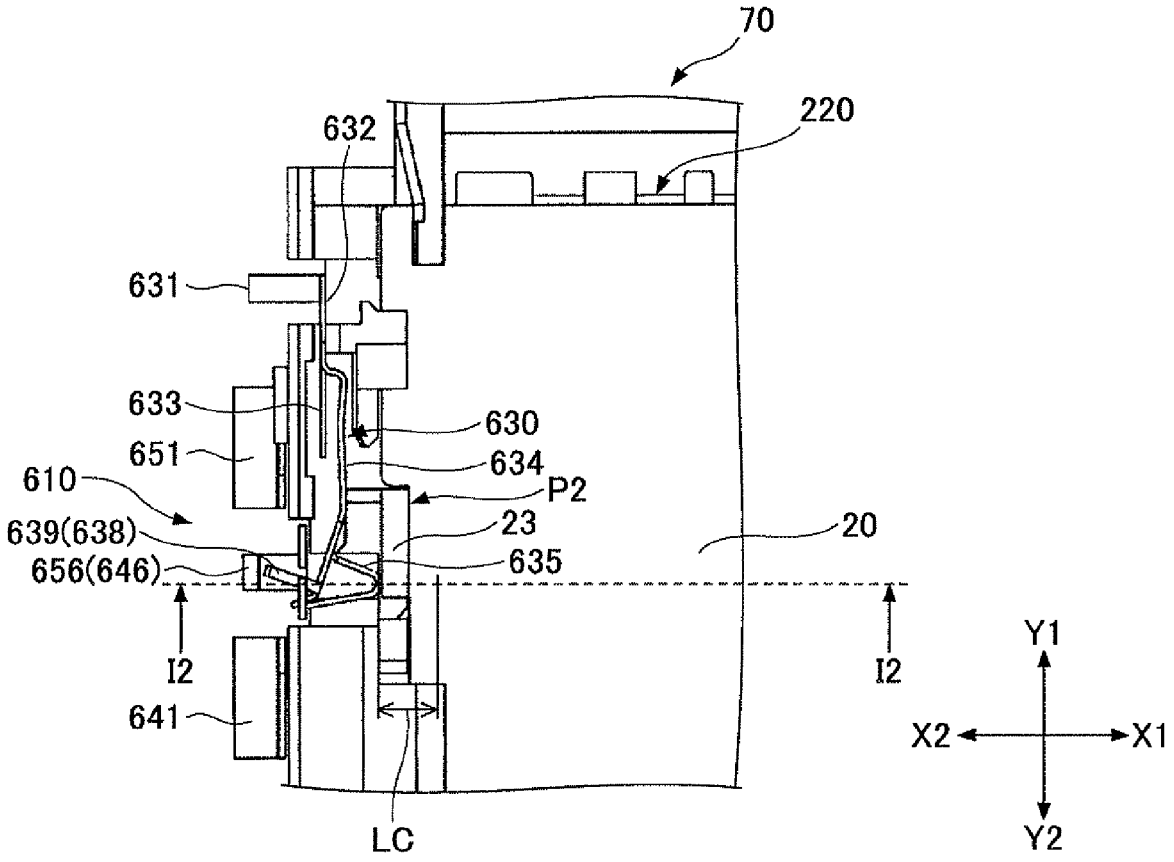
FIG. 40A is a plan view of the switch mechanism at a time when the first memory card in the write enable state is inserted into the card insertion part according to the fourth embodiment of the present invention.
Figure 40B:
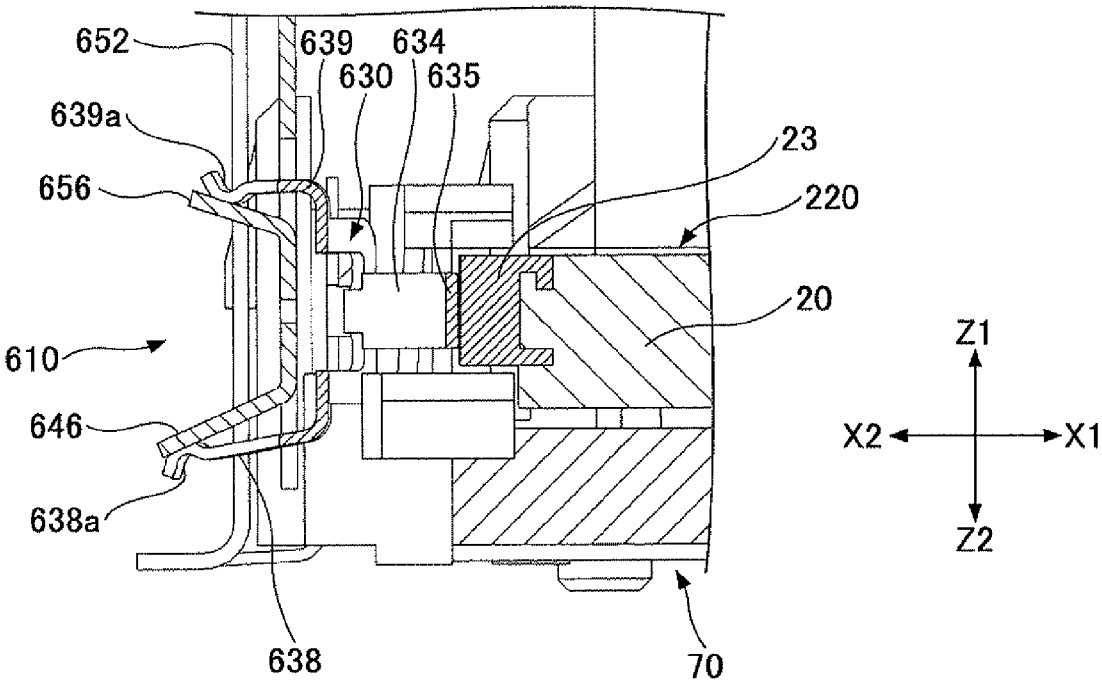
FIG. 40B is a cross-sectional view of the structure illustrated in FIG. 40A taken along broken line I2-I2 according to the fourth embodiment of the present invention.

FIG. 40A is a plan view of the switch mechanism 610 at a time when the first memory card 20 in the write enable state is inserted into the card insertion part 220. FIG. 40B is a cross-sectional view of the structure illustrated in FIG. 40A taken along broken line I2-I2.

Referring to FIGS. 40A and 40B, when the first memory card 20 is inserted through the lower insertion slot 62 of the lower housing module 70, the card contact part 635 of the movable terminal 630 comes into contact with the X2-side surface of the first memory card 20 to be pushed outward in the X2 direction.

Further, when the writing indication member 23 of the first memory card 20, inserted into the card insertion part 220 of the lower housing module 70 and attached, is at the write enable position P2, the card contact part 635 of the movable terminal 630 comes into contact with the writing indication member 23.

As a result, the card contact part 635 of the movable terminal 630 comes into contact with the X2-side surface of the writing indication member 23 to be displaced in the X2 direction. In this case, the amount of displacement of the card contact part 635 is greater than the distance LB between the contact part 639*a* of the second wiping part 639 and the second contact part 656 of the second fixed terminal 650 (FIG. 39B). That is, when the writing indication member 23 is in the write enable state, letting the amount of displacement of the first wiping part 638 and the second wiping part 639 of the movable terminal 630 be LC, the distance LA, the distance LB, and the distance LC satisfy LA<LB<LC. Accordingly, the contact part 638*a* of the first wiping part 638 and the contact part 639*a* of the second wiping part 639 come into contact with (the lower surface of) the first contact part 646 of the first fixed terminal 640 and (the upper surface of) the second contact part 656 of the second fixed terminal 650, respectively.

During the operation of detecting the first wiping part 638 and the second wiping part 639, when the first wiping part 638 and the second wiping part 639 are displaced the distance LA, the contact part 638*a* of the first wiping part 638 comes into contact with the first contact part 646 of the first fixed terminal 640. Then, the first wiping part 638 and the second wiping part 639 are further displaced in the X2 direction with the contact part 638*a* of the first wiping part 638 sliding on and along the lower surface of the first contact part 646 of the first fixed terminal 640 while performing a wiping operation. When the first wiping part 638 and the second wiping part 639 are displaced the distance LB, the contact part 639*a* of the second wiping part 639 comes into contact with the second contact part 656 of the second fixed terminal 650.

Then, the card contact part 635 of the movable terminal 630 is pushed outward further in the X2 direction, so that the contact part 639*a* of the second wiping part 639 also slides on the upper surface of the second contact part 656 of the second fixed terminal 650 to perform a wiping operation. In this operating state, the first wiping part 638 and the second wiping part 639 are bent to widen the gap between the first wiping part 638 and the second wiping part 639, sliding along the inclined lower and upper surfaces of the first contact part 646 and the second contact part 656, respectively. Accordingly, the first wiping part 638 and the second wiping part 639 are bent to move away from each other along the Z-axis, so as to ensure their contacts with the first contact part 646 and the second contact part 656, respectively, with increasing pressing contact forces.

Figure 40C:
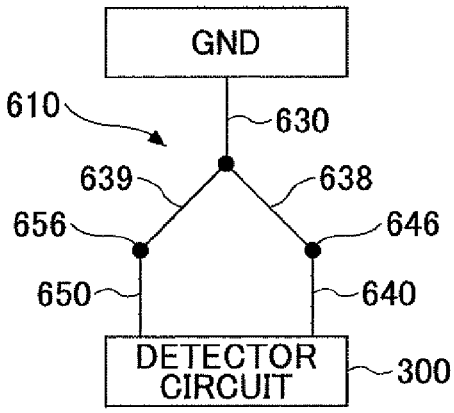
FIG. 40C is a schematic diagram illustrating the operating state of the switch mechanism when the first memory card in the write enable state is inserted according to the fourth embodiment of the present invention.

FIG. 40C is a schematic diagram illustrating the operating state of the switch mechanism 610 when the first memory card 20 in the write enable state is inserted.

Referring to FIG. 40C, the first wiping part 638 and the second wiping part 639 of the movable terminal 630 are in contact with the first contact part 646 of the first fixed terminal 640 and the second contact part 656 of the second fixed terminal 650, respectively, so that both of the first fixed terminal 640 and the second fixed terminal 650 are ON. Accordingly, the detector circuit 300 receives the detection signals output by the switch mechanism 610, and determines that the first memory card 20 is attached and the writing indication member 23 of the first memory card 20 is at the write enable position P2 based on the combination of the output states of detection signals (ON, ON) from the first fixed terminal 640 and the second fixed terminal 650.

Figure 41A:
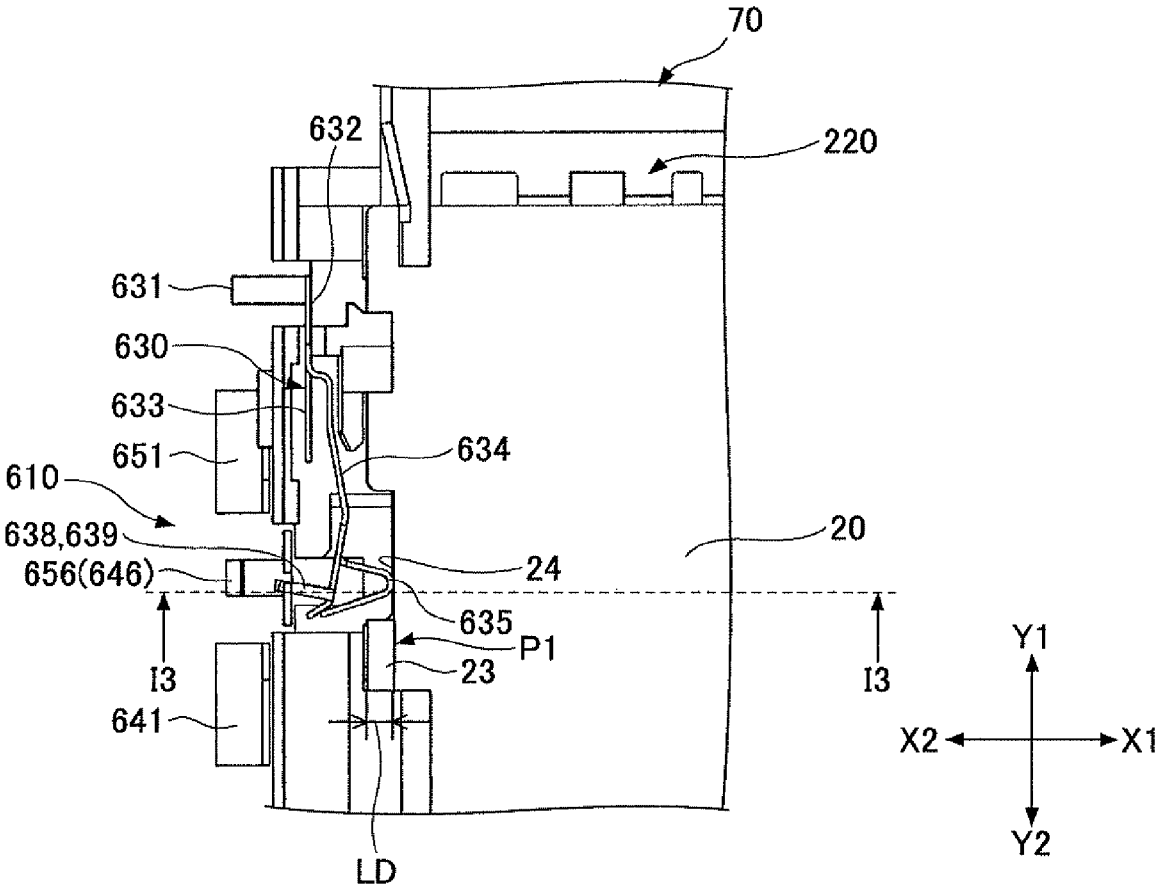
FIG. 41A is a plan view of the switch mechanism at a time when the first memory card in the write inhibit state is inserted into the card insertion part according to the fourth embodiment of the present invention.
Figure 41B:
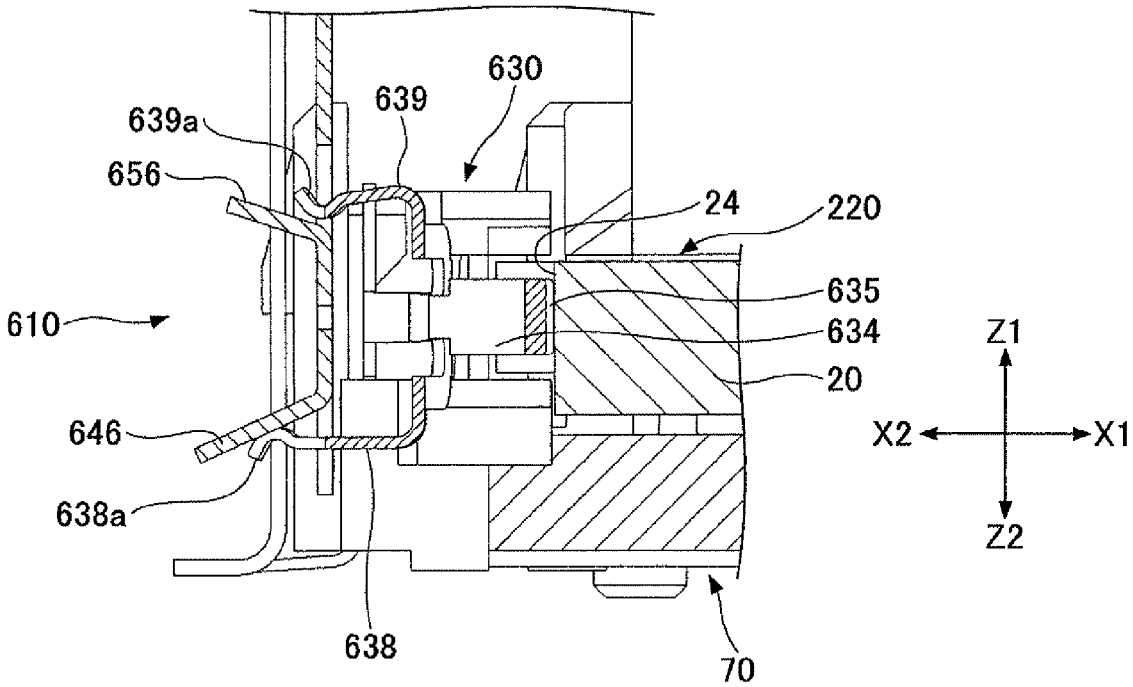
FIG. 41B is a cross-sectional view of the structure illustrated in FIG. 41A taken along broken line I3-I3 according to the fourth embodiment of the present invention.

FIG. 41A is a plan view of the switch mechanism 610 at a time when the first memory card 20 in the write inhibit state is inserted into the card insertion part 220. FIG. 41B is a cross-sectional view of the structure illustrated in FIG. 41A taken along broken line I3-I3.

Referring to FIGS. 41A and 41B, when the first memory card 20 is inserted through the lower insertion slot 62 of the lower housing module 70, the card contact part 635 of the movable terminal 630 comes into contact with the X2-side surface of the first memory card 20 to be pushed outward in the X2 direction.

Further, when the writing indication member 23 of the first memory card 20 inserted into the card insertion part 220 of the lower housing module 70 is at the write inhibit position P1, the recess 24 formed on the X2-side surface of the first memory card 20 comes into contact with the card contact part 635 of the movable terminal 630.

As a result, the first wiping part 638 and the second wiping part 639 of the movable terminal 630 return a distance LD (the width of the writing indication member 23) in the X1 direction when the card contact part 635 comes into contact with the recess 24 formed on the X2-side surface of the first memory card 20, after being displaced the distance LC (>LB) in the X2 direction with the insertion of the first memory card 20. The amount of returning in the X1 direction, or the distance LD, is determined to satisfy LA<LD<LB.

Therefore, the contact part 638*a* of the first wiping part 638 remains in contact with the first contact part 646 of the first fixed terminal 640, while the contact part 639*a* of the second wiping part 639 is separated from and out of contact with the second contact part 656 of the second fixed terminal 650.

Figure 41C:
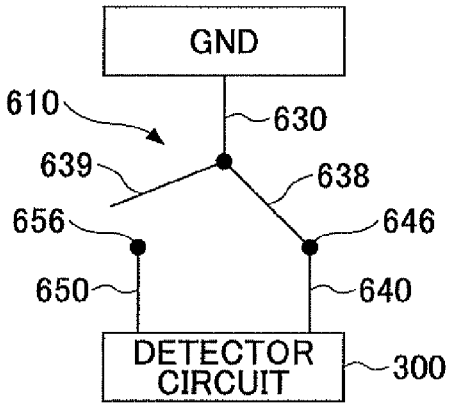
FIG. 41C is a schematic diagram illustrating the operating state of the switch mechanism when the first memory card in the write inhibit state is inserted according to the fourth embodiment of the present invention.

FIG. 41C is a schematic diagram illustrating the operating state of the switch mechanism 610 when the first memory card 20 in the write inhibit state is inserted.

Referring to FIG. 41C, the first wiping part 638 of the movable terminal 630 is in contact with the first fixed terminal 640 so that the first fixed terminal 640 is ON, while the second wiping part 639 of the movable terminal 630 is out of contact with the second fixed terminal 650 so that the second fixed terminal 650 is OFF. Accordingly, the detector circuit 300 receives the detection signal output by the switch mechanism 610, and determines that the first memory card 20 is attached and the writing indication member 23 of the first memory card 20 is at the write inhibit position P1 based on the combination of the output states of detection signals (ON, OFF) from the first fixed terminal 640 and the second fixed terminal 650.

Thus, according to the card connector 600, the amount of displacement of the movable terminal 630 changes based on the state of the first memory card 20 inserted, so that the movable terminal 630 comes into contact with (ON) or loses contact with (OFF) the first fixed terminal 640 and/or the second fixed terminal 650. This reduces the number of movable terminals so as to facilitate assembly of a connector, thus making it possible to improve production efficiency.

In the above-described embodiments, a description is given of the case of inserting and attaching a memory card. However, what is inserted into the card connector is not limited to the memory card, and may be any electric devices as long as the electric devices are card-shaped. For example, such card-shaped devices may be without a memory as long as the card-shaped devices have such a function as to output an electrical signal in response to their insertion into the card connector.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present inventions have been described in detail, it should be understood that various changes, substitutions, and alterations could be made hereto without departing from the spirit and scope of the invention.

What is claimed is:

1. A card connector, comprising:

a housing including an insertion part into which a card is to be inserted; and a switch mechanism including a movable terminal and a plurality of fixed terminals, the movable terminal being configured to deform elastically in response to being pressed by the card upon an insertion of the card into the insertion part, the fixed terminals being provided in a direction in which the movable terminal is displaced by the elastic deformation, wherein the movable terminal is provided separately with respect to each of the fixed terminals, and the switch mechanism is configured to switch a state of connection of the movable terminal and the fixed terminals between a first state where the movable terminal is in contact with one of the fixed terminals, a second state where the movable terminal is in contact with each of the fixed terminals, and a third state where the movable terminal is out of contact with each of the fixed terminals based on an amount of the displacement of the movable terminal according to a presence or absence of the card in the insertion part and a shape of the card.

2. The card connector as claimed in claim 1, wherein the fixed terminals have first ends supported by the housing and second ends configured to be connected to circuit patterns on a printed board.

3. The card connector as claimed in claim 1, wherein the fixed terminals are electrode patterns formed on a surface of a printed board on which the housing is to be mounted.

4. The card connector as claimed in claim 1, wherein the movable terminal has a first end supported by the housing and a second end positioned to face the insertion part in the housing.

5. The card connector as claimed in claim 1, wherein the amount of the displacement of the movable terminal changes in accordance with a position of a projection of the card at a time of the insertion of the card into the insertion part, the projection being slidable with respect to the card and provided on a side surface of the card with which the movable terminal is configured to come into contact, so as to indicate whether writing of data to the card is enabled or inhibited, the card being a memory card.

6. The card connector as claimed in claim 1, wherein the movable terminal includes a first contact part and a second contact part configured to come into contact with a first one and a second one, respectively, of the fixed terminals based on the amount of the displacement of the movable terminal.

7. The card connector as claimed in claim 6, wherein the first contact part and the second contact part are different in length from each other in the direction in which the movable part is displaced, so as to allow the first contact part and the second contact part to be in contact with and out of contact with the corresponding fixed terminals at different time states.

8. The card connector as claimed in claim 6, wherein the first one and the second one of the fixed terminals are positioned with an offset in the direction in which the movable part is displaced, so as to allow the first contact part and the second contact part to be in contact with and out of contact with the first one and the second one, respectively, of the fixed terminals at different time states.

9. A card connector into which a card, including a card provided with a projection slidable with respect to the card, is insertable, the card connector comprising:

a housing into which the card is to be inserted; and a switch including a movable terminal configured to deform elastically in response to being pressed by the card upon an insertion of the card into the housing; and a first fixed terminal and a second fixed terminal each contactable with the movable terminal in accordance with a displacement of the movable terminal, wherein the movable terminal elastically deforms to one of a first position where the movable terminal is in contact with the first fixed terminal, a second position where the movable terminal is in contact with the second fixed terminal, and a third position where the movable terminal is out of contact with each of the first fixed terminal and the second fixed terminal, in accordance with a condition where the card is not inserted into the housing, the projection of the card inserted into the housing is at a first projection position, or the projection of the card is at a second projection position different from the first projection position.

10. The card connector as claimed in claim 9, wherein:

the first and second fixed terminals have respective ends thereof connected to circuit patterns on a printed board, and the switch is configured to output one of a first signal and a second signal different from each other or output no signal to the circuit patterns in accordance with whether the movable terminal is at the first position, the second position, or the third position, so as to indicate that the insertion of the card is detected and writing to the card is enabled, that the insertion of the card is detected and the writing to the card is inhibited, or that the card is not inserted.

* * * * *